US012187330B2

(12) United States Patent
Ghaly

(10) Patent No.: US 12,187,330 B2
(45) **Date of Patent: *Jan. 7, 2025**

(54) METHOD AND APPARATUS FOR AUTONOMOUS TRAIN CONTROL SYSTEM

(71) Applicant: Nabil N. Ghaly, Huntington Station, NY (US)

(72) Inventor: Nabil N. Ghaly, Huntington Station, NY (US)

( * ) Notice: Subject to any disclaimer, the term of this patent is extended or adjusted under 35 U.S.C. 154(b) by 905 days.

This patent is subject to a terminal disclaimer.

(21) Appl. No.: 17/300,250

(22) Filed: Apr. 28, 2021

(65) Prior Publication Data

US 2021/0253150 A1 Aug. 19, 2021

Related U.S. Application Data

(63) Continuation of application No. 15/330,632, filed on Oct. 20, 2016, now Pat. No. 11,021,178.

(Continued)

(51) Int. Cl.

| | |
|---|---|
| ***B61L 23/14*** | (2006.01) |
| ***B61L 3/16*** | (2006.01) |
| ***B61L 15/00*** | (2006.01) |
| ***B61L 23/18*** | (2006.01) |
| ***B61L 27/20*** | (2022.01) |
| ***B61L 27/40*** | (2022.01) |
| *B61L 25/02* | (2006.01) |
| *B61L 29/00* | (2006.01) |

(52) U.S. Cl.

CPC ..... *B61L 23/14* (2013.01); *B61L 3/16* (2013.01); *B61L 15/0058* (2024.01); *B61L 23/18* (2013.01); *B61L 27/20* (2022.01); *B61L 27/40* (2022.01); *B61L 25/021* (2013.01); *B61L 25/025* (2013.01); *B61L 29/00* (2013.01); *B61L 2201/00* (2013.01); *B61L 2205/00* (2013.01)

(58) Field of Classification Search

CPC ..... B61L 27/20; B61L 15/0027; B61L 2027/204; B61L 27/04; B61L 23/14; B61L 21/10; B61L 27/40; B61L 25/021; B61L 25/025; B61L 29/00; B61L 2201/00; B61L 2205/00; B61L 3/16; B61L 15/0058; B61L 23/18

USPC ..... 701/19, 20

See application file for complete search history.

(56) References Cited

U.S. PATENT DOCUMENTS

| | | | | |
|---|---|---|---|---|
| 7,578,485 | B1 * | 8/2009 | Ohmstede | B61L 23/34 246/182 R |
| 8,428,798 | B2 * | 4/2013 | Kull | B61L 27/20 701/19 |

(Continued)

*Primary Examiner* — Zachary L Kuhfuss

(57) ABSTRACT

A method and a structure for an Autonomous Train Control System (ATCS) are disclosed, and are based on a plurality of autonomous train control elements that operate independent of each other. An autonomous train control element operates within an allocated track space, and based on predefined rules. Further, autonomous train control elements are paired together to exchange operational data. Pursuant to the predefined rules, an autonomous train control element acquires needed track space from a paired element, and relinquishes track space that is not required for its autonomous operation to a paired element. Further, an autonomous train control element is assigned a priority level with respect to the acquisition/relinquishment of track space.

20 Claims, 38 Drawing Sheets

Autonomous Operation of Virtual Train

Related U.S. Application Data

(60) Provisional application No. 62/285,266, filed on Oct. 24, 2015.

(56) References Cited

U.S. PATENT DOCUMENTS 8,554,397 B1 * 10/2013 Nishinaga ..... B61L 3/00 701/19
9,718,487 B2 * 8/2017 Ghaly ..... B61L 27/20
10,232,866 B2 * 3/2019 Ghaly ..... B61L 27/04
10,579,073 B2 * 3/2020 Dembinski ..... A63G 7/00
10,611,388 B2 * 4/2020 Chung ..... B61L 15/0062
10,766,512 B2 * 9/2020 Garmson ..... B61L 25/048
11,021,178 B2 * 6/2021 Ghaly ..... B61L 27/20
11,214,288 B2 * 1/2022 Ghaly ..... B61L 27/60
11,760,396 B2 * 9/2023 Ghaly ..... B61L 25/06 701/19
11,945,483 B2 * 4/2024 Ghaly ..... B61L 15/0062
2011/0172856 A1 * 7/2011 Kull ..... B61L 15/0027 246/219
2015/0232110 A1 * 8/2015 Ghaly ..... B61L 27/20 246/62
2015/0307119 A1 * 10/2015 Ghaly ..... B61L 25/06 246/122 R
2016/0046308 A1 * 2/2016 Chung ..... B61L 27/20 701/20
2017/0113707 A1 * 4/2017 Ghaly ..... B61L 23/14
2017/0334473 A1 * 11/2017 Ghaly ..... B61L 15/0018
2018/0120862 A1 * 5/2018 Dembinski ..... A63G 25/00
2019/0168788 A1 * 6/2019 Ghaly ..... B61L 27/60
2020/0108848 A1 * 4/2020 Garmson ..... B61L 3/125
2023/0150559 A1 * 5/2023 Ghaly ..... B61L 27/20 701/19
2024/0017753 A9 * 1/2024 Ghaly ..... B61L 27/20
2024/0025463 A1 * 1/2024 Ghaly ..... B61L 23/007

* cited by examiner

Autonomous Operation of Physical Train

Autonomous Operation of Physical Train

Physical Train Signature

Propagation of Train Failure Information

Autonomous Operation of Virtual Train

Autonomous Operation of interlocking Element

Autonomous Operation of interlocking Element

Autonomous Operation of interlocking Element

Autonomous Operation of interlocking Element

Route Section Designation

Autonomous Operation of interlocking Element

Advance Route Setting

Autonomous Operation of interlocking Element

Creation of Virtual Train

Autonomous Operation of interlocking Element

Autonomous Operation of interlocking Element

Autonomous Operation of interlocking Element

Autonomous Operation of X-ing Element

Autonomous Operation of ABSU Element

ABSU Operation – Physical Train Initialization

Autonomous Operation of Avatar Train

METHOD AND APPARATUS FOR AUTONOMOUS TRAIN CONTROL SYSTEM

PARENT CASE TEXT

This is a continuation application of patent application U.S. Ser. No. 15/330,632, filed in the Patent Office on Oct. 20, 2016, which benefits from provisional application of U.S. Ser. No. 62/285,266 filed on Oct. 24, 2015.

BACKGROUND OF THE INVENTION

Field of the Invention

This invention relates generally to train control systems, and more specifically to a train control system that includes a plurality of autonomous train control elements, wherein each element operates independently based on predefined rules.

During the Twentieth Century, train control systems evolved from the early fixed block, wayside technologies, to various fixed block, cab-signaling technologies, and in recent years to communications based train control (CBTC), A.K.A. moving block technologies. In a CBTC system a train receives a movement authority from a zone controller, and generates a stopping profile that governs its movement from its current position to the limit of the movement authority. A zone controller is normally located in a centralized location, and controls the movements of trains within an area of the railroad. The zone controller also interfaces with interlocking devices within its span of control to integrate interlocking functions with CBTC functionalities. Further, for certain installations, an auxiliary wayside signal (AWS) system is used in conjunction with CBTC to provide degraded modes of operation during CBTC failures.

The current industry practice is to provide site specific zone controller installations that reflect the configuration of the tracks and the operating environment within the areas controlled by the zone controller. Typically, a zone controller is based on a set of generic functions that are adapted to site specific conditions through an application engineering process. The customization of a zone controller to specific geographic location and specific operating environment is a time consuming task. It requires the development and certification of a vital data base. It also requires the development of new functions to adapt the CBTC technology to the customer's operating environment. This customization process leads to unique zone controller installations at different railroads as well as within the same railroad. Accordingly, there is a need to develop a new architecture that minimize the need for customization, and which provides, to the extent possible, a high level of implementation and operational flexibility through the use of autonomous system elements.

Description of Prior Art

In a fixed block wayside signal system, the tracks are divided into a plurality of blocks, wherein each block includes a train detection device such as a track circuit or axle counters to detect the presence of a train within the block. Vital logic modules employ train detection information to activate various aspects at a plurality of wayside signals in order to provide safe train separation between trains. An automatic train stop is normally located at each wayside signal location to enforce a stop aspect.

Cab-signaling technology is well known, and has evolved from fixed block, wayside signaling. A cab-signaling system employs fixed cab-signaling blocks, wherein a track circuit is used within each block to detect the presence of a train. Typically, a cab-signal system includes wayside elements that generate discrete speed commands based on a number of factors that include train detection data, civil speed limits, train characteristics, and track geometry data. The speed commands are injected into the running rails of the various cab-signaling blocks, and are received by trains operating on these blocks via pickup coils. A cab-signal system also includes car-borne devices that present the speed information to train operators, and which ensure that the actual speed of a train does not exceed the safe speed limit received from the wayside.

CBTC technology is also known in the art, and has been gaining popularity as the technology of choice for new transit properties. A CBTC system is based on continuous two-way communications between intelligent trains and Zone controllers located on the wayside. An intelligent train determines its own location, and generates and enforces a safe speed profile. There are a number of structures known in the art for a train to determine its own location independent of track circuits. One such structure uses a plurality of passive transponders that are located on the track between the rails to provide reference locations to approaching trains. Using on-board odometry equipment, such as a tachometer, accelerometer, etc., the vital onboard computer continuously calculates the location and speed of the train between transponders.

The operation of CBTC is based on the moving block principle, which requires trains in an area to continuously report their locations to a Zone Controller. In turn, the Zone Controller transmits to all trains in the area a data map that contains the topography of the tracks (i.e., grades, curves, super-elevation, etc.), the civil speed limits, and the locations of wayside signal equipment. The Zone controller, also, tracks all trains in its area, calculates and transmits to each train a movement authority limit. A movement authority is normally limited by a train ahead, a wayside signal displaying a stop indication, a failed track circuit, an end of track, or the like. Upon receiving a movement authority limit, the onboard computer generates a speed profile (speed vs. distance curve) that takes into account the limit of the movement authority, the civil speed limits, the topography of the track, and the braking characteristics of the train. The onboard computer, also, ensures that the actual speed of the train does not exceed the safe speed limit.

The current invention provides a new architecture that evolves CBTC technology to a distributed set of autonomous vital train control elements that are located on moving vehicles, and at certain fixed wayside locations. These elements are interconnected by an intelligent communication network that pairs selected train control elements together, based on the locations and configurations of the moving vehicles. This new architecture does not employ a zone controller, and each autonomous train control element operates independently based on pre-defined rules.

OBJECT OF THE INVENTION

This invention relates to train control systems, and in particular to a communication based train control system that employs a distributed set of autonomous train control elements (hereinafter referred to as "train control elements" or "autonomous elements" or "generic autonomous elements"). Each train control element operates based on predefined set of rules that define the functions performed within the element, as well as the data to be exchanged between the various elements. Accordingly, it is an object of the current invention to provide a method for a train control system that is founded on a plurality of generic autonomous elements located on board trains as well as at trackside locations (if used), and which is linked by a data communication network.

It is also an object of the current invention to provide a train control system that employs a plurality of autonomous elements to control the movement of trains on the tracks within a section of the railroad, wherein the elements are linked by a data communication network, and wherein the entire track space within said section of the railroad is allocated between these autonomous elements.

It is a further object of the current invention to provide a train control system that employs a plurality of autonomous elements to control the movement of trains on the tracks within a section of the railroad, wherein the elements are linked by a data communication network, and wherein said data communication network provides paired communication configurations to the autonomous elements.

It is another object of this invention to provide a train control system that includes a plurality of generic autonomous elements located on board trains and at fixed locations on the wayside, and which are linked by a data communication network.

It is a further object of this invention to provide a train control system that includes a plurality of generic autonomous elements that are linked by a data communication network, wherein each element performs its functions within an allocated section of the track space, and wherein each element can relinquish part of the track space it holds to another element.

It is also an object of this invention to provide a train control system that includes a plurality of generic autonomous elements that are linked by a data communication network, wherein said autonomous elements are of different types, wherein one type of the autonomous elements is defined as a train control module onboard a physical train that possess a section of the track space, wherein said section of the track space includes a first subsection that is occupied by the physical train, and a second subsection that corresponds to a movement authority limit for the physical train.

It is also a further object of this invention to provide a train control system that includes a plurality of generic autonomous elements that are linked by a data communication network, wherein said autonomous elements are of different types, and wherein one type of the autonomous elements is defined as a virtual train that holds a section of track space that is not occupied or owned by a physical train.

It is still an object of this invention to provide a train control system that includes a plurality of generic autonomous elements that are linked by a data communication network, wherein said autonomous elements are of different types, and wherein one type of the autonomous elements is defined as an interlocking element that controls physical interlocking devices. The interlocking element also establishes an interlocking route for an approaching train, and relinquishes the track space associated with said route to the train.

It is a further object of this invention to provide a train control system that includes a plurality of generic autonomous elements that are linked by a data communication network, wherein said autonomous elements are of different types, and wherein one type of the autonomous elements is defined as an absolute block signal unit ("ABSU") that controls train movement to a section of track space during a failure condition.

It is another object of this invention to provide a train control system that includes a plurality of generic autonomous elements that are linked by a data communication network, wherein each of said autonomous elements operates independently based on predefined rules.

It is also an object of this invention to provide a train control system that includes a plurality of generic autonomous elements that are linked by a data communication network, wherein said autonomous elements include a virtual train that operates within an allocated track space.

It is yet another an object of this invention to provide a train control system that includes a plurality of generic autonomous elements that are linked by a data communication network, wherein said autonomous elements include a virtual train that moves within the track space it holds, and wherein the virtual train relinquishes part of the track space it holds to a following virtual train.

It is still an object of this invention to provide a train control system that includes a plurality of generic autonomous elements that are linked by a data communication network, wherein said autonomous elements include a virtual train that moves within the track space that it holds, and wherein the virtual train relinquishes part of the track space it holds to a following physical train module.

It is a further object of the invention to provide a train control system that includes a plurality of autonomous elements that are linked by a data communication network, wherein said autonomous elements include a train control module onboard a physical train that moves within the track space that it holds, and wherein said train control module relinquishes part of the track space held by the physical train to a following virtual train.

It is also an object of this invention to provide a train control system that includes a plurality of generic autonomous elements that are linked by a data communication network, wherein said autonomous elements include a train control module onboard a physical train that moves within the track space that it holds, and wherein said train control module relinquishes part of the track space held by the physical train to a following physical train.

It is another object of this invention to provide a train control system that includes a plurality of generic autonomous elements that are linked by a data communication network, wherein said autonomous elements are of different types, wherein the autonomous elements interface with a Track Space Controller ("TSC"), and wherein the TSC includes a Train Control Module ("TCM"), or a train controller, that creates and retires virtual trains in response to autonomous actions by train control elements.

It is a further object of this invention to provide a train control system that includes a plurality of generic autonomous elements that are linked by a data communication network, wherein said autonomous elements are of different types, wherein the autonomous elements interface with a Track Space Controller ("TSC"), and wherein the TSC includes a simulation engine that controls the movement of virtual trains based on line parameters and/or collective operation of physical trains.

It is also an object of this invention to provide a train control system that includes a plurality of generic autonomous elements that are linked by a data communication network, wherein said autonomous elements are of different types, wherein the autonomous elements interface with a Track Space Controller ("TSC"), and wherein the TSC includes a module that interfaces with an Automatic Train Supervision (ATS) system that provides service delivery data, including train itineraries for physical trains.

It is further an object of this invention to provide a train control system that includes a plurality of generic autonomous elements that are linked by a data communication network, wherein said autonomous elements include a train control module onboard a physical train that moves within the track space that it holds, and wherein said train control module further includes a service control module that provides service delivery data, including train itineraries for the physical train.

It is another object of this invention to provide a train control system that includes a plurality of generic autonomous elements that are linked by a data communication network, wherein said autonomous elements are of different types, wherein the autonomous elements interface with a Track Space Controller ("TSC"), and wherein the TSC includes an interface with a Communication Interface Controller (CIC) that performs the function of pairing various autonomous train control elements together.

It is also an object of this invention to provide a train control system that includes a plurality of generic autonomous elements that are linked by a data communication network, wherein said autonomous elements are of different types, wherein the autonomous elements interface with a Track Space Controller ("TSC"), and wherein the TSC includes a physical interface module that enables communications with physical trains and trackside physical systems/devices.

It is still an object of this invention to provide a train control system that includes a plurality of generic autonomous elements that are linked by a data communication network, wherein said autonomous elements include a virtual train that operates in one of two modes defined as "active" mode and "standby" mode, wherein in the active mode the virtual train holds track space that is not occupied or held by a physical train, and in the standby mode the virtual train is awaiting activation to hold part of the track space.

It is also an object of this invention to provide a train control system that includes a plurality of generic autonomous elements that are linked by a data communication network, wherein said autonomous elements include a virtual train that operates autonomously pursuant to a set of rules, wherein pursuant to one rule, if the track space held by the virtual train falls below a certain threshold, the virtual train requests the Train Control Module to be switched to the "standby" mode (retired) and relinquishes its entire track space to an adjacent element.

It is further an object of this invention to provide a train control system that includes a plurality of generic autonomous elements that are linked by a data communication network, wherein said autonomous elements include a virtual train that operates autonomously pursuant to a set of rules, wherein pursuant to one of said rule, if the track space held by the virtual train exceeds a certain threshold, the virtual train requests the Train Control Module to create a new virtual train (by switching a virtual train in the "standby" mode to the "active" mode) and relinquishes excess track space to the newly created virtual train.

It is still an object of this invention to provide a train control system that includes a plurality of generic autonomous elements that are linked by a data communication network, wherein the train control system employs a cloud computing architecture, wherein autonomous elements of the train control system reside in the cloud and are configured as virtual train control elements that interact with corresponding elements in a physical train installation, and wherein one of said virtual train control elements is defined as an "avatar" train that corresponds to a physical train.

It is also an object of this invention to provide a train control system that includes a plurality of generic autonomous elements that are linked by a data communication network, wherein one of said plurality of elements is defined as an absolute block signal unit that operates in an autonomous mode during a failure condition to capture track space vacated by a train, and is used to provide backup operation during said failure condition.

It is a further object of this invention to provide a train control system that includes a plurality of generic autonomous elements that are linked by a data communication network, wherein one of said plurality of elements is defined as an absolute block signal unit that has a fixed track location, wherein the space between two consecutive ABSUs is defined as "Absolute Block Track Space" or "Absolute Block Space," and wherein during a backup mode of operation an ABSU operates in a "permissive" mode to permit a train to enter a vacant absolute block space, and operates in a "stop" mode to prevent a train to enter an occupied absolute block space.

It is also an object of the current invention to provide a train control system that includes a plurality of generic autonomous elements that are linked by a data communication network, wherein one of said plurality of elements is defined as an absolute block signal unit that has a fixed track location, wherein the ABSU assumes a "stop" state if an approaching physical train is not communicating.

It is another object of the current invention to provide a train control system that includes a plurality of autonomous elements that are linked by a data communication network, wherein one of said plurality of elements is defined as an absolute block signal unit that has a fixed track location, and wherein during a backup mode of operation, the ABSU maintains a "permissive" state if the approaching train is a virtual train or a communicating physical train.

It is a further object of the current invention to provide a train control system that includes a plurality of generic autonomous elements that are linked by a data communication network, wherein one of said plurality of elements is defined as an absolute block signal unit that has a fixed track location, and wherein during a backup mode of operation and upon receiving a request from an ABSU ahead of its location, the ABSU transforms its state from a "permissive" state to a "stop" state.

It is still an object of the current invention to provide a train control system that includes a plurality of generic autonomous elements that are linked by a data communication network, wherein one of said plurality of elements is defined as an absolute block signal unit that has a fixed track location, wherein while in the "stop" state, the ABSU accumulates track space vacated by a train that is moving away from the ABSU location, wherein upon accumulating track space equal to the "absolute block space" at this location, the ABSU transforms its state from "stop" to "permissive."

It is an additional object of this invention to provide a train control system that includes a plurality of generic autonomous elements that are linked by a data communication network, wherein each of the elements has an assigned level of priority related to the acquisition and relinquishing of track space.

It is a further object of this invention to provide a train control system that includes a plurality of generic autonomous elements that are linked by a data communication system, wherein one of said elements is defined as an interlocking element, wherein the interlocking element operates within an allocated track space and establishes and secures an interlocking route for an approaching train, and wherein said interlocking route is established over a switch in the normal position, a switch in the reverse position or a plurality of switches in various positions.

It is another object of this invention to provide a train control system that includes a plurality of generic autonomous elements that are linked by a data communication system, wherein one of said elements ensures safety for the movement of a train through an interlocking route, and wherein said interlocking route could be associated with an interlocking signal or a virtual signal.

It is still an object of this invention to provide a train control system that includes a plurality of generic autonomous elements that are linked by a data communication system, wherein one of said elements is an interlocking element that holds track space in the approach to a trailing point switch, and wherein said held track space is relinquished to an approaching train only if the approaching train provides an assurance that it will stop before reaching the trailing point switch.

It is also an object of this invention to provide a train control system that includes a plurality of generic autonomous elements that are linked by a data communication system, wherein one of said elements is an interlocking element that acquires track space from a train moving away from the interlocking, and wherein said interlocking element relinquishes said track space to a train at, or in the approach to the interlocking, pursuant to predefined set of rules.

It is another object of this invention to provide a train control system that includes a plurality of generic autonomous elements that are linked by a data communication system, wherein one of said elements is an interlocking element that acquires track space from a train moving away from the interlocking, and wherein said interlocking element relinquishes said track space to a similar interlocking element at an adjacent interlocking.

It is yet another object of this invention to provide a train control system that includes a plurality of generic autonomous elements that are linked by a data communication system, wherein one of said elements is an interlocking element that has a high level of priority related to the acquisition of track space, and wherein said interlocking element acquires track space from a train at, or in the approach of the interlocking, in the event an associated interlocking route is cancelled or a switch point associated with said interlocking route opens.

It is also an object of this invention to provide a train control system that includes a plurality of generic autonomous elements that are linked by a data communication system, wherein a train element approaching an interlocking requests permission to move over an interlocking route, and wherein an interlocking element processes the request from the train element, establishes and secures the requested route, and relinquishes track space to the train over the requested route after it is secured.

It is a further object of this invention to provide a train control system that includes a plurality of generic autonomous elements that are linked by a data communication system, wherein one of said elements is an interlocking element that acquires vacated track space from a train moving at or away from the interlocking, wherein said interlocking element monitors the track space associated with a track switch detector area, and the track space associated with the track switch approach locking areas, and wherein the interlocking element controls the locking condition of the track switch.

It is still another object of this invention to provide a train control system that includes a plurality of generic autonomous elements that are linked by a data communication system, wherein one of said elements is an interlocking element that acquires vacated track space from a train moving at or away from the interlocking, wherein said interlocking element monitors the track space associated with a track switch detector area, and the track space associated with the track switch approach locking areas, wherein the interlocking element controls the access for trains to move into said detector and approach locking areas, and wherein upon request from a train, the interlocking element relinquishes track space, associated with said detector and approach locking areas, to the train only if a route is established and protected, and the switch is locked.

It is yet another object of this invention to provide a train control system that includes a plurality of generic autonomous elements that are linked by a data communication system, wherein one of said elements is an interlocking element that monitors the track space associated with a track switch detector area, and the track space associated with the track switch approach locking areas, wherein the interlocking element monitors a stop assurance function of a train approaching the interlocking and is located within the track space associated with said track switch approach locking areas, and wherein the interlocking element can acquire track space associated with said track switch approach locking areas from the train as long as the stop assurance function indicates that the train can stop before moving into the track space associated with the track switch detector area.

It is another object of this invention to provide a train control system that includes a plurality of generic autonomous elements that are linked by a data communication system, wherein one of said elements is an interlocking element that controls the movement of trains over a track switch, wherein the interlocking element provides a plurality of routes over the track switch, wherein these routes include routes over the switch normal and routes over the switch reverse, as well as routes in different traffic directions, and wherein upon a request from a train, the interlocking element establishes the requested route, secures the route, and relinquishes track space over the requested route to the train.

It is also an object of this invention to provide a train control system that includes a plurality of generic autonomous elements of different types that are linked by a data communication system, wherein one type of said generic autonomous elements is a grade crossing controller that operates grade crossing gates and/or grade crossing warning lights, and wherein the grade crossing controller operates autonomously based on a set of rules.

It is still another object of the invention to provide a train control system that includes a plurality of generic autonomous elements of different types that are linked by a data communication system, wherein one type of said generic autonomous elements is a grade crossing controller that operates grade crossing gates and/or grade crossing warning lights, and wherein the grade crossing controller communicates with traffic light controllers that control the movement of vehicles approaching the grade crossing.

It is another object of the invention to provide a train control system that includes a plurality of generic autonomous elements of different types that are linked by a data communication system, wherein one type of said generic autonomous elements is a grade crossing controller that operates grade crossing gates and/or grade crossing warning lights, and wherein the grade crossing controller communicates with road vehicles approaching the grade crossing.

It is yet another object of the invention to provide a train control system that includes a plurality of generic autonomous elements of different types that are linked by a data communication system, wherein one type of said generic autonomous elements is a grade crossing controller that operates grade crossing gates and/or grade crossing warning lights, and wherein the grade crossing controller possess track space on all the tracks that are protected by the grade crossing.

It is also another object of the invention to provide a train control system that includes a plurality of generic autonomous elements of different types that are linked by a data communication system, wherein one type of said generic autonomous elements is a grade crossing controller that operates grade crossing gates and/or grade crossing warning lights, wherein the grade crossing controller possess track space on all the tracks that are protected by the grade crossing, wherein the grade crossing controller relinquishes track space to an approaching train only if the crossing gates and/or the crossing warning light are activated.

It is still another object of the invention to provide a train control system that includes a plurality of generic autonomous elements of different types that are linked by a data communication system, wherein one type of said generic autonomous elements is a grade crossing controller that operates grade crossing gates and/or grade crossing warning lights, wherein the grade crossing controller has high priority related to the acquisition of track space, and wherein the grade crossing controller acquires track space from an approaching train under certain operating conditions at the grade crossing.

It is a further object of this invention to provide a train control system that includes a plurality of generic autonomous elements that are linked by a data communication system, and which includes a structure that pairs autonomous elements together.

It is yet another object of this invention to provide a train control system that includes a plurality of generic autonomous elements that are linked by a data communication system, wherein a logical structure is used to pair a group of at least two autonomous elements together, and wherein one of the autonomous elements in said group relinquishes track space to another element in the group.

It is still an object of the current invention to provide a train control system that includes a plurality of generic autonomous elements that are linked by a data communication system, and which further includes a Communication Interface Controller (CIC) that interfaces with the Track Space Controller (TSC) to receive the identifications and locations of virtual and physical trains, as well as locations of interlocking, grade crossing and ABSU elements, wherein the CIC performs the function of pairing autonomous elements together, based on pre-defined rules and the relative geographical locations of the various elements.

It is also an object of the current invention to provide a train control system that includes a plurality of generic autonomous elements that are linked by a data communication system, wherein a Communication Interface Controller maintains data on which autonomous elements are paired together, and wherein the CIC dynamically changes the pairing configuration of the various autonomous elements to reflect train movements, statuses of interlocking elements, as well as traffic and failure conditions.

It is a further object of the current invention to provide a train control system that includes a plurality of generic autonomous elements that are linked by a data communication system, wherein a Communication Interface Controller is used to pair autonomous elements together, and wherein the Communication Interface Controller includes a processor module and memory modules that store information related to paired autonomous elements.

It is another object of the current invention to provide a train control system that includes a plurality of autonomous elements that are linked by a data communication system, wherein one type of said autonomous elements is defined as an Absolute Block Signal Unit (ABSU), wherein an ABSU is used during system initialization to perform a track sweep function, and wherein an ABSU includes axle counters that monitors the number of train axles that crossed its location.

It is also an object of this invention to provide a train control system that includes a plurality of autonomous elements that are linked by a data communication system, wherein magnetic levitation (Maglev) trains are used, wherein an ABSU is used during system initialization to perform a guideway sweep function, and wherein an ABSU operates based on the detection of power consumption in Maglev blocks.

It is a further object of the invention to provide a train control system that includes a plurality of autonomous elements that are linked by a data communication system, wherein one type of said elements is defined as virtual train, and wherein virtual trains are used to propagate operational and failure data in a daisy chain configuration within the ATCS territory.

BRIEF SUMMARY OF THE INVENTION

The foregoing and other objects of the invention are achieved in accordance with a preferred embodiment of the invention that provides an Autonomous Train Control System (ATCS) that employs a plurality of autonomous elements that are linked by a data communication network. The autonomous elements are of various types or categories, and include control modules onboard physical trains, virtual trains, interlocking elements, grade crossing elements (if used in a train control installation), and an optional absolute block signal unit that provides system initialization functions and backup modes of operation during failure conditions. The autonomous train control elements are interconnected by a data communication network that provides pairing of autonomous elements and each of the elements operates based on predefined set of rules.

The train control system disclosed in the preferred embodiment provides signal protection for trains operating on a section of the railroad (territory) that may include one or a plurality of tracks, and wherein the geographical territory along the various tracks within said section of the railroad is defined as "track space." As such the track space within a section of the railroad where the train control system is installed is allocated to the various train control elements that are installed or are operating in said section of the railroad. This allocation is dynamic, which means that during train operation an autonomous train control element can relinquish or acquire track space from another autonomous train control element based on predefined rules.

The train control system architecture disclosed in the preferred embodiment includes Track Space Controller (TSC) that interfaces with the autonomous train control elements and provides various functions, including providing computing resources (logical modules) and management of virtual trains, establishing communications with physical trains, maintain an updated rail line data base that includes the topographical data of the tracks located within the railroad section as well as the locations of wayside train control equipment, a simulation engine to control the movements of virtual trains, an interface with an automatic train supervision (ATS) system, and an interface with a Communication Interface Controller (CIC). The TSC does not directly control the movement of physical trains, but rather facilitates the flow of information between various autonomous train control elements.

Further, the train control system architecture disclosed in the preferred embodiment includes a Communication Interface Controller (CIC) that performs the main function of pairing groups of autonomous train control elements to communicate together, and exchange operating data. The CIC dynamically changes the pairing configuration of the various autonomous elements to reflect train movements, statuses of interlocking elements, statuses of grade crossing control devices (if used), as well as traffic and failure conditions. Further, the CIC interfaces with the Track Space Controller (TSC) to receive the identifications and locations of virtual and physical trains. The TSC also provides to the CIC data related to locations of interlocking & grade crossing controllers, and ABSU elements. The CIC operates based on predefined rules and performs the pairing function based in part on the relative locations of train control elements. For example, a train (physical or virtual) could be paired with a train ahead as well as with a following train. Alternatively, a train (physical or virtual) could be paired with an interlocking element, a grade crossing element or an ABSU element.

One of the characteristics of the preferred embodiment is to assign a track space acquisition priority to each category of autonomous train control elements. Pursuant to this structure, and under certain predefined conditions, a train control element with higher priority can acquire track space from a train control element with lower priority to maintain or ensure safe train operation. For example, an interlocking element that controls a track switch can acquire track space from an approaching physical train in the event the track switch point opens or becomes unlocked.

One of the main categories of autonomous train control elements is a train control module located onboard a physical train ("physical train") element. This module communicates via radio communication with paired train control elements to exchange operating data. In general, the physical train element acquires track space from a paired train control element ahead of its current location, and relinquishes vacated track space to a paired train control element located behind its current location. The physical train element determines the location and speed of the physical train using any of the train location determination subsystems known in the art. For example, the preferred embodiment employs a train location determination subsystem that is based on transponders located on the track to provide reference locations. Between transponders, odometry equipment located onboard a train continuously calculates train location and speed. Also, the onboard train control equipment includes a data base that provides track topography information as well as civil speed limits. In the preferred embodiment, the data base is uploaded from the Track Space Controller. Each physical train control element continuously sends its current location and speed to the Track Space Controller. Further, each physical train control element establishes a movement authority limit (MAL) based on the available track space it has acquired from paired elements. In addition, the physical train control element establishes a stopping profile that is based on the calculated movement authority limit. This stopping profile incorporates the civil speed limits within the MAL. The physical train control element ensures that the speed of the train does not violate the stopping profile, and that the physical train does not exceed its movement authority limit.

Upon entering a territory controlled by the Autonomous Train Control System (ATCS), a physical train is initialized to operate in the territory. The initialization process includes a number of functions. These functions include localization of the physical train, sweeping track space adjacent to the front and back ends of the train (also known as the "sieving function"), establishing communication with the Track Space Controller (TSC), transmitting physical train operating data to the TSC, allocating an initial track space to the physical train, and pairing the physical train with appropriate autonomous train control elements. Typically for the preferred embodiment, the physical train is initialized as a replacement of an existing virtual train, and by acquiring its allocated track space. The virtual train is then switched to a standby mode or state ("standby mode"). As such, the physical train receives an initial movement authority limit associated with the retired virtual train, and adjusted to account for the length of the physical train. One of the desired operating characteristics for the preferred embodiment is, to the extent possible, provides an "optimum" track space to a physical train. The optimum track space is predefined and serves the purpose of enabling the physical train to operate at maximum allowable operating speed within the territory. As such, and in view of the premise that physical trains have an assigned level of track space acquisition priority that is higher than that of virtual trains, a physical train requests track space from paired front virtual train to satisfy the requirement for an optimized track space. This process is repeated until the optimized track space is satisfied.

Under certain operating conditions, a physical train is requested to relinquish track space to a paired autonomous train control element that has a higher assigned level of track space acquisition priority. Upon receiving such request, the physical train relinquishes part or all of the requested track space provided that it does not violate safety rules. An example of such operating conditions is when an interlocking element requests track space from an approaching train in order to process a higher priority move over the interlocking. Under this condition, the approaching physical train relinquishes the requested track space only if it can stop using service brake prior to reaching the interlocking. Further, under rare operating conditions, a physical train will truncate its movement authority without relinquishing any track space, and resulting in an emergency brake application in order to mitigate safety hazards. An example of such operating condition is an open switch point within the track space assigned to the physical train.

Although physical trains have a high level of priority with respect to the acquisition of track space, this high priority level is reduced in the event of a failure or a loss of communication with a physical train. Under such operating condition, and especially if the physical train is not able to communicate with paired train control elements, the physical train is not able to relinquish vacated track space or acquire additional track space from another train control element. As such, the physical train retains the track space it had at the time of the failure. The movement of the failed physical train is then governed by operating rules and procedures. Typically, and as described in the preferred embodiment, the failed physical train receives authorization to proceed at restricted speed passed the limit of the track space it has. A physical or a virtual train that is following the failed train is not able to acquire additional track space, and is not able to move past its movement authority limit that is based on the track space it has. However, if an Absolute Block Signal Unit (ABSU) is used, and upon the movement of the failed physical train passed the nearest ABSU, track space vacated by the failed train is acquired by the ABSU and then relinquished to a newly activated virtual train.

Similarly, a train ahead that is moving away from the failed physical train is not able to relinquish vacated track space, and maintains the vacated track space until the failure condition is resolved by an ABSU train control element. As such, and based on one design choice, the resolution of this failure condition requires dual action on the part of the ABSU train control element. First, upon the movement of the train ahead past an ABSU location, the ABSU switches to the "stop" mode and starts to accumulate track space from the train moving away from its location. When the accumulated track space equals to the associated absolute block track space, the ABSU switches to the "permissive" mode to allow the failed train to move past its location. Second, upon the movement of the failed physical train passed the ABSU location, the ABSU requests the TSC to create or activate a new virtual train to occupy the track space that was assigned to the failed physical train. It should be noted that the track space that is transferred from the failed physical train to the newly activated virtual train extends from the location where the physical train failed (which is also the same location that marks the limit of the track space assigned to the train following the failed train) to the location of the ABSU. It should also be noted that upon the activation of the new virtual train, and assigning track space to it, the train following the failed train is able to acquire additional track space and move forward.

A second category of autonomous train control elements is defined as a "virtual train," and is designed to represent vacant track space. As such, virtual trains are logical elements that hold track space that is not assigned to physical trains, interlocking elements, grade crossings and/or ABSUs. In the preferred embodiment, virtual trains are driven by a simulation engine, which is a module included in the Track Space Controller (TSC). The simulation engine establishes an operating speed for each virtual train based on the average speed of physical trains operating in the area. Further, the simulation engine establishes a train length for each virtual train. A virtual train behaves similar to a physical train in term of establishing a movement authority limit that governs its movement within its assigned track space, as well as its interactions with other train control elements. Further, similar to physical trains, a virtual train is paired with other autonomous train control elements to relinquish/acquire track space. For example, a virtual train relinquishes vacated track space to a following train (physical or virtual), and acquire track space from a preceding autonomous train control element.

In addition, a virtual train implements a set of rules that govern its autonomous operation. A number of these rules are related to the amount of track space a virtual train can retain during operation on the line. More specifically, and in order to effectively manage track space allocation, the track space that is assigned to a virtual train is bounded by a "minimum track space" and a "maximum track space." If the actual track space assigned to a virtual train falls below the "minimum" track space, then the virtual train requests the TSC to switch its status (or state) to "standby," and relinquishes its entire track space to another train control element. Conversely, if the actual track space assigned to a virtual train exceeds the "maximum" track space, the virtual train requests the TSC to activate or create a new virtual train, and relinquishes "excess" track space to the newly created or activated virtual train. For the preferred embodiment, an "excess" track space is defined as the difference between the actual track space and an "initial" track space that is assigned to a virtual train when it is first created or activated.

A virtual train has a low level of priority related to the acquisition of track space, and as such provides operational flexibility for other train control elements in terms of acquiring and relinquishing track space. Further, in view of the premise that virtual trains are in effect used as a place holder for available track space, upon a request from the TSC, a virtual train relinquishes its entire track space and switches to the "standby" mode (or state) in order to enable the allocation of track space to a newly initialized physical train. Also, under certain operating conditions, and upon request from a following physical train, a virtual train relinquishes its entire track space to the physical train, and switches to the "standby" mode. An example of such operating conditions is during slow traffic conditions ahead, and wherein a physical train requires additional track space to continue to move forward. Similarly, under certain operating conditions, and upon a request from an interlocking element, a virtual train relinquishes its entire track space to the interlocking element, and switches to the "standby" mode. An example of such operating conditions is when the track space occupied by the virtual train is needed to enable an interlocking function.

For the preferred embodiment, and based on one design choice, virtual trains follow similar operating rules as physical trains. This includes compliance with civil speed restrictions, work zones, and operation within interlocking areas. This will maintain uniformity of train service. With respect to operation through stations, it is also a design choice to require virtual trains to make station stops using predefined dwell times, or to simply make virtual trains skip the various stations. Further, as would be understood by a person skilled in the art, the movement and behavior of virtual trains could be part of an algorithm that provides train regulation for physical trains. Such an algorithm could be dynamic, which means that certain operational parameters for virtual trains could be dynamically adjusted to optimize train regulation for physical trains.

Another autonomous train control element is defined as an Absolute Block Signal Unit (ABSU), and provides a backup mode of operation during failure conditions. Further, the ABSU provides certain functions related to system and train initializations. The ABSU operates based on the absolute permissive block concept, wherein a train is given a movement authority to proceed through a block from the entering boundary of the block to its exit boundary provided that the entire block is vacant. In a train control system based on autonomous operation, an absolute permissive block is defined as a signal block between two consecutives ABSUs. Further, the track space within an absolute permissive block is defined as the "absolute block track space." Conventional signaling installations use a plurality of track circuits or other means of train detection within an absolute permissive block to determine the status of the absolute block, i.e. vacant or occupied. For the preferred embodiment, axle counters are used to detect the number of axles in a train that crosses its location. An ABSU can then communicates with an adjacent ABSU, and exchange data provided by axle counters, to determine the status of the absolute block track space, i.e., occupied or vacant.

During regular operation of an Autonomous Train Control System (ATCS), trains operate close together and it is likely that a plurality of trains operate within an area defined as an absolute permissive block. Further, in an ATCS installation there is no centralized structure that keeps track of the number of trains operating within a certain area of the railroad. In addition, conventional technologies that employ fixed block train detection are not able to determine the exact number of trains within an area impacted by a failure in one or more. Although the proposed ABSU has the capability to determine the number of trains operating within the associated absolute permissive block, this is not necessary since the ATCS architecture has the direct capability of detecting a failure in a physical train.

In the preferred embodiment, the proposed autonomous ABSU elements employ a unique "signature" for each physical train. A signature is defined as one or a plurality of attributes that are associated with a physical train. Although a single attribute is sufficient for the operation of the ABSUs, it is desirable to use two attributes to define a signature for a physical train. Accordingly, the preferred embodiment uses the number of axles in a physical train, and a unique train ID embedded in a tag or transponder onboard the train to define the signature of a physical train. A tag or a transponder could be a passive transponder that stores a fixed train ID, or could be an active transponder that stores a variable train ID (i.e. the train ID is different for each train trip). Another design alternative is for the train ID to include two parts: a fixed part and a variable part that is based on the train trip. What is important is that the train ID remains fixed during a trip from an originating point to a destination point.

In the preferred embodiment, and similar to other autonomous train control elements, each ABSU is paired with train control elements that are operating in the vicinity of the ABSU. More specifically, each ABSU is normally paired with a train (physical or virtual) at or ahead of its location, and a train (physical or virtual) at or approaching its location. As such, an ABSU is continuously receiving information from an approaching train. However, during normal ATCS operation, the two trains that are paired with the ABSU (one ahead of the ABSU location and the second is in the approach to the ABSU location) directly exchange information without any involvement by the ABSU. If the approaching train is a physical train, and upon losing communication with the approaching physical train, or upon a failure on-board the physical train, the ABSU can detect such failure or a loss of communication (a loss of communication is automatically detected, while a failure is relayed directly to the ABSU). Alternatively, if a physical train that is not directly paired with an ABSU experiences a failure or a loss of communication, such failure condition is detected by an autonomous train control element that is paired with the failed physical train, and the failure information is relayed through a daisy chain of paired train control elements until it reaches the ABSU. For example, if a physical train that is paired with a virtual train (which in turn is paired with an ABSU) fails, then such failure is detected by the virtual train, and is relayed to the ABSU.

For the preferred embodiment, wherein the ABSUs operate autonomously, and in order to facilitate system initialization and backup mode of operation, each physical train transmits its signature to the autonomous train control elements it is paired with. Further, the train control equipment on-board physical trains include a structure that determines the number of axles in the train consist, and provisions for storing the train signature (the number of axles and the train ID). In addition, upon the detection of a failure condition on-board a physical train, failure information is propagated through a chain of paired autonomous train control elements in a manner that ensures that each ABSU detects the operating condition of a failed physical train approaching its location.

The ABSU has two modes of operation: a "standby" mode, and an "active" mode. Further, in the active mode, an ABSU can be in a "permissive" state or in a "stop" state. During normal ATCS operation, an ABSU operates in a "standby" mode, wherein the ABSU displays a clear aspect, and enables trains (physical and virtual) to move past its location. Upon detecting that an approaching physical train has a failure condition, the ABSU switches to the active mode and assumes a "stop" state of operation, wherein it displays a stop aspect. Further, during the "stop" state, the ABSU accumulates track space from a paired autonomous train control element that is moving away from the ABSU location. Upon accumulating track space that is equal to the associated absolute block track space, the ABSU switches to the "permissive" state to enable the failed physical train to move past its location. In effect, the ABSU authorizes the failed train to move up to the end of the associated permissive absolute block. Further, upon detecting that the failed physical train has completely crossed its location, the ABSU switches to the "stop" state, and informs the ABSU in the approach to its location that the failed train has moved out of the absolute permissive block in the approach to its location.

One main characteristic of the ABSU autonomous operation is being "invisible" to the other train control elements during normal ATCS operation. During the "standby" mode, the ABSU simply receives communication from a paired approaching train. This communication includes the train signature of the approaching paired train, as well as data related to a failed physical train that is moving towards the ABSU location. In turn the received data includes relative position information of the failed train (i.e. for example the train signature of the physical train that is immediately preceding the failed train), and the signature of the failed train, including the number of axles in the train.

In general, and for installations wherein manual trains operate, the ABSU performs three main functions. The first function is performed during both operating modes (standby and active) to detect that a train has completely crossed over the point where the ABSU is located. As part of this function, the ABSU confirms that a specific train identified by a train signature has crossed its location. In the event that a train without a train signature crosses the ABSU location, it is detected and is assigned a provisional train signature by the ABSU. However, if the ABSU is operating in the stop state, and if it cannot confirm that the approaching train is an equipped train, it considers such train to be a manual train operating without speed restriction, and will trigger an ABSU overlap function that provides sufficient breaking distance to the manual train.

The second function is performed when the ABSU is operating in the "stop" state. Upon detecting that an approaching physical train that has either lost communication, or is experiencing a failure, the ABSU operates in the "stop" state, and starts to accumulate track space from paired train control element that is moving away from its location. Then upon accumulating sufficient track space that is equal to the associated absolute block track space, the ABSU switches to the "permissive" state to enable the failed physical train to move past its location. The ABSU switches back to the "stop" state after the failed train crosses the ABSU location.

The third function is performed when the ABSU is in the "stop" state, and upon the movement of the failed train outside the associated absolute block space. There are two scenarios associated with this operating condition. The first scenario is associated with a train operating normally in the approach to the ABSU location (physical or virtual). Under this scenario, the ABSU relinquishes its accumulated track space to the approaching train, and switches to the "standby" mode of operation. The second scenario is associated with a failed physical train approaching the ABSU location. Under this scenario, the ABSU switches to the "permissive" state to allow the approaching failed physical train to move passed its location. Then upon such movement of the failed physical train, the ABSU will switch back to the "stop" state.

To accomplish these functions, an ABSU communicates with approaching trains as well as with adjacent ABSUs. With respect to communication with trains, and when the ATCS is operating normally, an ABSU is usually paired with two trains (physical and/or virtual). Under this pairing arrangement, the ABSU is in a listening mode, receiving data from an approaching train. Alternatively, when an ABSU is in a "Permissive" or "stop" state, it communicates with an approaching train and/or a train moving away from its location in order to relinquish or acquire track space. With respect to communications with adjacent ABSUs, and under certain operating conditions, an ABSU receives the signature of an approaching train from the ABSU in the approach to its location ("Approach ABSU"). Also, an ABSU transmits to the "Approach ABSU" that a specific train (defined by its signature) has completely crossed its location. In addition, under certain operating conditions, an ABSU transmits to the ABSU ahead of its location ("Ahead ABSU") the signature of the train approaching the Ahead ABSU. Further, it receives from the Ahead ABSU that a specific train (defined by its signature) has completely crossed the location of the Ahead ABSU.

In the event an ABSU is located in the approach to an interlocking element, and under certain operating conditions (for example, ABSU is in the "permissive" or "stop" state), it is necessary to establish communication between the ABSU and the interlocking element. Under such configuration, and in an operating scenario wherein the ABSU is acquiring track space from a first train moving away from the ABSU location, it is necessary for the interlocking element to confirm to the ABSU that a route has been established for a second train that is approaching the ABSU. The interlocking element then releases the track space over the established route (which was vacated by the first train moving away from the ABSU location) to the ABSU. It should be noted that, under this operating scenario, and upon the movement of the first train passed the interlocking location, the interlocking element is also paired with the second train approaching the ABSU, and provides relevant interlocking data to the train.

To perform the above described ABSU functions, and as would be understood by a person of ordinary skills in the art, there are a number of design choices to implement the ABSU element. These design choices depend on the concept of operation employed and the extent to which stop enforcement is required. For the preferred embodiment, the architecture of the ABSU element is based on a configuration of conventional train control equipment that include axle counter to detect the crossing of a physical train, a transponder reader to read the ID of a passing train, an active transponder to transmit data to an approaching train, a wayside signal module and associated automatic train stop (optional) to control the movement of an approaching train into an absolute permissive block, and a radio module to communicate with adjacent ABSUs, and other autonomous train control elements.

It should be noted that the above architecture is set forth herein for the purpose of describing the preferred embodiment and is not intended to limit the invention hereto. As would be understood by a person with ordinary skills in the art, the ABSU could be based on a different architecture and/or different set of train control equipment. For example, optical detectors could be used in lieu of axle counters. Also, a data communication module operating over a fiber optic communication network could be used in lieu of a radio module to communicate with adjacent ABSUs, interlocking elements. Further, an ABSU can leverage communication resources associated with other autonomous train control elements. In addition, the use of a wayside signal as part of the ABSU is optional. An indicator to indicate the ABSU state on-board a physical train could be activated through the active transponder at the ABSU location.

As indicated above, one of the main objectives of employing the ABSU elements is provide a structured approach for the initialization of the ATCS. This includes system as well as physical train initializations. Typically, at the beginning of ATCS system initialization, trains are not localized and it is necessary to account for all physical trains operating within the territory (both communicating and silent trains). Similar to CBTC, train localization in the preferred embodiment is performed using passive transponders. To account for all physical trains operating within the territory, the preferred embodiment employs an initialization process based on physical trains sweeping the ATCS territory. This initialization process is based in turn on the functions provided by the ABSU elements. To start, and at the beginning of the initialization process, the ABSUs operate at the "stop" state. This is due to the potential absence of communication from either a physical train or a virtual train. Upon the detection of the movement of a physical train (identified by a train signature) passed an ABSU location, and upon receiving confirmation from the ABSU ahead that this train has also passed its location, the ABSU is assured that the associated absolute block track space is vacant. There are two operating scenarios: The first operating scenario is associated with a communicating physical train or a virtual train approaching the ABSU location. Under this operating scenario, the ABSU relinquishes its track space to the approaching train and switches to the "standby" mode. The second operating scenario is when the ABSU does not detect a communicating physical train or a virtual train approaching its location. Under this operating scenario, the ABSU requests the Track Space Controller (TSC) to create a virtual train, and relinquishes its track space to the newly created virtual train. The ABSU remains in the "stop" state and starts to accumulate (acquire) track space from the newly created virtual train that is now moving away from the ABSU location. This process is repeated at all ABSUs located in the ATCS territory until all physical trains are accounted for, and are operating autonomously in the territory. When this operating condition is reached, all ABSUs within the territory will be operating in the "standby" mode.

It should also be noted that the proposed ABSU architecture provides a self-healing characteristic during an ABSU failure. If an ABSU element fails while it is operating in the "standby" mode, and in accordance with the preferred embodiment, this failure is detected by an autonomous train control element that is paired with the ABSU. Data associated with the failed ABSU propagates through paired train control elements until it reaches the ABSUs on both sides of the failed ABSU (i.e. the "Approach ABSU" and the "ABSU Ahead"). The ATCS will then be reconfigured by the elimination of the failed ABSU. This reconfiguration results in a longer absolute permissive block that maps the territories of the two absolute permissive blocks in the approach to and ahead of the failed ABSU element. Further, it should be noted that this reconfiguration process is transparent to, and has no impact on autonomous train operation.

Alternatively, if an ABSU fails while it is operating in the "permissive" or "stop" states, its failure may not be detected by an approaching train. However, the failure is detected by adjacent ABSUs, which then by-pass the failed ABSU and establishes communication together. Upon the occurrence of an ABSU failure, it is assumed that communication is interrupted between the failed ABSU and the Approach ABSU, as well as with the ABSU Ahead. When communication is lost with an adjacent ABSU, the Approach ABSU is designed to establish communication with the next ABSU in the ATCS configuration. This means that when an ABSU fails, the Approach ABSU and the ABSU Ahead establish communication together. Any track space acquired by the failed ABSU remains with the failed ABSU until it is acquired by the "Approach ABSU" as part of a track sweep operation. Any failed physical train in the vicinity of the failed ABSU continues to operate under previous operating parameters (i.e. movement authority limit within acquired track space and/or pursuant to speed restriction). However, trains approaching the failed ABSU will not receive accumulated track space at the failed ABSU location.

The preferred embodiment incorporates a failure management feature that enables physical trains to move past a failed ABSU. This feature is enabled when the ABSU is operating in the "permissive" or "stop" state, and preconditions the ABSU to transition into one of two failure states in the event of a failure. If the ABSU fails while operating in the "permissive" state, this means that it is safe for an approaching physical train (communicating or silent) to continue its movement passed the ABSU location. By definition, the ABSU does not hold track space when it is operating in the "permissive" state. As such, when in the "permissive" state, an ABSU is preconditioned to fail in an "override" failure state. Under this failure state, the ABSU is designed to automatically display an "override" aspect and to drive the automatic stop (if used) to a clear position. Further, the active transponder defaults to transmitting a special failure code to an approaching train.

Alternatively, if the ABSU fails while operating in the "stop" state, this means that it has accumulated track space, but not sufficient to enable a train to move past its location. As such when in the "stop" state, the ABSU is preconditioned to fail in the "stop" failure state. Under this failure state, the ABSU is designed to automatically display a "stop" aspect and to drive the automatic stop (if used) to a tripping position. A manual override is provided to enable a physical train to move passed the failed ABSU location pursuant to operating rules and procedures.

It should be noted that the above description of the ABSU architecture, functions and operation are being disclosed herein for the purpose of describing the preferred embodiment, and are not intended to limit the invention hereto. As would be understood by a person with ordinary skills in the art, a number of variations/modifications can be implemented in the proposed architecture, functionalities, operation and/or failure recovery techniques. For example, while it is desirable for the preferred embodiment to employ a wayside signal module and associated automatic train stop to provide certain signal functions, the ABSU can be designed without the wayside signal and associated automatic train stop. Similarly, it should also be noted that while the preferred embodiment employs a transponder reader at each ABSU location to capture the train ID of a passing train, the ABSU can be designed without the use of a transponder reader. Under such alternate design, train ID data is transmitted from a train to the ABSUs via radio communication. Further, if this alternate design is used, then it is not necessary to equip each train with a transponder that includes the train ID fields. The train ID data can be stored within the on-board computer and transmitted to the ABSUs as part of a radio communication.

Another autonomous train control element is defined as an interlocking element, which establishes an interlocking route, holds and control the allocation of track space associated with that route. The context of an interlocking element ranges from a single track switch to a complex interlocking with a plurality of track switches. As such, an interlocking route could simply be a route over a single switch or a route over a plurality of switches spanning a plurality of tracks. The interlocking element normally responds to a request from an approaching train element (physical or virtual train) to establish a specific interlocking route. For the preferred embodiment, the interlocking element interfaces with the interlocking logic (both vital and non-vital) that processes the route request, ensures no opposing or conflicting routes are established, moves track switches to the proper positions, locks needed track switches, directional routes and traffic signals, and establishes and secures the requested route. Alternatively, as a design choice, the interlocking element integrates the interlocking control logic into its functionalities.

In general, an autonomous interlocking element provides traditional interlocking functions associated with a switch, including detector locking, approach locking, time locking and overlap locking. An autonomous interlocking element also performs route and traffic locking functions. In an Autonomous Train Control System (ATCS), the use of wayside interlocking signal equipment (i.e. wayside signals, automatic train stops, etc.) is transparent to other autonomous train control elements. The governing concept for the preferred embodiment is that the interlocking element relinquishes track space to other elements, wherein the track space is associated with an interlocking route, and wherein the route is secure and provides for safe train operation. Further, the interlocking element acquires track space from other train control elements, either through a track space exchange protocol or unilaterally in order to perform internal interlocking functions and/or to ensure safety of train operation.

The interlocking element has a high level of priority with respect to the acquisition of track space. In that respect, an interlocking element holds track space over a switch detector area in order to enable the movement of the switch. Upon establishing a route over a switch, the interlocking element ensures that the switch is locked before relinquishing the track space over the switch to an approaching train for example. Further, the interlocking element continues to monitor the integrity of the switch position and locking status, and in the event of an open switch point, it will cancel the established route and acquires the associated track space from an approaching train even if it results in the application of emergency brakes on-board the approaching train.

Also, under certain conditions, an interlocking element holds track space in the approach to a trailing point switch in order to provide safety of operation in the form of trailing point protection. There are a number of operational scenarios associated with a train approaching an interlocking switch, and in particular a trailing point switch. In a first scenario, the approaching train does not have a priority to receive a route over the switch from the interlocking element. In such case, the interlocking element relinquishes track space to the approaching train only if it receives confirmation from the approaching train that it is functioning properly, and it is able to operate within the approach track space and stop before reaching the interlocking boundary.

In a second operating scenario, an approaching train holds track space over an interlocking route, and the interlocking element has a need or a request to cancel the route and establish an alternate route. In this case, the interlocking element acquires track space from the approaching train only if it receives an assurance from the train that it will stop before reaching the interlocking boundary (i.e. detector area).

Further, under certain conditions, the interlocking element needs to hold track space at the leaving end of an interlocking exit in order to provide safe operation during an overlap locking condition. Similar to other autonomous train control elements, the interlocking element acquires track space from, and relinquishes track space to other train control elements. In general, an interlocking element acquires track space from a train that is moving away from the interlocking, and relinquishes track space to a train that is approaching the interlocking. The autonomous operation of the interlocking element is governed by a set of predefined rules. These rules are based on traditional signaling design and safety concepts.

In addition, the interlocking element is paired with other train control elements to exchange operational data. In general, the pairing process is based on the relative locations of train control elements with respect to the interlocking. However, in this case (i.e. interlocking element), the pairing process takes into account interlocking switch positions. As such, an interlocking element for an interlocking configuration that spans a plurality of tracks could be paired with a plurality of autonomous trains to enable parallel moves through the interlocking. The priority for establishing certain interlocking routes is based on data received from the Track Space Controller, which is based in turn on data received from the ATS.

With respect to the implementation of traffic function, it is necessary for an interlocking element to communicate with (be paired with) an adjacent interlocking element. In a typical traffic configuration, a normal traffic direction is defined as the normal train movement direction between two adjacent interlockings for a specific track. Also, a reverse traffic direction is defined as the movement of a train between the two adjacent interlockings on the specific track in a direction that is opposite to the normal traffic direction. Traditional signal concepts require the track space between two interlocking to be vacant before reversing the traffic direction. As such, an interlocking element at the entering end of a traffic section (i.e. the point at which a train enters the traffic section) controls the track space associated with the traffic section. Reversing a traffic direction is then accomplished in two steps: in the first step, the interlocking element at the entering end of the traffic section relinquishes the traffic space associated with the traffic section to the interlocking element at the exit end of the traffic section. At the completion of the first step, traffic direction is in a transition state, and no train is allowed to enter the traffic section from either end. In the second step, the interlocking element at the exit end reverses traffic direction, becoming the entering interlocking element, and at such time the reversal of traffic direction is complete.

It should be noted that upon a request or a need to change traffic direction, the interlocking element at the entering end of an established traffic direction will accumulate track space from a train moving away from its location until the entire traffic section is clear. It should also be noted that in certain applications, there is a need to establish split traffic operation between two adjacent interlocking elements (i.e. enabling two trains to operate on the same track in opposite directions). Under such operating condition, the track space associated with the traffic section is split between the two adjacent interlocking elements, and each interlocking element is able to relinquish track space to a train moving away from its location up to the limit of its allocation of traffic track space. Further, under such operating condition, and if ABSU elements are employed in the design, then the ABSUs will prevent the movements of a failed train into split traffic territory. Also, any train that fails within split traffic territory is prohibited from moving forward, except under strict operating rules and procedures. In addition, supervisory functions are implemented to support split traffic operation, and which ensure that only one train operates in a given direction to prevent a lockout condition. The foregoing disclosure of split traffic operation is being provided to describe the preferred embodiment, and is not intended to limit the invention herein. As would be appreciated by a person skilled in the art, different designs and/or operational parameters could be derived to implement split traffic operation. All such designs are within the scope of this invention.

Another autonomous train control element is defined as a "Grade Crossing" element, which provides protection at grade intersections for trains operating on railroad tracks and vehicle operating on motorways. An autonomous grade crossing element provides protection and/or warnings to vehicle traffic approaching an intersection. Similarly, an autonomous train control element allows a train to proceed over an intersecting roadway only if the grade crossing protection and warning devices have been activated. The grade crossing element has a high priority in terms of the acquisition of track space, and is designed to normally operate in a default state, wherein it holds track space over sections of track defined as grade crossing islands. Further, a grade crossing element holds track space on a track that intersects with a road or a motorway, in both approaches to the intersection. In addition, similar to other train control elements, a grade crossing element is paired with other elements to relinquish or acquire track space.

A grade crossing element includes a processor based controller to control the operation of warning devices (grade crossing flashing lights for example), grade crossing gate (if used), communication modules (radio and/or data communication device), as well as road traffic interface & communication modules. The grade crossing element communicates with (or interfaces with) an intelligent transportation system (ITS) to coordinate roadway vehicle traffic with rail traffic and provide safe operation at the intersection. In its simplest form, the ITS includes roadway traffic signals to control the movement of vehicle traffic approaching the intersection. The operation of the grade crossing element is triggered by a request from an approaching train for track space that crosses the protected roadway. Upon receiving such request, the grade crossing element sends a preempt signal request to the ITS or traffic signal controller to stop all vehicle traffic approaching the intersection. Then upon receiving a confirmation from the traffic signal controller that all traffic signals are displaying "stop" aspects, the grade crossing element activates the grade crossing protection devices (flashing lights and gates). Then upon confirmation that the protection devices are operating correctly, the grade crossing element relinquishes track space over the intersecting road to an approaching physical train.

It should be noted that the grade crossing element can relinquish track space in the approach section of a grade crossing intersection, provided it receives a stop assurance signal from the approaching train indicating that the train is capable of stopping before reaching the intersection. Further, it should be noted that under future applications, wherein smart cars are equipped with communication equipment, navigation equipment and collision avoidance systems, the grade crossing element will communicate with all smart vehicles approaching the grade crossing intersection (broadcast) to ensure that the vehicles do not proceed over the train tracks until all approaching trains have passed the intersection. The design of this application is based on the fail safe principle such that road vehicles need an enable signal to proceed through the rail intersection. The enable signal is continuously broadcasted if there are no trains approaching the intersection. Upon the detection of an approaching train, the interlocking element stop the generation of the enable signal, which prevents vehicles equipped with this crash avoidance system from moving through the intersection. Smart vehicles are equipped with navigation equipment that determines the need to cross the railroad track for a particular destination, and communicates the enable signal to the collision avoidance system onboard the vehicle indicating that it is safe to proceed over the tracks through the rail intersection.

The grade crossing element also communicates with adjacent ABSUs under certain operating conditions (for example in the event of a failure onboard an approaching physical train). The grade crossing element relinquishes track space to an ABSU only if the grade crossing is secure. A failed train can then proceed through the grade crossing. The grade crossing permits vehicle traffic to resume after the train passes an ABSU on the other side of the crossing intersection. In order to shorten the time of grade crossing operation, one design choice is to place a train detection block over the road intersection in order to de-activate the crossing signals and raise the crossing gates (if used) as soon as a train vacates the crossing intersection.

The Autonomous Train Control System (ATCS) includes two additional elements that coordinate the operation and interfaces between the various autonomous train control elements, as well as manage the communication pairing of these elements. As such, a Track Space Controller (TSC) is used to facilitate the interactions between autonomous train control elements, and act as an interface with external systems, including a centralized Automatic Train Supervision (ATS) system, a Public Address/Customer Information Screen system (PA/CIS), a traction power system, and the like. The second train control element is defined as a Communication Interface Controller (CIC), and its main function is to provide connectivity between various autonomous train control elements based in part on real time train location information as well as switch and route statuses provided by interlocking elements.

Unlike zone controllers in a Communication Based Train Control (CBTC) system, the Track Space Controller (TCS) does not establish movement authority limits to trains operating in the track territory controlled by the zone controller. Rather, in the preferred embodiment, the TCS provides computing resources (logical modules) needed for the autonomous operation of virtual trains. The TCS also includes a train controller module that manages the creation, activation, deactivation and deletion of virtual trains. Further, the TCS includes a Simulation Engine module that monitors the operating speeds of physical trains operating in the ATCS territory to establish average operating speeds at various track segments. The average operating speeds are then used to establish operating speeds for virtual trains operating at various locations within the ATCS territory. In addition, the TCS includes a memory structure (memory modules) to store fixed, status and real time operating data for the various autonomous train control elements.

The TCS memory structure includes a plurality memory modules or memory segments to organize and store data required for the operation of the ATCS. One of these modules is used to store line information, which includes track topography data, passenger station data, civil speed limits data, and locations of wayside equipment such as switch points, wayside signals, transponders and the like. Upon the initialization of a physical train, line data is uploaded to the train to enable autonomous operation within the ATCS territory. It should be noted that the use of a memory segment to store line data is being set forth herein for the purpose of describing the preferred embodiment, and is not intended to limit the invention hereto. As would be understood by a person skilled in the art, line data could be stored directly on-board physical trains without the need to download the data from the TCS. Further, line data could be shared between autonomous train control elements without the need to be stored in a centralized location.

Another memory module is used to store status information for interlocking equipment. The interlocking data is used to facilitate the pairing of autonomous train control elements. Track switch and traffic status information together with train locations are provided to the CIC in order to perform the required communication pairing functions. It should be noted that interlocking status information needed for the operation of physical trains are relayed directly by the physical interlocking element to approaching physical trains.

In the preferred embodiment, other memory modules are used to store status information and operational data for various autonomous train control elements, including physical trains, Absolute Block Signal Units, and grade crossing control devices. The status information and operational data are used to facilitate the communication pairing functions, maintenance functions, support the operation of virtual trains, provide operational data to ATS, as well as to support the initialization of physical trains.

The train control module (train controller) of the TSC performs a number of functions related to the creation and management of virtual trains. These functions include processing requests from autonomous elements to create and remove (retire) virtual trains, as well as processing the initialization of physical trains, wherein operational data associated with a virtual train are transferred to a newly initialized physical train. Further, the train controller receives train dispatching and regulation data from the ATS system, and manages data transmission and data allocation to physical and virtual trains. In addition, the train controller provides train status and operational information to the ATS system. Also, for the preferred embodiment, the train controller receives ATS interlocking control information, and relay interlocking control and route initiation data to interlocking elements and/or trains. Further, the train control module provides route and interlocking status information to the ATS system.

The main function of the Communication Interface Controller (CIC) is to manage the communication pairing of autonomous train control elements. The CIC must ensure trusted and secure communication between the proper train control elements. The term "proper train control elements" is defined in the context of an autonomous train control system, wherein geographically adjacent elements need to establish communication in order to exchange operational data. Further, certain elements that have fixed locations need to establish communication with similar elements and/or other fixed location elements. One design choice is to provide fixed communication links between adjacent fixed location elements. In addition, in view of continuous movements of trains within the ATCS territory, it is necessary to provide a communication pairing architecture that facilitates the dynamic pairing of elements as the locations of moving elements (trains) changes relative to the locations of fixed elements (interlocking, ABSU's and grade crossings).

The preferred embodiment incorporates a design architecture for the CIC that includes a plurality communication pairing groups. A communication pairing group has two, three, or more cells, wherein each cell is a place holder for the identity of an autonomous train control element. In general, two-cell groups are used to pair moving elements together. For example, a two-cell group can hold the identities of a physical train and a virtual train, two physical trains or two virtual trains. The assignment of trains to two-cell groups is dynamic, and changes (i.e. trains are assigned to different groups) as trains move through the ATCS territory. It should be noted that each moving autonomous element requires a minimum of two communication channels. The first channel is used to communicate with an element located ahead, and the second channel is used to communicate with an element located behind. With respect to the three-cell group, it is used to pair moving elements with fixed location elements. For the preferred embodiment, and as part of system design, each fixed location element is assigned to a specific three-cell group, wherein this assignment is permanent, and changes only in the event of failure conditions or upon system modifications. Normally, the middle cell is used to store the ID of a fixed location element, while the right cell is used to store the ID of an approaching train, and the left cell is used store the ID of a train moving away from the fixed location element. It should be noted that for an interlocking element, a three-cell group is required for each track. In addition, each fixed location element requires two communication channels to communicate with an approaching train and a train moving away from its location. With respect to interlocking element, it requires at least two communication channels for each track.

It should be noted that the above disclosed design architecture for the CIC is being set forth to describe the preferred embodiment, and is not intended to limit the invention hereto. As would be understood by a person skilled in the art, different architectures could be derived to implement the communication pairing of autonomous train control elements. In addition to the dynamic pairing of train control elements, wherein moving elements are paired with other moving elements or fixed-location elements, there is a need to establish communication between adjacent fixed location elements. To that extent fixed communication channels are required between interlocking, ABSU and grade crossing elements. Two-cell groups could be used to identify the fixed communication channels required between fixed location train control elements.

The Interface Communication Controller (CIC) includes a CIC processor that interfaces with the TSC to receive operational data related to the locations of physical and virtual trains as well as the statuses of interlocking devices. The CIC processor uses the data received from the TSC to perform the required dynamic pairing. Further, the CIC processor provides the dynamic pairing data to the CIC interface within the TSC, where it is transmitted to virtual train modules as well as to the data communication network and physical trains through the physical interface. In addition, the CIC interfaces directly to the communication network to receive data on real time active communication channels. The CIC processor continuously monitors the active communication channels data and compares the data to the dynamic pairing data to continuously validate communication channels assignment. In the event of a discrepancy between the two sets of data, the identified communication channels are disconnected. It should be noted that an alternate design choice is to integrate the CIC into the TSC, making the CIC a module within the TSC architecture.

The objects of the invention are also achieved in accordance with an alternate embodiment of the invention that provides an Autonomous Train Control System (ATCS), which employs a plurality of autonomous elements that are linked by a data communication network, wherein certain autonomous elements are implemented in a cloud computing environment. More specifically, the alternate embodiment uses virtualization and highly available computing resources in a private or secure cloud environment to implement virtual trains that represent free track space, "avatar trains" to represent physical trains, virtual interlocking control modules to represent physical interlockings, virtual ABCUs to represent physical ABCUs and virtual grade crossing controls to represent physical grade crossings.

Similar to the preferred embodiment, the alternate ATCS embodiment employs a plurality of autonomous elements that operate based on predefined set of rules to provide signal protection for trains operating on a section of the railroad that may include one or a plurality of tracks. While the geographical territory along the various tracks is defined as "track space," the corresponding territory in the cloud computing environment is defined as "virtual track space." As such the virtual track space corresponding to a section of the railroad where the train control system is installed is allocated to the various virtual train control elements that reside in the cloud computing environment. Further, similar to the preferred embodiment, this allocation is dynamic, which means that during train operation a virtual autonomous train control element can relinquish or acquire track space from another virtual autonomous train control element based on said predefined rules. Virtual elements then allocate corresponding track space to associated physical elements.

The ATCS architecture for the alternate embodiment includes a Track Space Controller (TSC) that interfaces with the virtual train control elements and provides similar functions to those in the preferred embodiment, including the management of virtual trains, establishing communications between avatar and physical trains, maintain an updated line data base that includes the topographical data of the tracks located within the railroad section as well as the locations of wayside train control equipment, a simulation engine to control the movements of virtual trains, an interface with an automatic train supervision (ATS) system, and an interface with a Communication Interface Controller (CIC).

The CIC performs the main function of pairing groups of virtual train control elements to communicate together, and exchange operating data. The CIC dynamically changes the pairing configuration of the various virtual autonomous elements to reflect train movements, statuses of interlocking elements, statuses of grade crossing control devices (if used), as well as traffic and failure conditions. In addition, the CIC establishes communication channels or links between virtual elements and corresponding physical elements. Further, the CIC interface with the Track Space Controller (TSC) to receive the identifications and locations of virtual and avatar trains, as well as locations of interlocking, grade crossing controllers and ABSU elements. The CIC operates based on predefined rules and performs the pairing function based in part on the relative locations of train control elements and interlocking switch positions. For example, a train (avatar or virtual) could be paired with a train ahead as well as with a following train. Alternatively, a train (avatar or virtual) could be paired with a virtual interlocking element, a virtual grade crossing element or a virtual ABSU element.

Similar to the preferred embodiment a virtual track space acquisition priority is assigned to each category of autonomous train control elements. Pursuant to this structure, and under certain predefined conditions, a virtual train control element with higher priority can acquire virtual track space from a virtual train control element with lower priority to maintain or ensure safe train operation. For example, a virtual interlocking element that corresponds to a physical interlocking, which controls a track switch, can acquire virtual track space from an approaching train in the event the track switch point opens or becomes unlocked.

One of the main categories of virtual train control elements is defined as an "avatar train." An avatar train corresponds to, and continuously communicates via radio with, the train control module onboard an associated physical train. The physical train control module exchanges operational data with the corresponding avatar train. More specifically, the avatar train sends a movement authority to the corresponding physical train. In turn, the physical train sends its current location, speed and other operating and maintenance data to the avatar train. The physical train determines its own location and speed using any of the train location determination subsystems known in the art. The avatar train operates similar to physical train operation in the preferred embodiment. It acquires virtual track space from a paired virtual train control element ahead of its current location, and relinquishes vacated virtual track space to a paired virtual train control element located behind its current location. Each avatar train establishes a movement authority limit (MAL) based on the available virtual track space it has acquired from paired virtual elements. It then sends an equivalent MAL to the associated physical train.

The train control element onboard the physical train incorporates a data base that provides track topography information as well as civil speed limits. In the alternate embodiment, the data base is uploaded from the Track Space Controller. Also, the on-board train control module establishes a stopping profile to enforce the movement authority limit received from associated avatar train. This stopping profile incorporates the civil speed limits within the MAL.

To initialize a physical train into ATCS operation, it is necessary to create an associated avatar train and perform a number of functions. These functions include localization of the physical train, sweeping track space adjacent to the front and back ends of the train (also known as the "sieving function"), establishing communication between the physical train and the associated avatar train, transmitting physical train operating data to the avatar train, pairing the avatar train with appropriate virtual autonomous train control elements, allocating an initial virtual track space to the avatar train, and sending a MAL to the physical train.

Typically for the alternate embodiment, the avatar train is created as a replacement of an existing virtual train, and by acquiring a portion or all of its allocated virtual track space. The virtual train is then switched to a standby mode or state ("standby mode"). The avatar train establishes an initial movement authority limit based on the initial virtual track space allocated from the retired virtual train. The initial virtual track space is determined by adjusting for the length of the associated physical train, and for any difference in location between the physical train and the virtual train. Similar to the preferred embodiment, it is desirable to provide an optimum virtual track space to the avatar train in order to enable the associated physical train to operate at maximum allowable operating speed within the territory. As such, and in view of the premise that avatar trains have an assigned level of virtual track space acquisition priority that is higher than that of virtual trains, an avatar train requests virtual track space from paired front virtual train to satisfy the requirement for an optimized track space. This process is repeated until the optimized virtual track space is satisfied.

The operation and functional characteristics of an avatar train as it interacts with a virtual interlocking element and a virtual ABSU are similar to those of a physical train that interacts with an interlocking element and a physical ABSU, and as described in the preferred embodiment. With respect to failure modes, one potential failure is a loss of communication between an avatar train and an associated physical train. In general, the operational behavior of an avatar train when it loses communication with its associated physical train is similar to the behavior of a physical train when it loses communication with paired train control elements. During such failure, the operation of the physical train is governed by operating rules and procedures. Upon receiving authorization, the physical train can proceed at restricted speed until it reaches its movement authority limit. The physical train can continue to move at restricted speed until it reaches an ABSU location under operating rules and procedures. Then upon moving past the ABSU location, the virtual ABSU element acquires the virtual track space vacated by the physical train. With respect to the operation of the corresponding avatar train, there are alternate design choices. In a first design choice, the avatar train follows the restricted movement of the physical train, and moving to a new location only upon receiving confirmation from an ABSU that the physical train has passed its location.

An alternate design choice is based on establishing an emergency communication channel between the failed physical train and a following physical train. Under this failure recovery design approach, the failed physical train remains at its last reported location until a second physical train come to a close proximity to the failed train. This enables the establishment of an emergency communication link between the two trains. Odometry data is transmitted from the failed train to the following train. In turn, the second train sends movement authorizations to the failed train. In effect, under this design alternative, the second physical train and associated avatar train are used as a communication bridge between the failed physical train and associated avatar train. Since the avatar train possess virtual track space for the failed train, and in view of the assumption that the avatar train operates in a cloud computing environment, it is not affected by the failure onboard the associated physical train, and as such it continues to communicate with a following avatar train. Upon reaching an operating state when the second avatar train is paired with the front avatar train (i.e. no virtual trains exist between the avatar trains), the front avatar train transmits to the following avatar train a limited movement authority for its associated physical train. In turn, the second avatar train transmits this limited movement authority to its own corresponding physical train, which sends it to the failed train via the emergency communication link. Upon receiving the limited movement authority, the failed physical train can move either under manual operation or limited automatic operation.

Upon the movement of the failed physical train, it transmits its odometry information to the following physical train. The odometry information is processed to calculate the location of the failed train. This calculated location is transmitted back to the failed train, as well as to the second avatar train, then the first avatar train. It should be noted that there are alternative design choices related to the calculation of the location for the failed train. Depending on the failure scenario, the method for location calculation could vary. For example, if the failed train remains localized, then there is no need for location calculation, and it is simply sufficient to transmit the location of the failed train to the associated avatar train via the following physical train and associated avatar train. An alternative failure scenario is when the failed train is not localized. Under this alternative scenario, raw odometry data is transmitted for location calculation at the following physical train. In such a case, location uncertainty is expected to be higher than normal operation. However, the location information is useful to enable a degraded mode of operation for the failed train. This process continues until the failed train is repaired or taken out of operation.

Similar to the preferred embodiment, the alternate embodiment employs an autonomous train control element that provides a backup mode of operation during certain system failures. An Absolute Block Signal Unit is being provided in both the physical and virtual operating environment. A Virtual Absolute Block Signal Unit (V-ABSU) includes the necessary logic, and implements the necessary rules to operate autonomously, communicate and interface with other autonomous train control elements. A Physical Absolute Block Signal Unit (ABSU) corresponds to the V-ABSU and is located on the track to provide the operational interface with physical trains. The V-ABSU provides control commands and data to the corresponding ABSU, and receives status information and data from the ABSU.

The V-ABSU operates based on the absolute permissive block concept, wherein a train is given a movement authority to proceed through a virtual block from the entering boundary of the virtual block to its exit boundary provided that the entire virtual block is vacant. In a train control system based on autonomous operation, an absolute permissive virtual block is defined as a signal block between two consecutives V-ABSUs. Further, the virtual track space within an absolute permissive virtual block is defined as the "virtual absolute block track space." As indicated in the preferred embodiment, conventional signaling installations use a plurality of track circuits or other means of train detection within an absolute permissive block to determine the status of the absolute block, i.e. vacant or occupied. For the alternate embodiment, axle counters are used to detect the number of axles in a physical train that crosses the location of an associated physical ABSU. The axle counter data are then used to determine if a virtual absolute block is vacant or occupied.

The autonomous operation of the V-ABSU is very similar to the autonomous operation of the ABSU described in the preferred embodiment. This includes the use of a unique train signature for each physical train and associated avatar train. The attributes, configuration and implementation of the train signature are similar to those disclosed in the preferred embodiment. Further, the pairing of V-ABSUs with other virtual train control elements is similar to the disclosure for the preferred embodiment. In that respect a V-ABSU is paired with a virtual train, an avatar train, a virtual interlocking element, a virtual grade crossing element, adjacent V-ABSUs, etc., to exchange virtual track space. Further, a V-ABSU continuously communicates with its associated physical ABSU to exchange control and status data. In addition, a V-ABSU has three modes of operation: a "standby" mode, a "permissive" mode and a "stop" mode, which are triggered by operating conditions similar to those described in the preferred embodiment. Also, the functions performed in each of these modes are similar to those disclosed in the preferred embodiment. However, it should be noted that while virtual track space is exchanged between the V-ABSUs and other virtual train control elements, the actual interface (detection and some operating data exchange) between an ABSU and a train occurs in the physical environment. Furthermore, the interaction, operation and interface implementation between a V-ABSU and an adjacent virtual interlocking element is similar to the interaction disclosed in the preferred embodiment. This includes the design choice of integrating the ABSU functions in the virtual interlocking element.

With respect to the specific signal equipment used in a physical ABSU, it is a matter of design choice and the concept of operation used. As such, the configuration of conventional train control equipment used in the physical ABSU is similar to the configuration described in the preferred embodiment. In addition, similar design choices are available including the use of optional and alternate equipment.

Similar to the disclosure in the preferred embodiment, one of the main objectives of employing the V-ABSU elements is provide a structured approach for the initialization of the ATCS. This includes system as well as physical train initializations. The functions performed by the V-ABSU during the initialization process are similar to those described in the preferred embodiment. This includes the two operating scenarios described in the preferred embodiment. It should be noted, similar to the preferred embodiment, that the proposed V-ABSU architecture is based on a generic operational approach that detects train movements at discrete points rather than continuous monitoring of train movements throughout an entire section of the railroad. As such, the proposed architecture requires a very limited set of geographical data to customize an ABSU to a particular geographic location. Further, the V-ABSU architecture provides a self-healing characteristic during a physical ABSU failure. The operation and functionalities of this self-healing feature are similar to those described in the preferred embodiment.

In addition, the alternate embodiment incorporates a failure management feature similar to that described in the preferred embodiment. This failure management feature is based on pre-conditioning the V-ABSU to fail in a plurality of states depending on the operating state of an approaching physical train.

The alternate embodiment also includes an autonomous virtual interlocking controller to manage the operation of the physical interlocking equipment and interfaces with other autonomous virtual train control elements. Some of the functions performed by this virtual interlocking element includes establishing an interlocking route, holds and control the allocation of virtual track space associated with that route. Similar to the preferred embodiment, the context of a virtual interlocking element ranges from a single track switch to a complex interlocking with a plurality of track switches. As such, an interlocking route could simply be a route over a single switch or a route over a plurality of switches spanning a plurality of tracks. It should be noted that in the context of the alternate embodiment, the term "interlocking route" refers to a virtual or corresponding physical route through the interlocking configuration. The virtual interlocking control element normally responds to a request from an approaching train element (avatar or virtual train) to establish a specific interlocking route. For the alternate embodiment, the virtual interlocking element interfaces with a control element that implements interlocking logic (both vital and non-vital). This control element could be located in the cloud computing environment, and in such a case, it could interface with an interlocking module that also resides in the cloud computing environment. Alternatively, the interlocking control element could interface with a physical interlocking module that includes the vital and non-vital control logic. In turn, the interlocking module interfaces with the physical interlocking elements on the track (i.e. switch machines, signals, etc.). It should be noted that another design choice is for the virtual interlocking element to perform the logic control functions implemented in the interlocking module. This is the preferred design solution for the alternate embodiment.

Upon receiving a route request from an autonomous virtual train control element, the virtual interlocking element processes the route request, ensures no opposing or conflicting routes are established, issues commands to move track switches to the proper positions, locks needed track switches, directional routes and traffic signals, and establishes and secures the requested route. Similar to the preferred embodiment, and in general, an autonomous virtual interlocking element provides traditional interlocking functions associated with a physical switch, including detector locking, approach locking, time locking and overlap locking. An autonomous virtual interlocking element also performs route and traffic locking functions. Also, similar to the preferred embodiment, the use of wayside interlocking signal equipment (i.e. wayside signals, automatic train stops, etc.) is transparent to other autonomous train control elements. The governing concept for the alternate embodiment is that the virtual interlocking element relinquishes virtual track space to other autonomous elements, wherein the virtual track space is associated with an interlocking route, and wherein the route is secure and provides for safe train operation. Further, the virtual interlocking element acquires virtual track space from other virtual train control elements, either through a virtual track space exchange protocol or unilaterally in order to perform internal interlocking functions and/or to ensure safety of train operation.

The virtual interlocking element has a high level of priority with respect to the acquisition of virtual track space. In that respect, a virtual interlocking element holds virtual track space over a switch detector area in order to enable the movement of the switch. Upon establishing a route over a switch, the virtual interlocking element ensures that the switch is locked before relinquishing the virtual track space over the switch to an approaching avatar or virtual train for example. Further, the virtual interlocking element continues to monitor the integrity of the switch position and locking status, and in the event of an open switch point, it will cancel the established route and acquires the associated virtual track space from an approaching train even if it results in the application of emergency brakes on-board an approaching physical train.

In addition, similar to the preferred embodiment, the virtual interlocking element performs functions associated with approach locking and overlap locking operating scenarios. The description and implementation of these functions are similar to the description and implementation included in the preferred embodiment.

The virtual interlocking element is paired with other virtual train control elements to exchange operational data. Similar to the preferred embodiment, and in general, the pairing process is based on the relative locations of virtual train control elements with respect to the interlocking as well as interlocking switch positions. Also, with respect to the implementation of traffic function, the virtual interlocking element communicates with (is paired with) an adjacent virtual interlocking element to perform traffic functions. The definition of traffic directions and the description and implementation of various traffic functions, including split traffic operation, are similar to the disclosure in the preferred embodiment.

The alternate embodiment could further includes a virtual autonomous "Grade Crossing" element, which provides protection at grade intersections for trains operating on railroad tracks and vehicle operating on motorways. A virtual autonomous grade crossing element ensures safe operation of both vehicle traffic and rail traffic at the intersection. For example, a virtual autonomous train control element allows a physical train to proceed over an intersecting roadway only if the grade crossing protection and warning devices have been activated. Similar to the preferred embodiment, a virtual grade crossing element has a high priority in terms of the acquisition of virtual track space, and is designed to normally operate in a default state, wherein it holds virtual track space over sections of track defined as grade crossing islands. Further, a virtual grade crossing element holds virtual track space on a track that intersects with a road or a motorway, for both approaches to the intersection. In addition, similar to other virtual train control elements, a virtual grade crossing element is paired with other virtual elements to relinquish or acquire virtual track space.

In the alternate embodiment, the virtual grade crossing element is implemented in the cloud computing environment, and include the needed computing resources that provide the logic and functionalities to control the operation of physical warning devices (grade crossing flashing lights for example), and physical grade crossing gate (if used). Further, the physical grade crossing installation includes communication modules (radio and/or data communication device), as well as road traffic interface & communication modules. The physical grade crossing installation communicates with (or interfaces with) an intelligent transportation system (ITS) to coordinate roadway vehicle traffic with rail traffic and provide safe operation at the intersection. The operation and functionalities of the virtual grade crossing element are similar to those described in the preferred embodiment, including the coordination with various types of traffic signal controllers & ITS installation. In addition, the virtual grade crossing element communicates with adjacent virtual ABSUs under certain operating conditions (for example in the event of a failure onboard an approaching physical train). The virtual grade crossing element relinquishes virtual track space to a virtual ABSU only if the physical grade crossing is secure. A failed physical train can then proceed through the physical grade crossing.

Similar to the preferred embodiment, the alternate embodiment includes two additional virtual elements that coordinate the operation and interfaces between the various autonomous virtual train control elements, as well as to manage the communication pairing of these elements. The first element is defined as a Track Space Controller (TSC) and is used to facilitate the interactions between virtual train control elements, and act as an interface with external systems. For example, the TCS will interface with a centralized Automatic Train Supervision (ATS) system, a Public Address/Customer Information Screen system (PA/CIS), a traction power system, and the like. These external systems include control elements in the cloud computing environment that interface with associated physical elements. Alternatively, the external systems could be implemented entirely in the physical environment.

The second virtual train control element is defined as a Communication Interface Controller (CIC), and its main function is to provide connectivity (pairing) between various virtual autonomous train control elements as well as to manage the communication between the virtual elements and associated physical elements. Similar to the preferred embodiment, the pairing function is based in part on real time train location information as well as switch and route statuses provided by virtual interlocking elements.

Also, similar to the preferred embodiment, the Track Space Controller (TCS) provides computing resources needed for the autonomous operation of virtual trains. In addition, the TCS includes a train controller module that manages the creation, activation, deactivation and deletion of virtual trains. Further, the TCS manages various aspects of avatar train operation. The TCS includes a Simulation Engine module that monitors the operating speeds of physical (avatar) trains operating in the ATCS territory to establish average operating speeds at various track segments. The average operating speeds are then used to establish operating speeds for virtual trains operating at various locations within the ATCS territory. In addition, the TCS includes a memory structure to store fixed, status and real time operating data for the various autonomous train control elements. The operating data includes line information such as track topography data, passenger station data, civil speed limits data, and locations of wayside equipment. In turn, the wayside equipment includes switch points, wayside signals, transponders and the like.

The TCS provides line data information to avatar trains, which in turn upload the data to associated physical trains. Further, the TCS store relevant status information for interlocking equipment. The interlocking data is used to facilitate the pairing of autonomous virtual train control elements. More specifically, the CIC employs track switch and traffic status information together with train locations in order to perform the required communication pairing functions. It should be noted that interlocking status information required for autonomous operation is provided by the virtual interlocking element directly to avatar trains to enable the operation of physical trains.

Another function performed by the TCS is to store operational data and status information of various autonomous train control elements, including avatar trains, virtual absolute block signal units, and virtual grade crossing control devices. The operational data is stored in the various logical modules that implement the virtual train control elements. The status information and operational data are used to facilitate the communication pairing functions, maintenance functions, support the operation of virtual trains, as well as to support the initialization of physical trains.

Further, the train control module (train controller) of the TSC performs a number of functions related to the creation and management of virtual trains. These functions include processing requests from virtual autonomous elements to create and remove virtual trains, as well as processing the initialization of avatar/physical trains, wherein operational data associated with a virtual train are transferred to a newly initialized avatar/physical train. In addition, the train controller receives train dispatching and regulation data from the ATS system, and manages data transmission and data allocation to avatar/physical and virtual trains. Similar to the preferred embodiment, the train controller provides train status and operational information to the ATS system. Also, the train controller receives ATS interlocking control information, and relay interlocking control and route initiation data to the virtual interlocking elements and/or trains. Further, the train control module provides route and interlocking status information to the ATS system.

The main function of the Communication Interface Controller (CIC) is to manage the communication pairing of virtual autonomous train control elements. The CIC must ensure trusted and secure communication between the proper virtual train control elements. Further, the CIC ensures secure communication between virtual elements and associated physical elements. The term "proper train control elements" is defined in the context of an autonomous train control system, wherein geographically adjacent elements need to establish communication in order to exchange operational data. Further, certain virtual elements that correspond to physical elements with fixed locations need to establish communication with similar virtual elements and/or other fixed location elements. In addition, in view of continuous movements of trains (virtual and avatar/physical) within the ATCS territory, it is necessary to provide a communication pairing architecture that facilitates the dynamic pairing of virtual elements as the locations of moving elements (trains) change relative to the locations of fixed elements (virtual interlocking, virtual ABSU's and virtual grade crossings).

Similar to the preferred embodiment, the alternate embodiment incorporates a design architecture for the CIC that includes a plurality communication pairing groups. A communication pairing group has two, three, or more cells, wherein each cell is a place holder for the identity of an autonomous virtual train control element. Generally, two-cell groups are used to pair moving elements together. For example, a two-cell group can hold the identities of an avatar train and a virtual train, two avatar trains or two virtual trains. The assignment of trains to two-cell groups is dynamic, and changes (i.e. trains are assigned to different groups) as trains move through the ATCS territory. It should be noted that each moving autonomous element requires a minimum of two communication channels. The first channel is used to communicate with an element located ahead, and the second channel is used to communicate with an element located behind. With respect to the three-cell group, it is used to pair moving elements with fixed location elements. For the alternate embodiment, and as part of system design, each fixed location element is assigned to a specific three-cell group, wherein this assignment is permanent, and changes only in the event of failure conditions or upon system modifications. Normally, the middle cell is used to store the ID of a fixed location element, while the right cell is used to store the ID of an approaching train, and the left cell is used store the ID of a train moving away from the fixed location element. It should be noted that for a virtual interlocking element, a three-cell group is required for each track. In addition, each fixed location element requires at two communication channels to communicate with an approaching train and a train moving away from its location. With respect to virtual interlocking element, it requires at least two communication channels for each track.

As noted in the preferred embodiment, the above disclosed design architecture for the CIC is being set forth to describe the alternate embodiment, and is not intended to limit the invention hereto. As would be understood by a person skilled in the art, different architectures could be derived to implement the communication pairing of autonomous virtual train control elements. In addition to the dynamic pairing of train control elements, wherein moving elements are paired with other moving elements or fixed-location elements, there is a need to establish communication between adjacent fixed location elements. To that extent fixed communication channels or links are required between virtual interlocking, virtual ABSU and virtual grade crossing elements. Two-cell groups could be used to identify the fixed communication channels required between fixed location train control elements.

The Interface Communication Controller (CIC) includes a CIC processor that interfaces with the TSC to receive operational data related to the locations of avatar/physical and virtual trains as well as the statuses of virtual interlocking devices. The CIC processor uses the data received from the TSC to perform the required dynamic pairing. Further, the CIC processor provides the dynamic pairing data to the CIC interface within the TSC, where it is transmitted to virtual train modules, avatar train modules as well as to the data communication network and physical elements through the physical interface. In addition, the CIC interfaces directly to the communication network to receive data on real time active communication channels. The CIC processor continuously monitors the active communication channels data and compares the data to the dynamic pairing data to continuously validate communication channels assignment. In the event of a discrepancy between the two sets of data, the identified communication channels are disconnected.

BRIEF DESCRIPTION OF THE DRAWINGS

These and other more detailed and specific objectives will be disclosed in the course of the following description taken in conjunction with the accompanying drawings wherein.

DESCRIPTION OF THE PREFERRED EMBODIMENT

Figure 1:
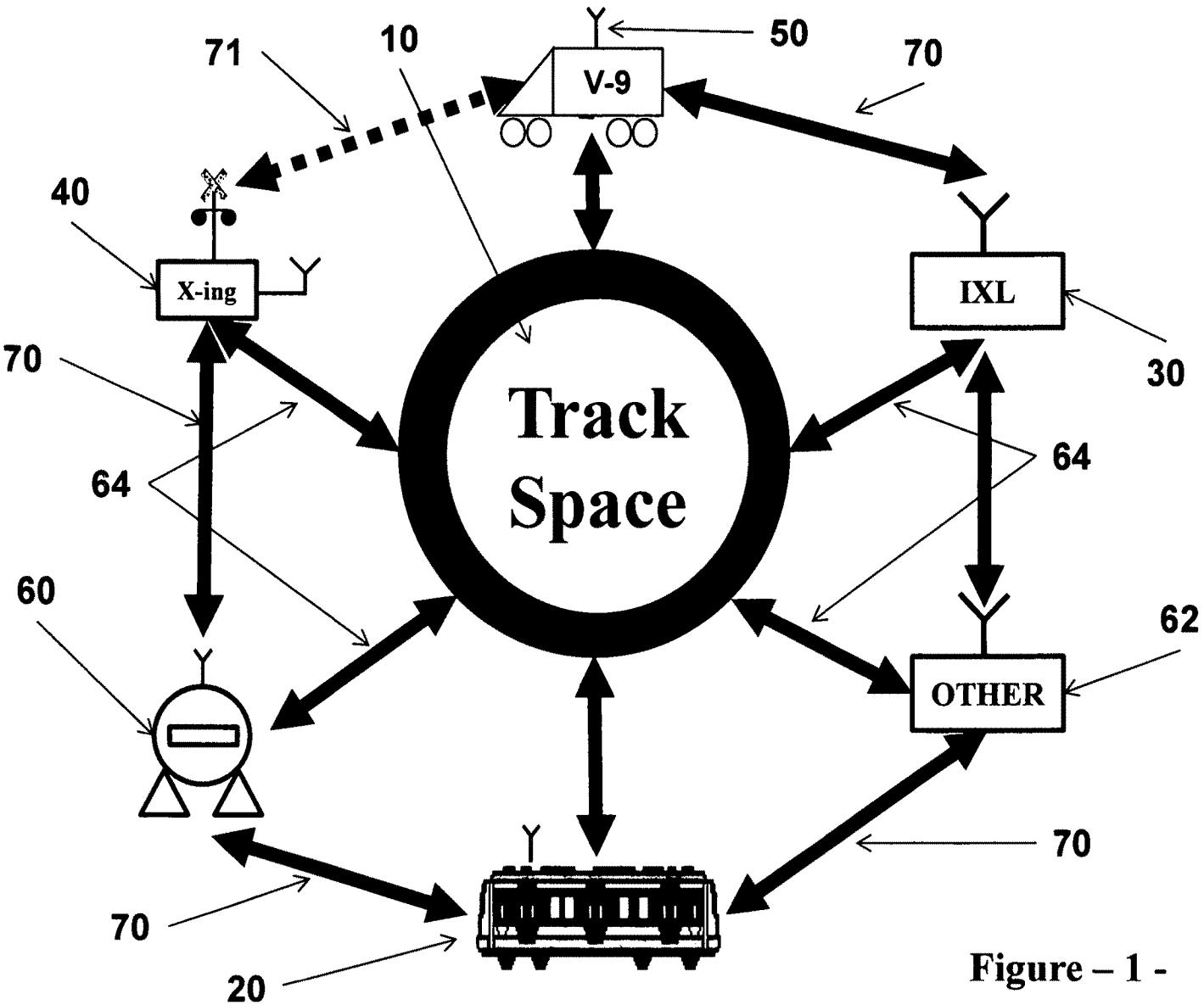
FIG. 1 is a general conceptual diagram of an Autonomous Train Control System showing the various autonomous train control elements, and the interaction between paired elements related to the acquisition and relinquishment of track space in accordance with the preferred embodiment of the invention.

The present invention describes a new structure, and/or a new method to implement an Autonomous Train Control System (ATCS). This new structure is based on the concept of a plurality of autonomous train control elements that operate independent of each other, and interface with each other for the purpose of relinquishing and/or acquiring "track space." The ATCS normally controls train movements within a section of a railroad or within a transit line. Similar to other train control systems, an ATCS installation covers a plurality of tracks, as well as track switches that provide means for trains to move from one track to another. The "track space" is defined as the longitudinal stretch along the entire physical track installed within the ATCS territory, and including the track within interlockings. For the preferred embodiment, the track space within the ATCS territory is allocated to the various autonomous train control elements, which include physical trains, interlocking elements, absolute block signal units (optional), grade crossings, and any other train control element that requires an allocation of track space. An additional class of autonomous train control elements is used in the preferred embodiment to represent free, un-occupied, or un-allocated track space. This additional class is defined as "virtual trains." Each of the autonomous train control elements operate pursuant to a set of rules. Further, each class of autonomous train control elements is assigned a priority level with respect to the acquisition or relinquishment of track space. An element with a higher priority level, can acquire allocated track space from another element with lower priority level.

The use of virtual trains to represent free track space requires the introduction of a secondary concept related to the acquisition and relinquishing of track space. Since a virtual train does not represent, or correspond to a physical train entity, certain physical train functions are not suitable to be performed by a virtual train. For example, a virtual train should not activate grade crossing protection as it moves in the approach to and through a grade crossing territory. However, there is still a need for a virtual train to operate and move through grade crossing territory. Similarly, some interlocking functions require the acquisition of track space held by a grade crossing element. For example, when performing traffic reversal between interlockings the track space allocated to a grade crossing element must be assigned to interlocking element. Such assignment must be performed without activating the grade crossing element. As such, the preferred embodiment employs the concept of "leasing" and "vacating" track space. By leasing track space assigned to a grade crossing control element, a virtual train can proceed through the grade crossing track section without activating the crossing. Similarly, by leasing track space from a grade crossing element, an interlocking element can reverse traffic without activating the grade crossing. It should be noted that although a grade crossing element leases track space to a virtual train or an interlocking element, the track space remains assigned to the grade crossing element. As such leased rack space must be returned to the grade crossing element when it is vacated and cannot be transferred directly to another element. For example, a virtual train that vacates a track space leased from a grade crossing element returns the vacated track space back to the grade crossing element for releasing to a following virtual train, or to be relinquished to a following physical train.

The interfaces between autonomous train control elements are identified based on relative geographic locations, and include the communication pairing of adjacent elements for the purpose of acquiring/relinquishing track space, as well as exchanging operational data. The preferred embodiment includes two additional elements: The first element is defined as Track Space Controller (TSC), and its main functions include the implementation and management of virtual trains, as well as to facilitate the interfaces between various autonomous train control elements. The second element is defined as a Communication Interface Controller (CIC), and its main function is to manage the communication pairing of autonomous train control elements.

Referring now to the drawings where the illustrations are for the purpose of describing the preferred embodiment of the invention and are not intended to limit the invention hereto, FIG. 1 is a conceptual abstract diagram of the proposed ATCS, showing the track space 10, and the various autonomous train control elements, including physical trains 20, interlocking elements 30, grade crossing elements 40, virtual trains 50, Absolute Block Signal Units (ABSU) 60 & any other train control element 62. The initial allocation of track space to the train control elements is made during system and/or train initialization, and is based on predefined rules. With respect to fixed location train control elements, track space initial allocation is based on fixed geographical limits. For example, the initial track space allocated to an interlocking element 30 includes the switch detector area as well as the approaches to the interlocking. Similarly, the initial track space allocated to a grade crossing element 40 includes the track space along the grade crossing island as well as the approaches. ABSUs 60 receive an initial track space allocation that includes the associated absolute signal block. A virtual train 50 receives an initial track space allocation, or a leased track space allocation, upon the creation of the train based on predefined rules. Similarly, a physical train 20 receives an initial track space allocation upon the initialization of the train based on predefined rules. It should be noted that the initial allocation to ABSUs 60 is an interim allocation until the track space is reallocated to other train control elements during normal system operation.

The system initialization process, during which track space is initially allocated to train control elements, is based on an initial sweep of the track space sections to ensure that they are vacant. As a design choice, fixed block detection could also be used in certain track sections to ensure that no trains are present in these track sections. For example, fixed block detection could be used within switch detector areas and the island sections of grade crossings. Upon system and train initializations, and the establishment of normal operation, the train control elements relinquish and acquire 70 track space to paired element based on operating conditions and predefined set of rules. Virtual trains operating in the vicinity of grade crossing elements lease and vacate track space 71 based on operating conditions and predefined set of rules.

Figure 2:
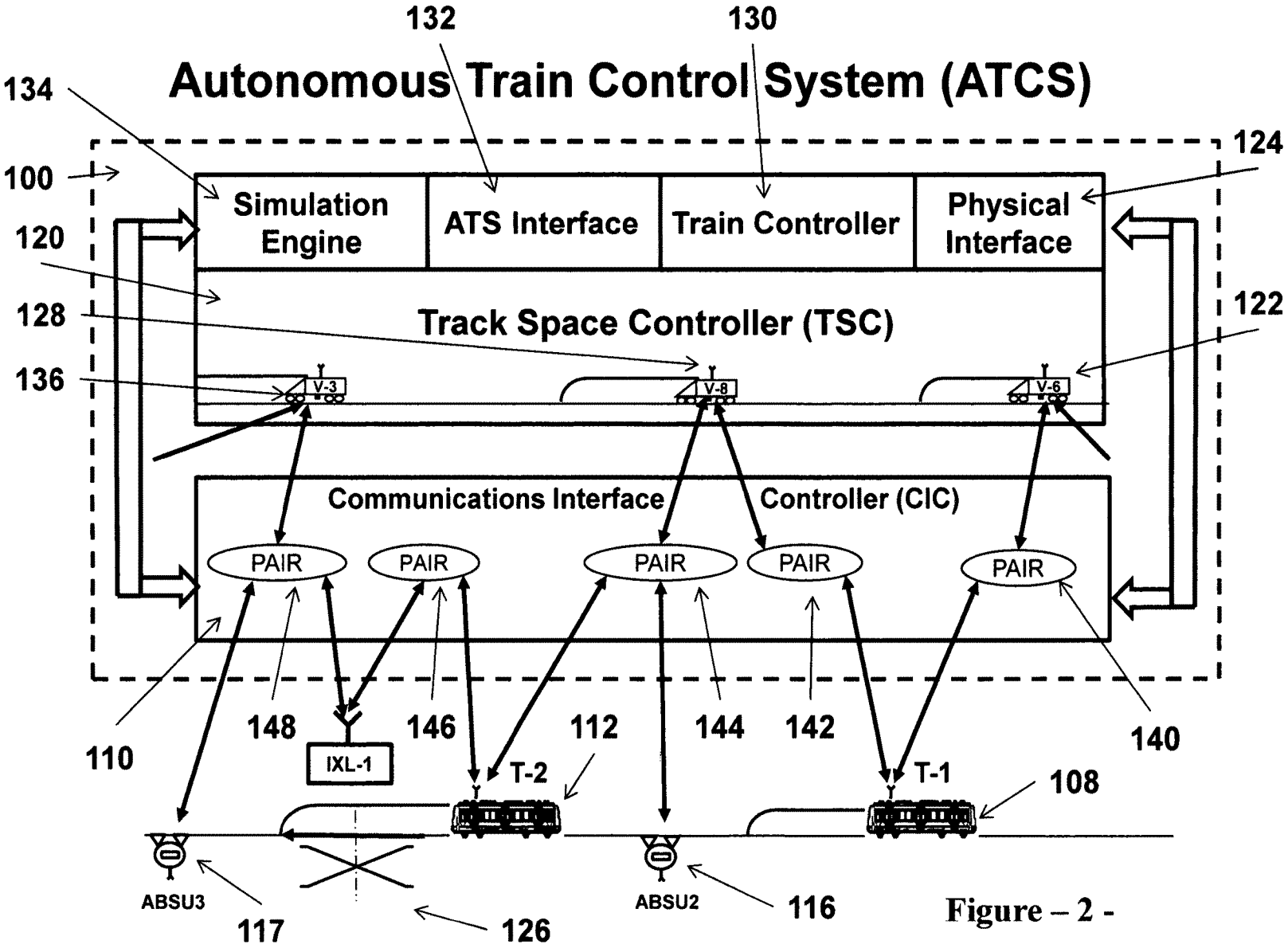
FIG. 2 shows a general block diagram of the Autonomous Train Control System in accordance with the preferred embodiment of the invention.

FIG. 2 shows a block diagram of a typical configuration for the proposed ATCS in accordance with the teachings of the preferred embodiment. This configuration includes physical trains T-1 108 and T-2 112, virtual trains V-3 136, V-6 122 & V-8 128, interlocking element 126, absolute block signal units ABSU2 116 & ABSU3 117. The ATCS also includes centralized computing resources 100, which includes two main elements: the Track Space Controller (TCS) 120, and the Communication Interface Controller (CIC) 110. The main functions performed by the TCS 120 include the implementation and management of virtual trains 130 & 134, and the management of interfaces with physical elements 124 as well as interfaces with external systems 134. The main function of the CIC 110 is to pair the autonomous train control elements together based on location and operational data received from the TCS 120. As such, for the ATCS configuration shown in FIG. 2, and for the relative positions of trains shown, virtual train V6 122 is paired 140 with physical train T-1 108, virtual train V-8 128 is also paired 142 with T-1 108. In turn, V-8 128 is also paired 144 with physical train T-2 112 and absolute block signal unit ABU2 116. Further, physical train T-2 112 is paired 146 with interlocking element IXL-1 126. In addition, virtual train V-3 136 is paired 148 with IXL-1 126 and ABSU3 117. It should be noted that as the relative positions of trains change, the pairing of train control elements changes. This is a dynamic process based train locations and operational data.

Figure 3:
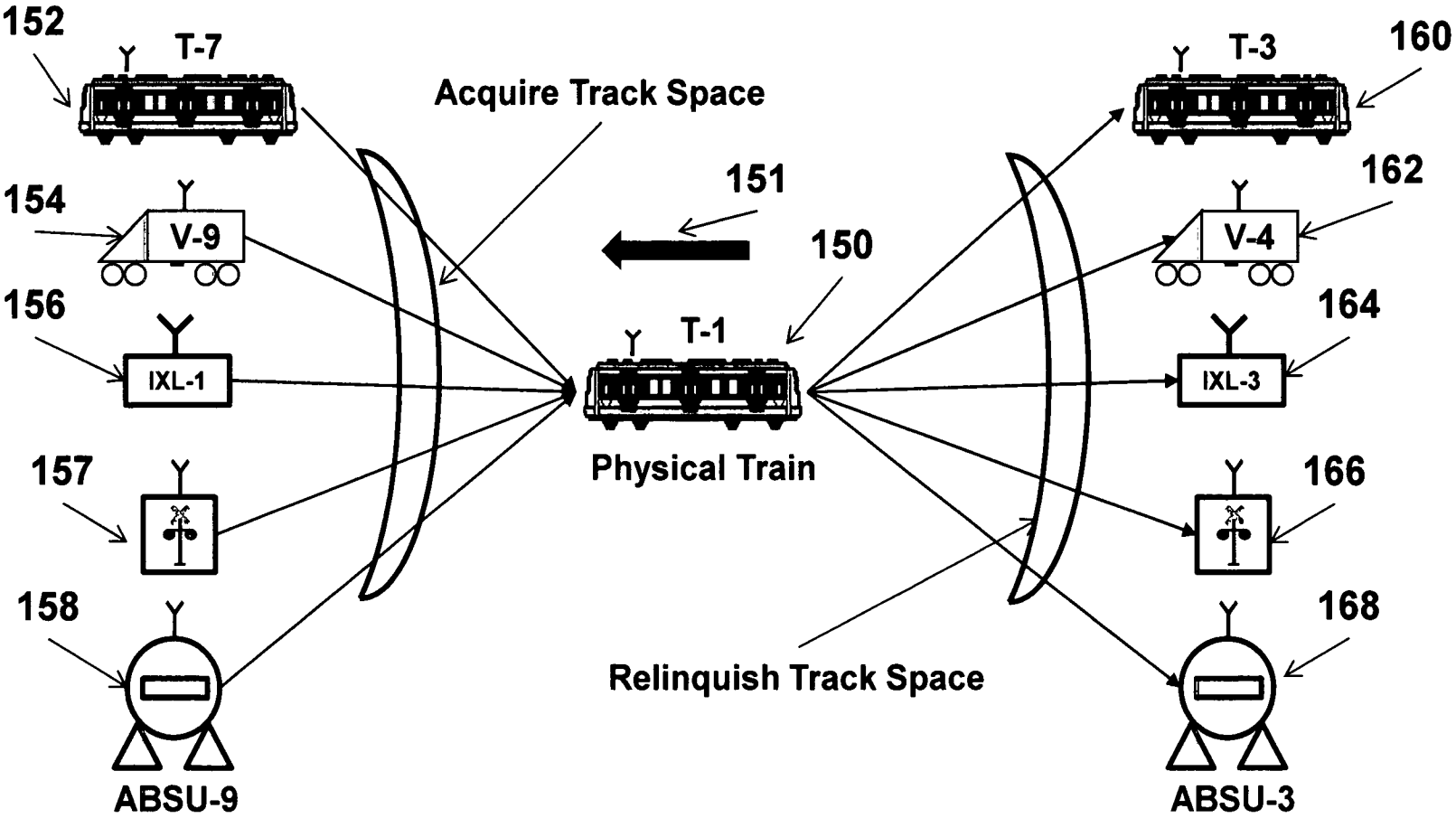
FIG. 3 shows a diagram that demonstrates the autonomous operation of a physical train with respect to the acquisition and relinquishment of track space in accordance with the invention.

As indicated above, physical trains acquire and relinquish track space from/to other train control elements. More specifically, and as shown in FIG. 3, a physical train 150 can acquire track space from another physical train 152, a virtual train 154, an interlocking control element 156, a grade crossing control element 157, or an absolute block signal unit (ABSU) 158. The acquisition of track space takes place as a train ahead (physical 152 or virtual 154) vacates track space, in response to a route request to an interlocking control element 156, in response to a request for track space to a grade crossing control element 157, or during a failure condition, wherein an ABSU 158 relinquishes the track space associated with its absolute signal block (ASB) after ensuring that the ASB is vacant. It should be noted that to proceed through a grade crossing section, it is necessary for the physical train to acquire track space directly from the grade crossing. A train (physical or virtual) moving ahead of the physical train must relinquish/release vacated track space to the grade crossing element for reassignment to the following physical train.

Similarly, a physical train 150 can relinquish track space to another physical train 160, a virtual train 162, an interlocking control element 164, a grade crossing control element 166, or an absolute block signal unit (ABSU) 168. The relinquishing of track space takes place after the physical train 150 vacates track space upon its movement in the indicated direction 151.

Figure 4:
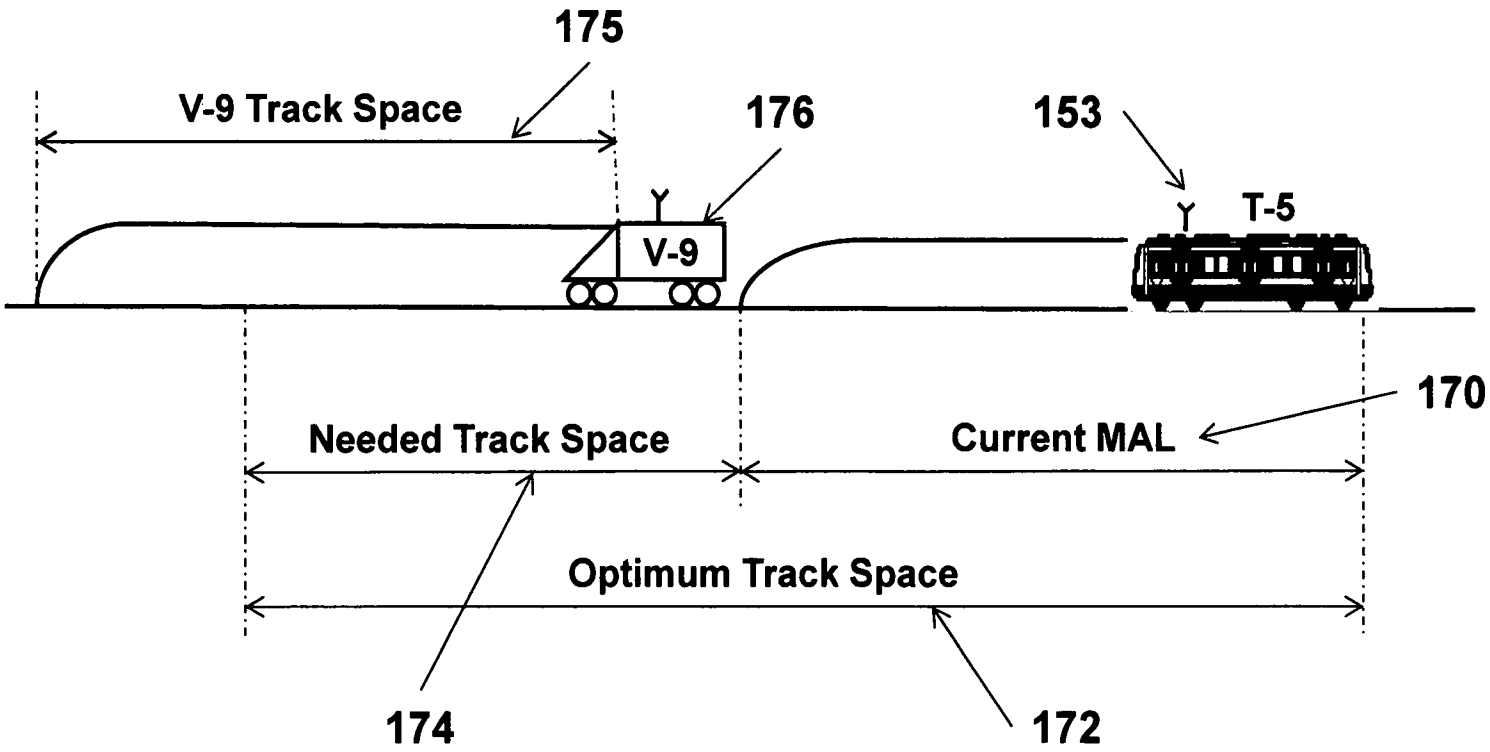
FIG. 4 shows an operational scenario that demonstrates a rule for the autonomous operation of a physical train in accordance with the invention.
Figure 5:
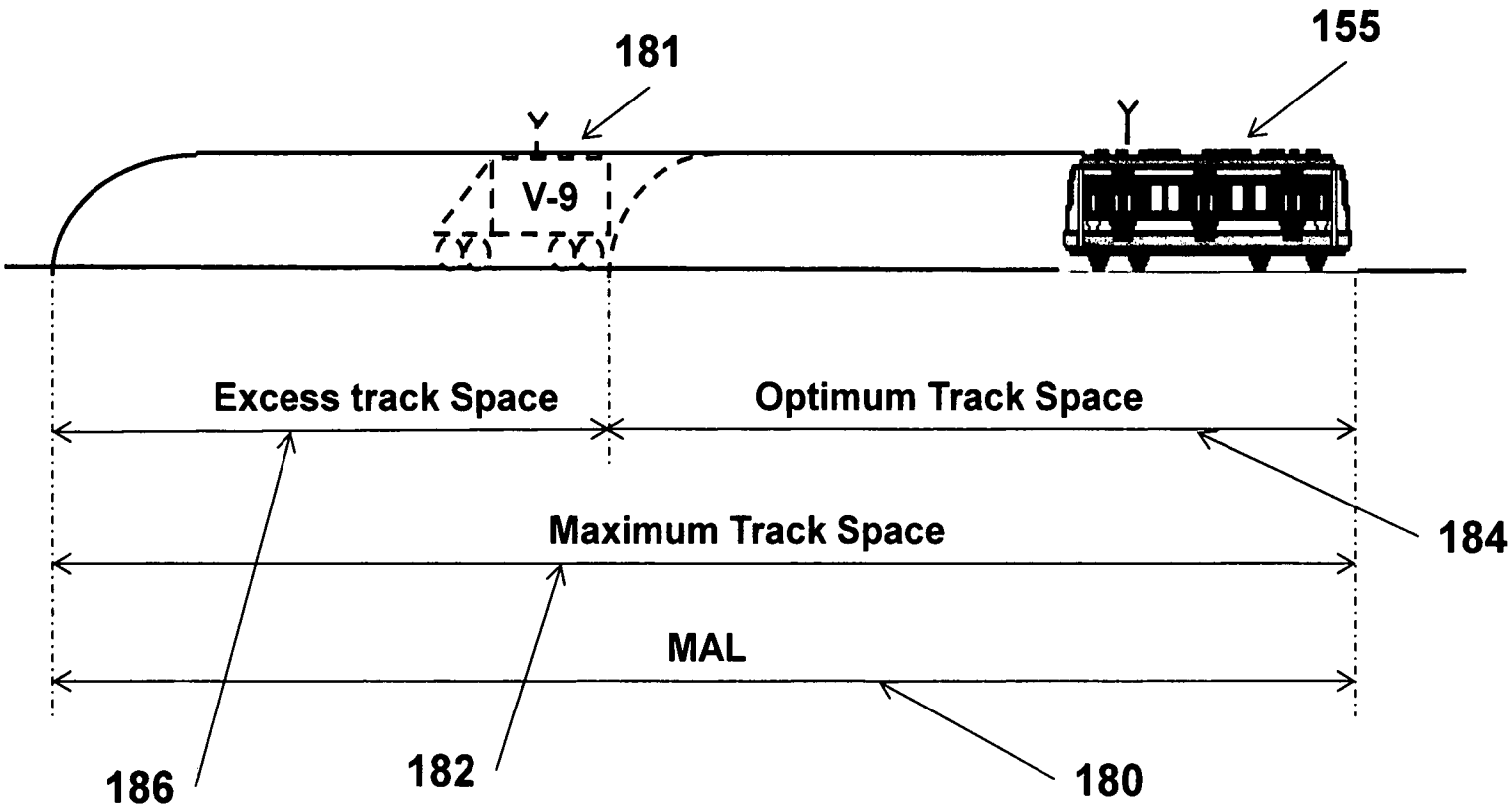
FIG. 5 shows an operational scenario that demonstrates a rule for the autonomous operation of a physical train in accordance with the invention.

FIGS. 4 & 5 show certain characteristics of the autonomous operation for physical trains. Each physical train control element establishes a movement authority limit (MAL) based on the available track space it has acquired from paired elements. Also, a physical train control element establishes a stopping profile that is based on the MAL. As disclosed above, to the extent possible, it is desirable to provide an "optimum" track space to a physical train in order for the physical train to operate at the maximum allowable operating speed within the territory. As such, FIG. 4 reflects an operating scenario, wherein the current track space and associated MAL 170 for a physical train is less than the required optimum track space 172. Based on the premise that physical trains have an assigned level of track space acquisition priority that is higher than that of virtual trains, the autonomous operation of physical trains includes a feature wherein a physical train acquires more track space from a paired virtual train to satisfy its optimum track space requirements. As such, in FIG. 4, physical train 153 requests track space from paired front virtual train 176 to satisfy the requirement for an optimized track space 172. In the event the needed track space 174 is more that the track space 175 allocated to the virtual train 176, the process is repeated until the optimized track space 172 is satisfied. Alternatively, if the needed track space 174 is less than the track space 175 allocated to the virtual train 176, then the virtual train 176 will relinquish the needed track space 174 to the physical train 153. However, if the remaining track space for the virtual train 176 is less than a certain threshold, the entire track space 175 assigned to the virtual train 176 is relinquished to the physical train 153. In such a case, the virtual train 176 is retired.

A second characteristic of the physical train autonomous operation is associated with the operating scenario depicted in FIG. 5, wherein the track space 180 allocated to a physical train 155 exceeds a maximum track space threshold 182. In the preferred embodiment, it is not desirable for a physical train to acquire track space way in excess of its optimum track space. As such, one autonomous operation characteristics of physical train is to relinquish track space when its allocated space exceeds a maximum threshold. An example of an operational scenario that results in excess track space 186 occurs when a physical train is delayed and keeps accumulating track space from a train ahead that is moving away from its location. In FIG. 5, when the track space allocated to a physical train 155 exceeds the maximum track space threshold 182, the physical train relinquishes the excess track space 186 for the creation or activation of a new virtual train 181.

Figure 6:
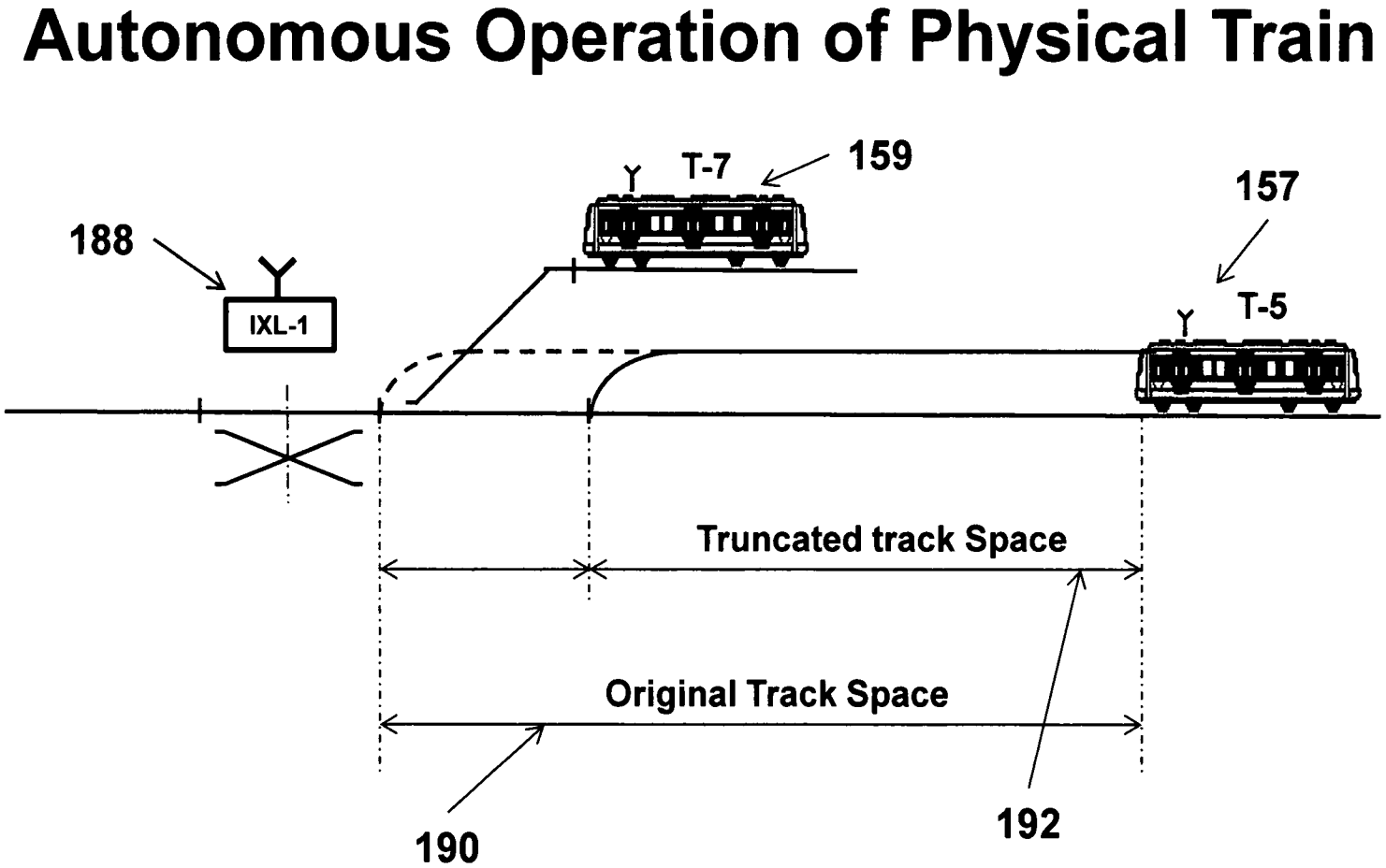
FIG. 6 shows an operational scenario that demonstrates a rule for the autonomous operation of a physical train in accordance with the invention.

FIG. 6 shows another operating scenario, wherein a physical train relinquishes track space to a paired autonomous train control element. In the preferred embodiment, a physical train is requested to relinquish track space to a paired autonomous train control element that has a higher assigned level of track space acquisition priority. Upon receiving such request, the physical train relinquishes part or all of the requested track space provided that it does not violate safety rules. In FIG. 6, interlocking element IXL-1 188 requests physical train T-5 157 to relinquish part of its track space 190 in order to process a higher priority move for physical train T-7 159 through the interlocking. As part of the physical train autonomous operation, physical train T-5 157 relinquishes the requested track space to IXL-1 188 only if it can stop using service brake prior to reaching the interlocking, within its truncated track space 192. It should be noted that, under rare operating conditions, a physical train will truncate its movement authority without relinquishing any track space, and resulting in an emergency brake application in order to mitigate safety hazards. An example of such operating condition is an open switch point within the track space assigned to the physical train. An alternate design requires the allocated track space to be relinquished to the interlocking element in the event of an open switch point.

Figure 7:
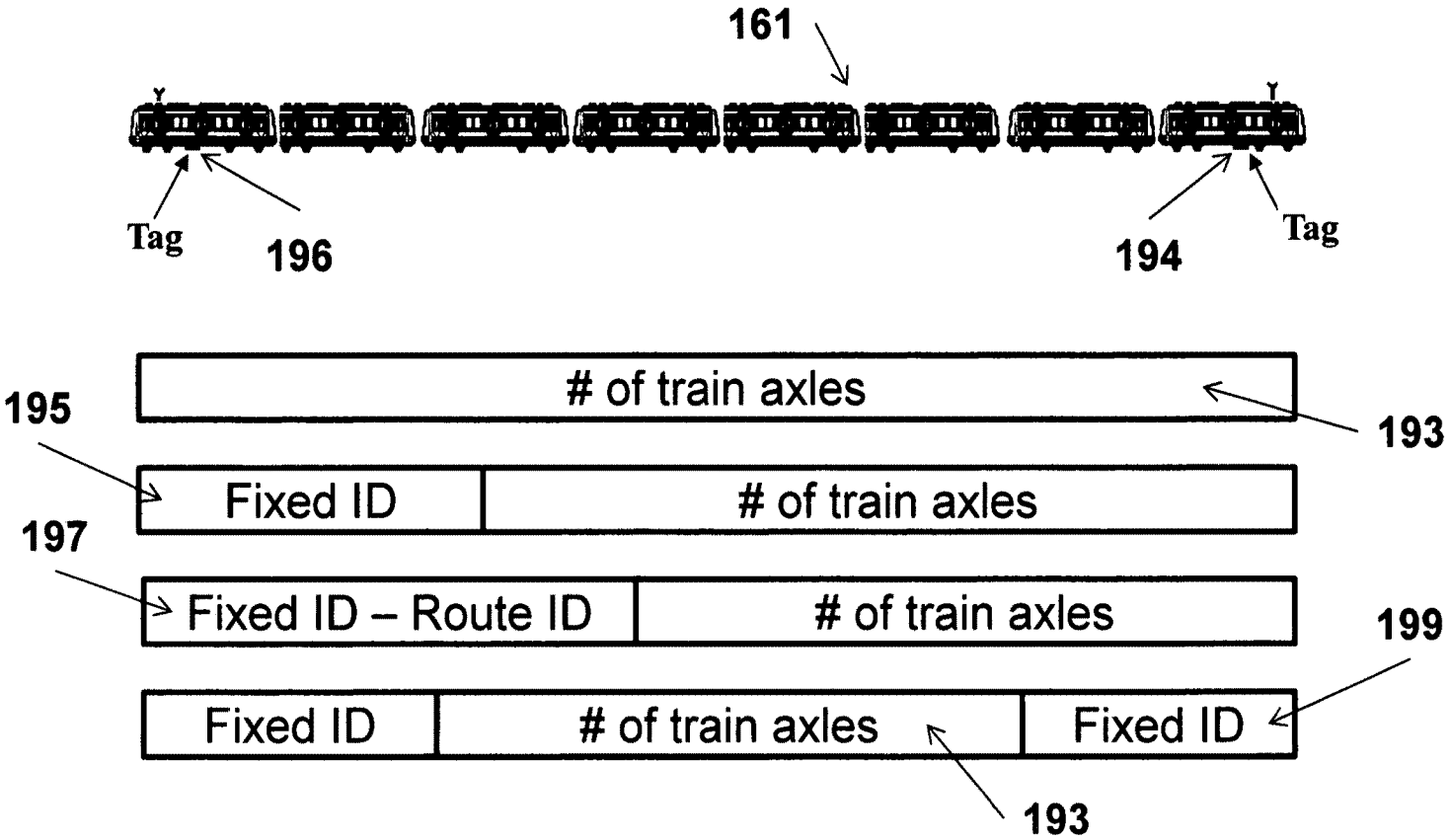
FIG. 7 shows various configurations of physical train signature in accordance with the invention.

Another characteristic of physical train autonomous operation is related to failure conditions. One unique characteristic of the ATCS is the mechanism used to detect failures of physical trains and communicate failure information to other train control elements. A failure is detected by self-diagnostics of the failed physical train element or by loss of communication with a paired train control element. Failure information, including the identity and characteristics of the failed physical train are propagated within the ATCS using daisy chain communication by paired train control elements. The preferred embodiment identifies a physical train by a "train signature." FIG. 7 shows various design options to provide physical train signature for a train consist 161. A first design option is to define the train signature as the number of axles 193 in the train consist 161. A second design option is to define the train signature as the combination of a fixed ID 195 embedded in a first passive transponder (tag) 196, and the number of train axles 193. The third design option is similar to the second option, wherein the train signature is a combination of a train ID and the number of axles. However, the train ID includes a fixed field based on information embedded in a transponder, and a variable field that reflects the route ID for the train 197. The route ID changes for each train trip, but remains fixed during a train trip. In the preferred embodiment, a train trip is defined as the trip from an initiating terminal station to a destination terminal station. The fourth design option is to define the train signature as a combination of a first fixed train ID 195, the number of axles 193 in the train consist, and a second fixed train ID 199 embedded in a second passive transponder 194. It should be noted that additional train status information could be included in the train signature. For example, the train signature could reflect the train operating status, including if the train is operating with a restricted speed or based on a movement authority limit.

Figure 8:
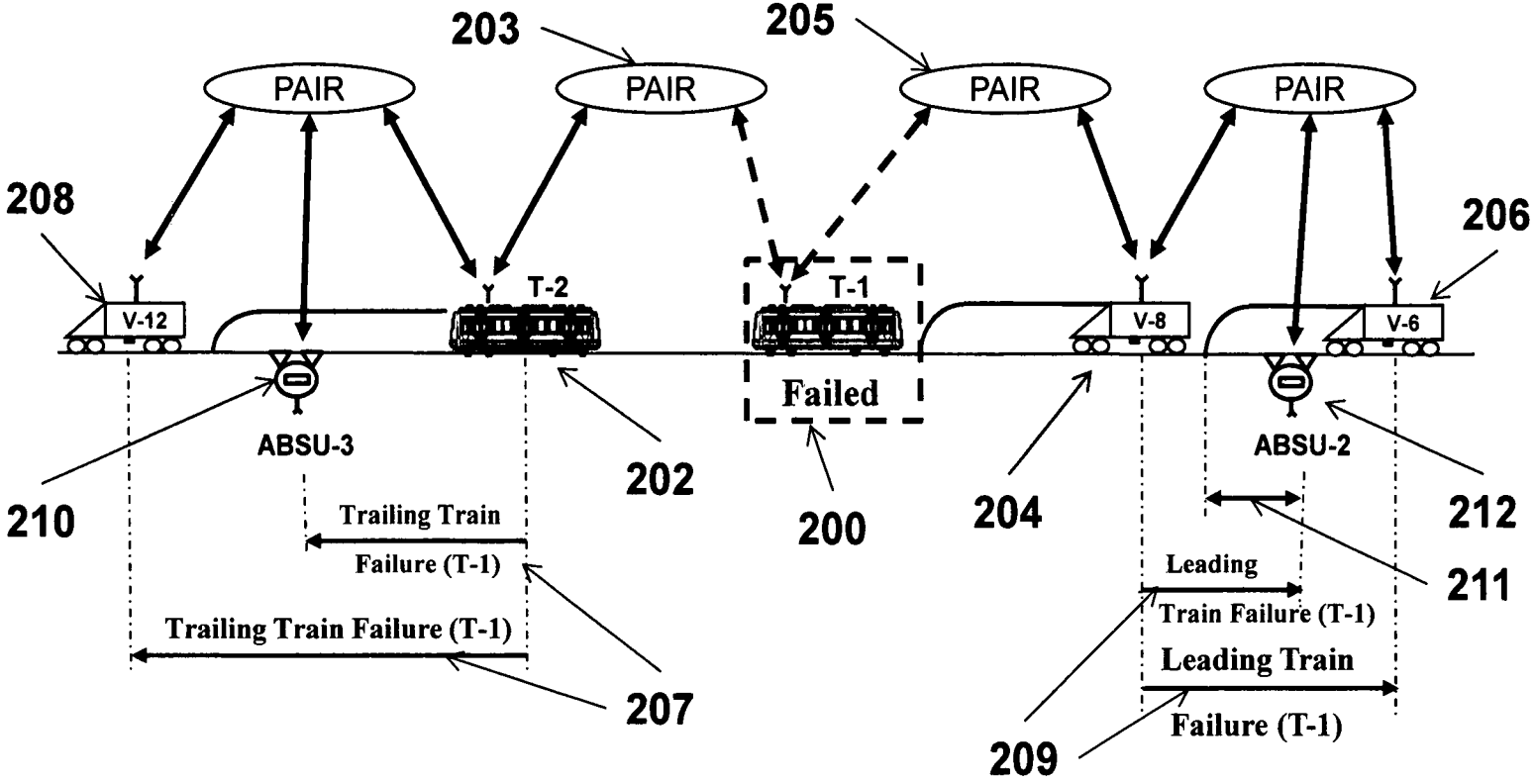
FIG. 8 shows a diagram that demonstrates the concept of propagation of train failure information in accordance with the invention.

FIG. 8 demonstrates the concept of propagating physical train failure information by relaying the failure data from one train control element to the next. In FIG. 8, physical train T-1 200 has experienced a failure and is unable to communicate with paired 205 virtual train 204 and paired 203 physical train 202. Upon losing communication with T-1 200, physical train T-2 202 transmits a "Trailing Train Failure" ("TTF") message 207 to paired train control elements ABSU-3 210 and virtual train V-12 208. The TTF message 207 identifies the failed physical train as T-1 200, using its train signature. Upon the movement of physical train T-2 202 past ABSU-3 210, ABSU-3 is preconditioned to detect the crossing of T-1 200. Further, as physical train T-2 202 continues to move, it will propagate the T-1 200 failure data to paired fixed location train control elements.

Similarly, upon losing communication with T-1 200, virtual train V-8 204 transmits a "Leading Train Failure" ("LTF") message 209 to paired train control elements ABSU-2 212 and virtual train V-6 206. The LTF message 209 identifies the failed physical train as T-1 200, using its train signature. Upon receiving the LTF message 209, ABSU-2 212 requests V-8 204 to relinquish its entire track space. In addition, ABSU-2 212 requests V-6 206 to relinquish part of its track space that falls within the absolute signal block 211. The track space controller will then retire virtual train V-8, and ABSU-2 212 switches to the active mode to control the movement of trains into its associated absolute signal block. Upon receiving confirmation from ABSU-3 210 that failed train T-1 200 has passed its location, ABSU2 212 will switch to a permissive state and will relinquish its entire track space (equal to the absolute signal block) to an approaching train. It should be noted that with respect to virtual train V-6 206, it will relay the LTF message to an approaching train, and will most likely relinquish its remaining track space to the approaching train.

Although physical trains have a high level of priority with respect to the acquisition of track space, this high priority level is reduced in the event of a failure or a loss of communication. The movement of a failed physical train and the recovery of the ATCS from such failure are described as part of the ABSU autonomous operation.

Figure 9:
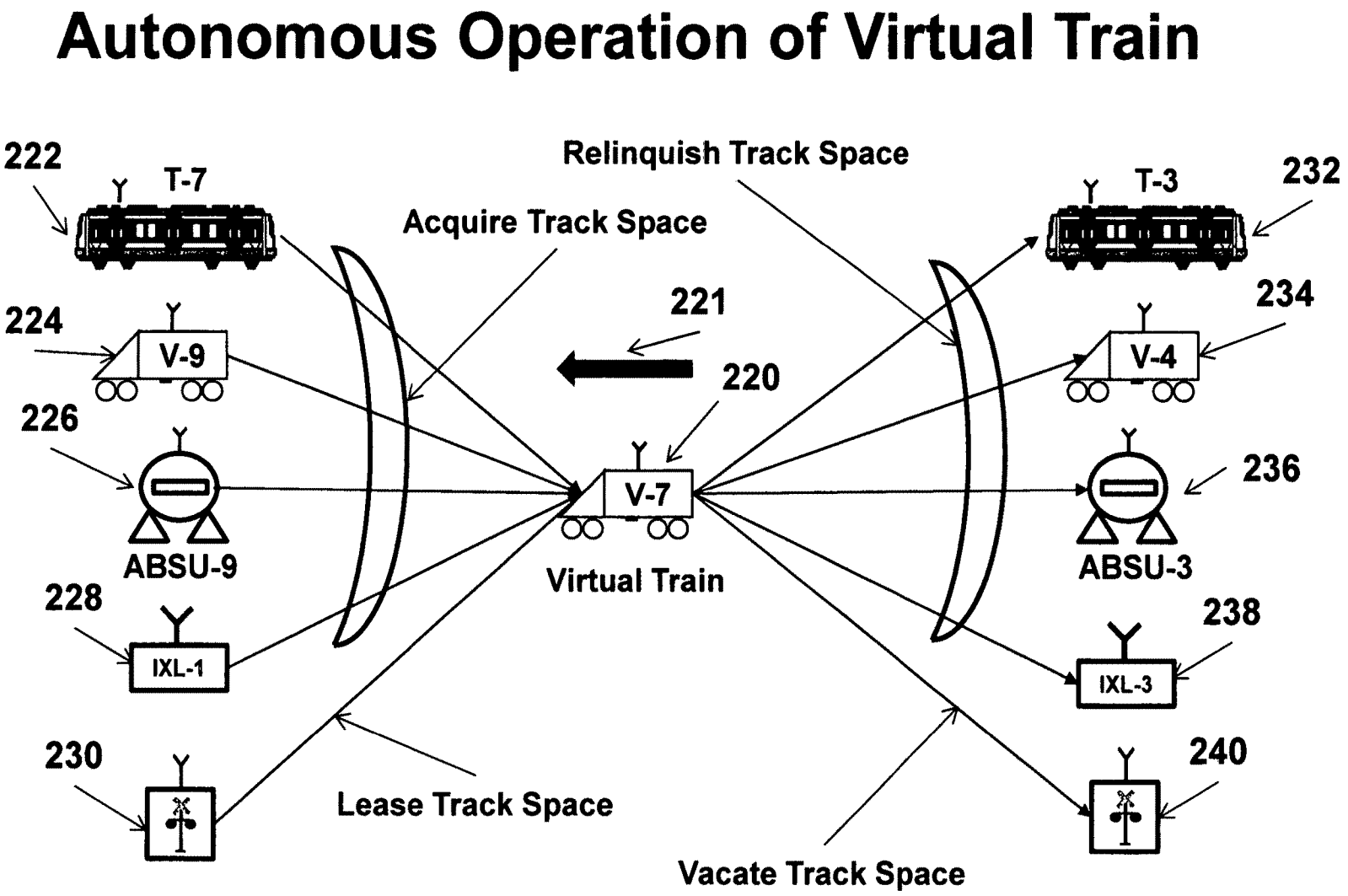
FIG. 9 shows a diagram that demonstrates the autonomous operation of a virtual train with respect to the acquisition and relinquishment of track space in accordance with the invention.

Virtual trains are logical elements that represent free/unassigned track space, but have a similar operational behavior to physical trains. These logical elements are implemented as part of the TSC and operate autonomously based on predefined rules. FIG. 9 shows the interactions between a virtual train 220 and other train control elements. A virtual train 220 can acquire track space from a physical train 222, another virtual train 224, an interlocking control element 228, or an absolute block signal unit (ABSU) 226. In addition, virtual train 220 can lease space from a grade crossing element 230. The acquisition of track space takes place as a train ahead (physical 222 or virtual 224) vacates track space, in response to a route request to an interlocking control element 228, or during a failure condition, wherein an ABSU 226 relinquishes the track space associated with its absolute signal block (ASB) after ensuring that the ASB is vacant. Further, the virtual train 220 receives leased space in response to a request for track space to a grade crossing control element 230.

In addition, a virtual train 220 can relinquish track space to a physical train 232, another virtual train 234, an interlocking control element 238, or an absolute block signal unit (ABSU) 236. Also, the virtual train 220 returns vacated space back to a grade crossing control element 240. The relinquishing of track space takes place after the virtual train 220 vacates track space upon its movement in the indicated direction 221.

Figure 10:
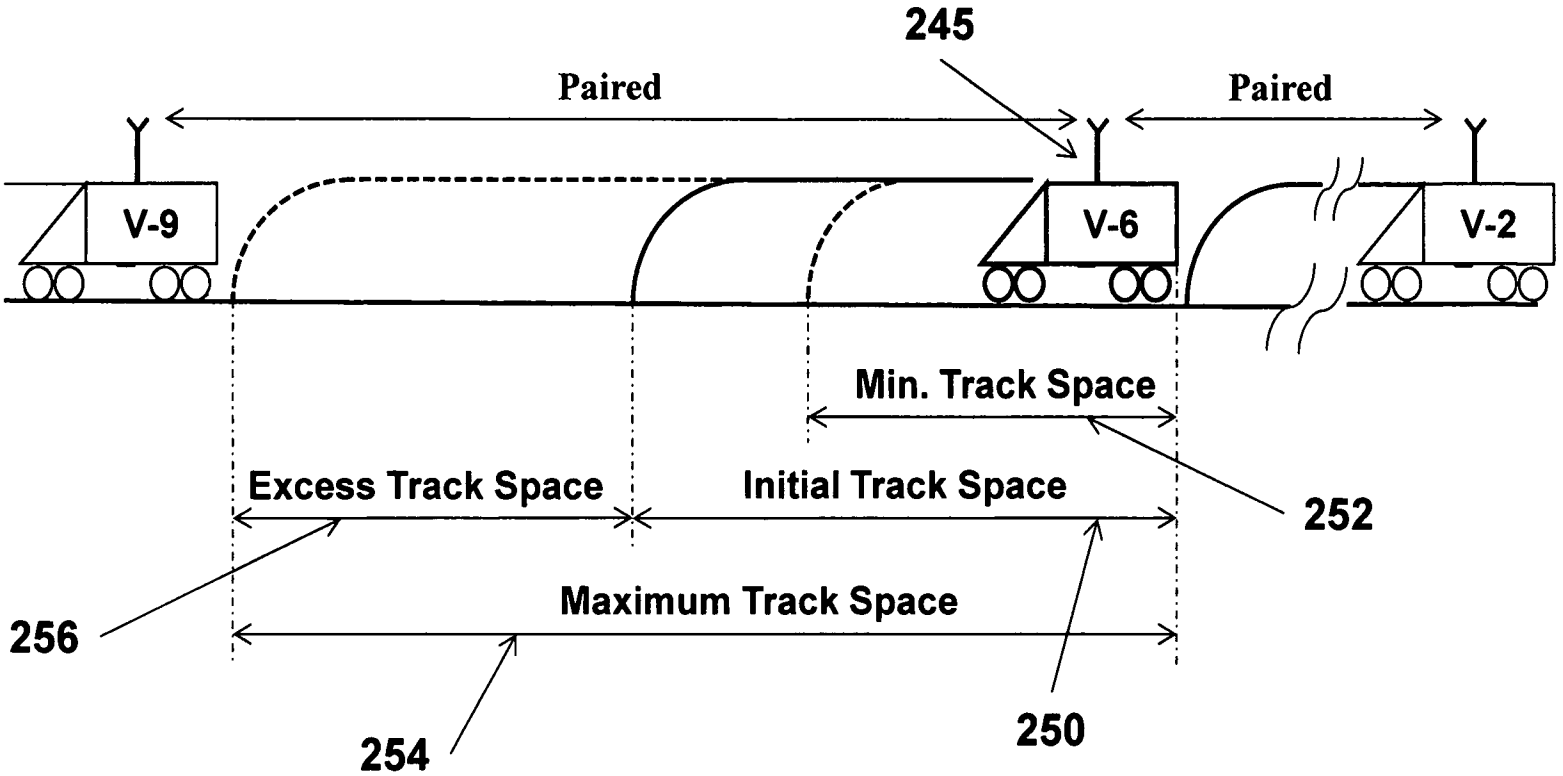
FIG. 10 shows an operational scenario that demonstrates a rule for the autonomous operation of a virtual train in accordance with the invention.

FIG. 10 shows certain characteristics of the autonomous operation for virtual trains. Similar to physical trains, each virtual train establishes a movement authority limit (MAL)

based on the available track space it has acquired from paired elements. Also, a virtual train establishes a stopping profile that is based on the MAL, as well as simulation engine parameters that provide operation of virtual trains based on line operating conditions. It should be noted that although a virtual train has a stopping profile associated with a MAL, such a stopping profile does not constrain certain autonomous functions for virtual trains. For example, if a virtual train needs to be retired, this function could be executed without a delay associated with stopping the virtual train. Referring to FIG. 10, upon the creation of a virtual train 245, it receives an initial track space allocation 250, and the virtual train is then paired with adjacent train control elements to acquire/relinquish track space. As the virtual train 245 continues to operate on the line, its allocated track space varies. If the allocated track space falls below a minimum threshold 252, the virtual train 245 is retired and its allocated track space is relinquished to a paired train control element. Conversely, if the allocated track space exceeds a maximum track space threshold 254, the allocated track space is truncated to the initial track space 250, and the excess track space 256 is used to create a new virtual train. These autonomous rules for the operation of a virtual train ensures that during service interruption affecting the movement of a physical train, there is a manageable track space assigned to the virtual train.

Figure 11:
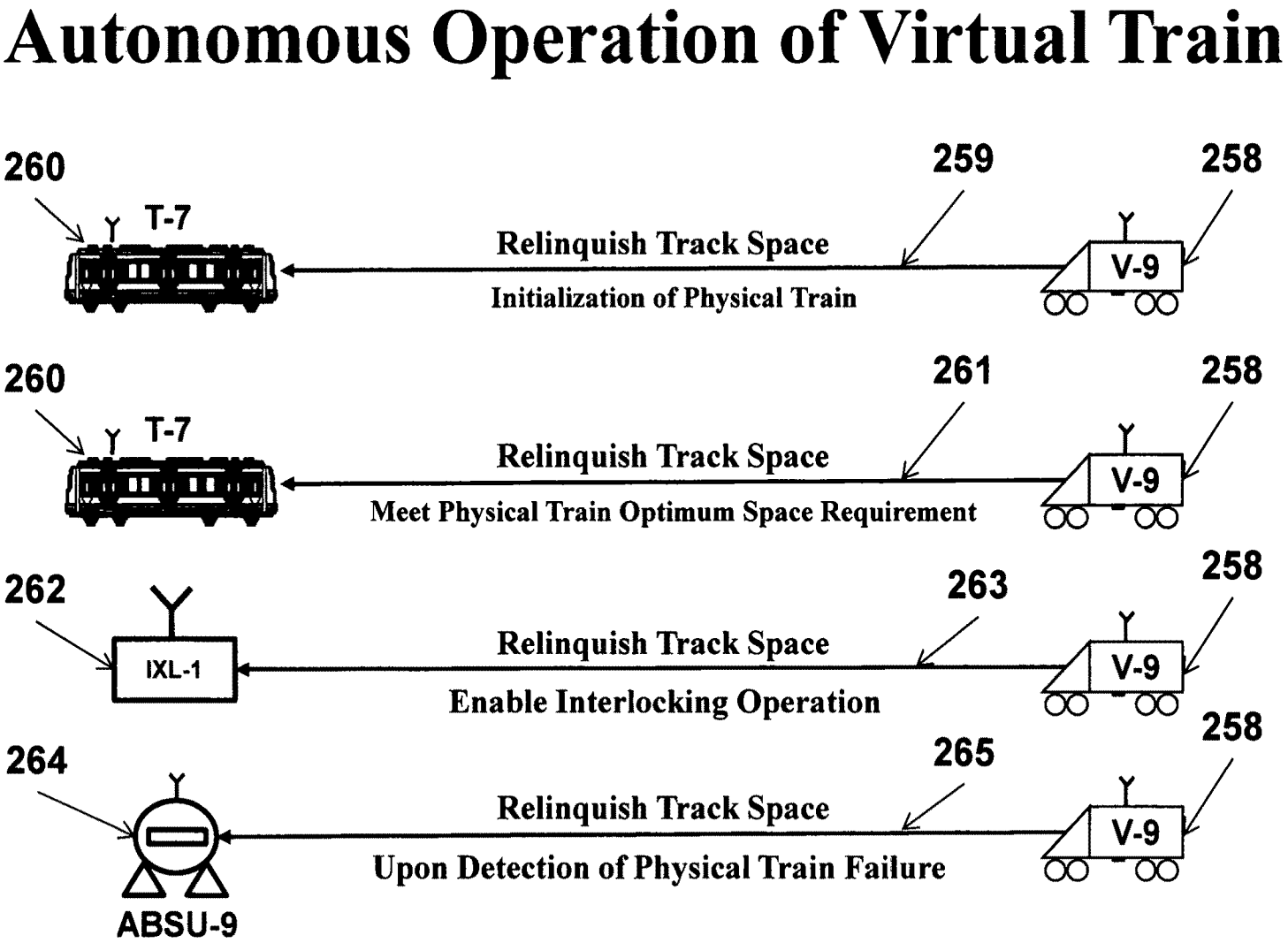
FIG. 11 shows the various operational scenarios during which a virtual train relinquishes track space.

FIG. 11 shows examples of operating scenarios during which a virtual train 258 relinquishes a part or its entire allocated track space to another autonomous train control element. In the first example, virtual train 258 relinquishes track space 259 to physical train 260 during the initialization process of the physical train. In the second example, virtual train 258 relinquishes track space 261 to physical train 260 for the purpose of enabling physical train 260 to meet its optimum space requirements. In the third example, virtual train 258 relinquishes track space 263 to interlocking element 262 to enable interlocking operation (for example, the movement of a switch, or the establishment of a route). In the fourth example, virtual train 258 relinquishes track space 265 to an ABSU element 264 upon the detection of a physical train failure. It should be noted that additional rules for the autonomous operation of virtual trains may be required under unique operating conditions. Such rules will supplement the rules disclosed herein, and will be based on the premise that virtual trains have the lowest priority with respect to track space acquisition. It should also be noted that the concept of virtual trains provides a number of benefits to the ATCS, including flexibility of operation for autonomous train control architecture.

Figure 12:
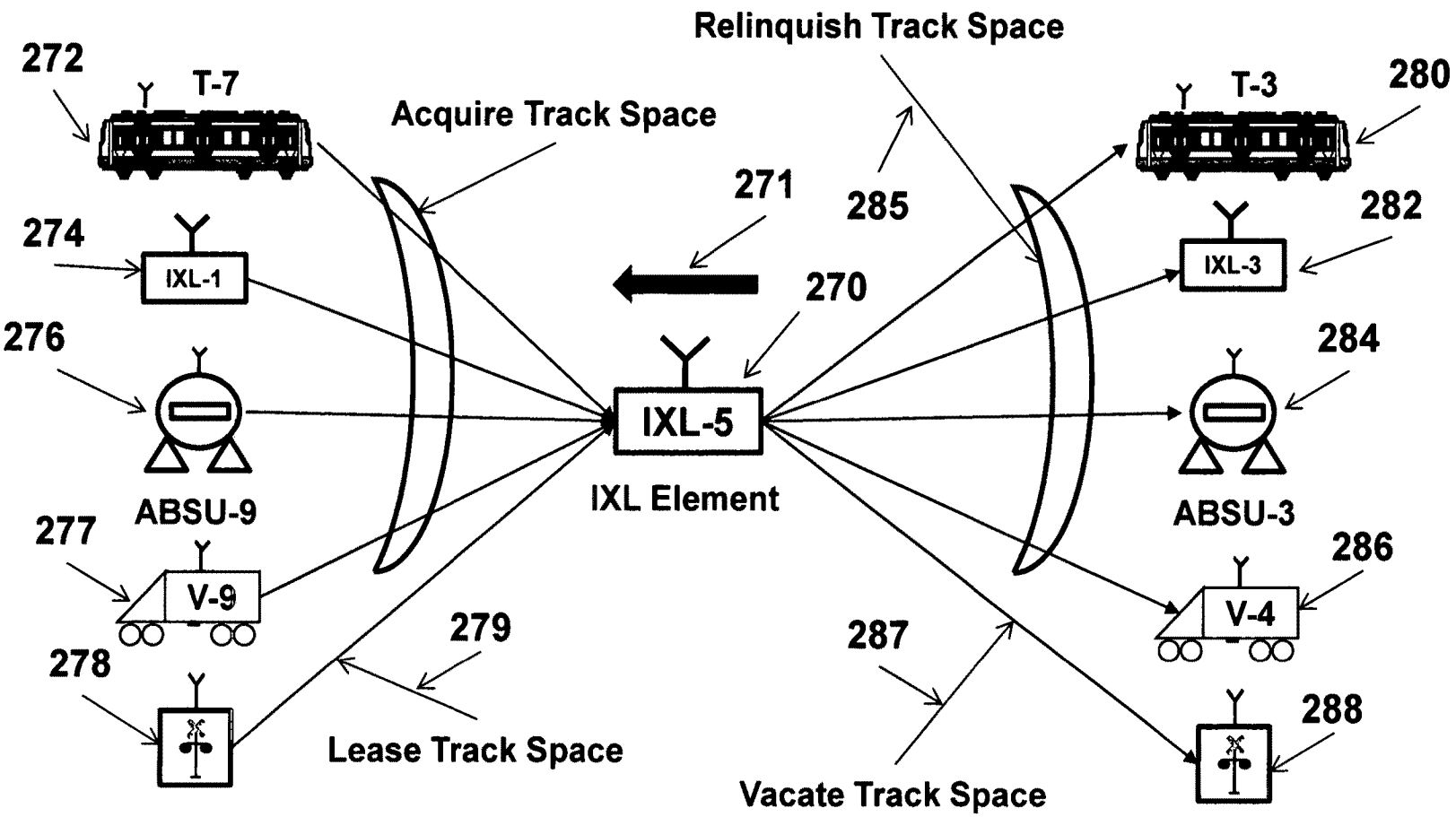
FIG. 12 shows a diagram that demonstrates the autonomous operation of an interlocking element with respect to the acquisition and relinquishment of track space in accordance with the invention.

FIG. 12 shows characteristics of the autonomous operation of an interlocking element 270 for an operating traffic direction 271. In general, an interlocking element acquires track space from a paired element when it is necessary to modify an existing route, establish a new route or modify traffic directions. There are a number of alternate design choices when routes are fleeted (same route is established for consecutive trains). In the first alternative, and pursuant to one design choice, a train moving away from the interlocking relinquishes vacated track space to a following train that is operating on the same route. In such a case, the interlocking element simply monitors the track space transaction between the two trains, and ensures that the route remains secured and locked. In the second alternative, a train moving away from the interlocking relinquishes vacated track space to the interlocking element for reassignment to a following train. As such, FIG. 12 shows various operating conditions during which the interlocking element 270 acquires track space from paired elements. The interlocking element 270 acquires vacated track space from physical train 272 and virtual train 277 as they move away from its location. Also, the interlocking element 270 acquires track space from a second interlocking element 274, and leases track space from grade crossing element 278 for the purpose of changing a traffic direction. Further, the interlocking element 270 acquires track space from an ABSU 276 for the purpose of performing an interlocking function.

The interlocking element 270 also relinquishes track space 285 to paired elements under various operating conditions. For example, upon receiving a request for a route from an approaching physical train 280, or an approaching virtual train 286, the interlocking element 270 will establish and secure the requested route and will relinquish the associated track space to the train that has requested the route. Also the interlocking element 270 relinquishes track space to another interlocking element 284 to enable the modification of a traffic direction. Further, the interlocking element 270 relinquishes track space to an ABSU 284 to enable a failed train to operate in a section controlled by the ABSU 284. In addition, the interlocking element 270 vacates track space 287 that was leased from a grade crossing element 288 after completing a traffic reversal operation. It should be noted that a physical train is not required to be paired to an interlocking element to request an interlocking route. The preferred embodiment employs a concept wherein an interlocking route request could be relayed to an interlocking element through a daisy chain configuration of virtual trains ahead of its location.

Figure 13:
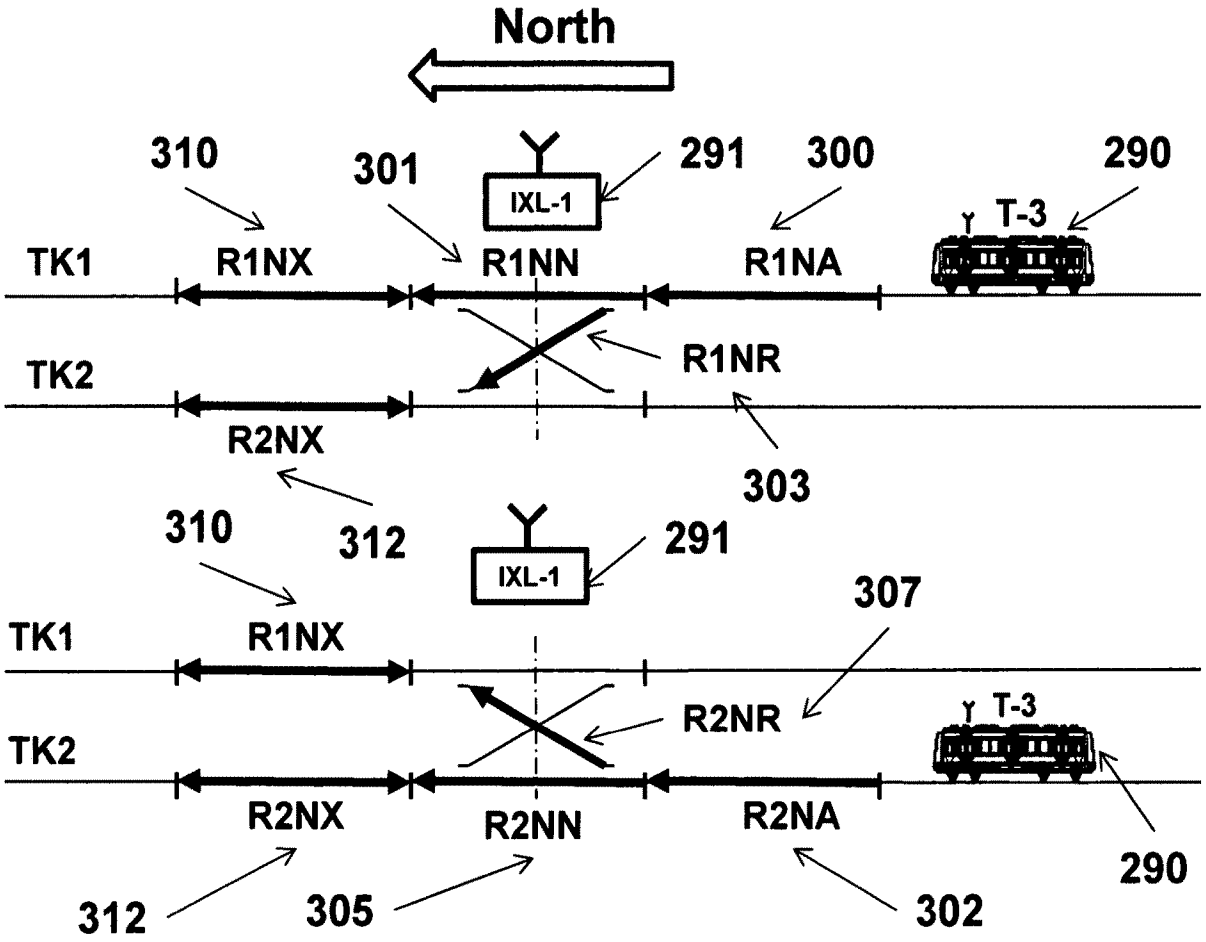
FIG. 13 shows an operational scenario that demonstrates a rule for the autonomous operation of an interlocking element in accordance with the invention.
Figure 14:
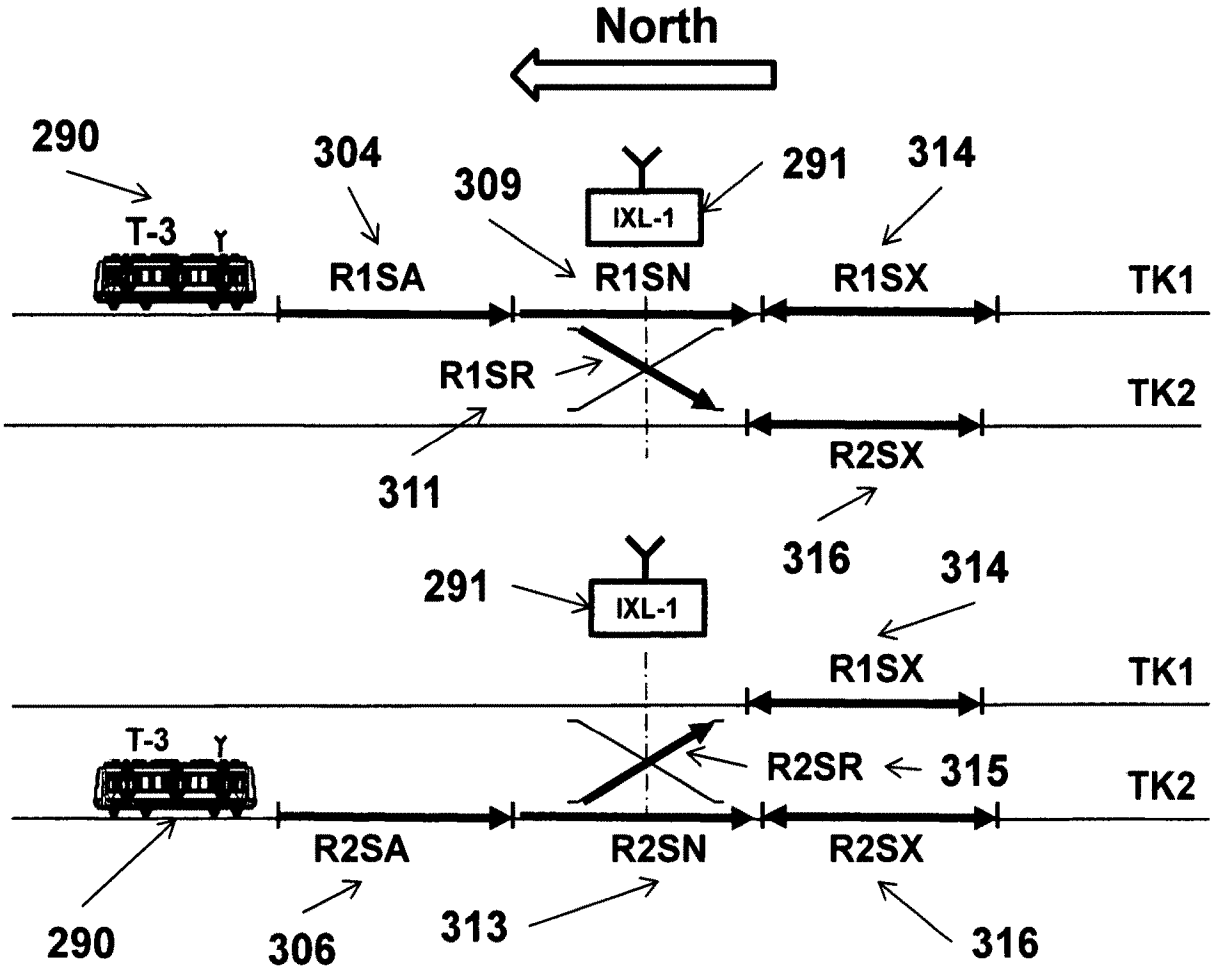
FIG. 14 shows an operational scenario that demonstrates a rule for the autonomous operation of an interlocking element in accordance with the invention.

FIGS. 13 & 14 show the configuration of the various routes at a typical diamond crossover interlocking for the preferred embodiment. In general, there are three route sections for each interlocking route: an "approach" section "R1NA" 300, "R2NA" 302, "R1SA" 304 & "R2SA" 306, a "switch" section "R1NN" 301, "R1NR" 303, "R2NN" 305, "R2NR" 307, "R1SN" 309, "R1SR" 311, "R2SN" 313 & "R2SR" 315, and an "exit" section "R1NX" 310, "R2NX" 312, "R1SX" 314 & "R2SX" 316.

Figure 15:
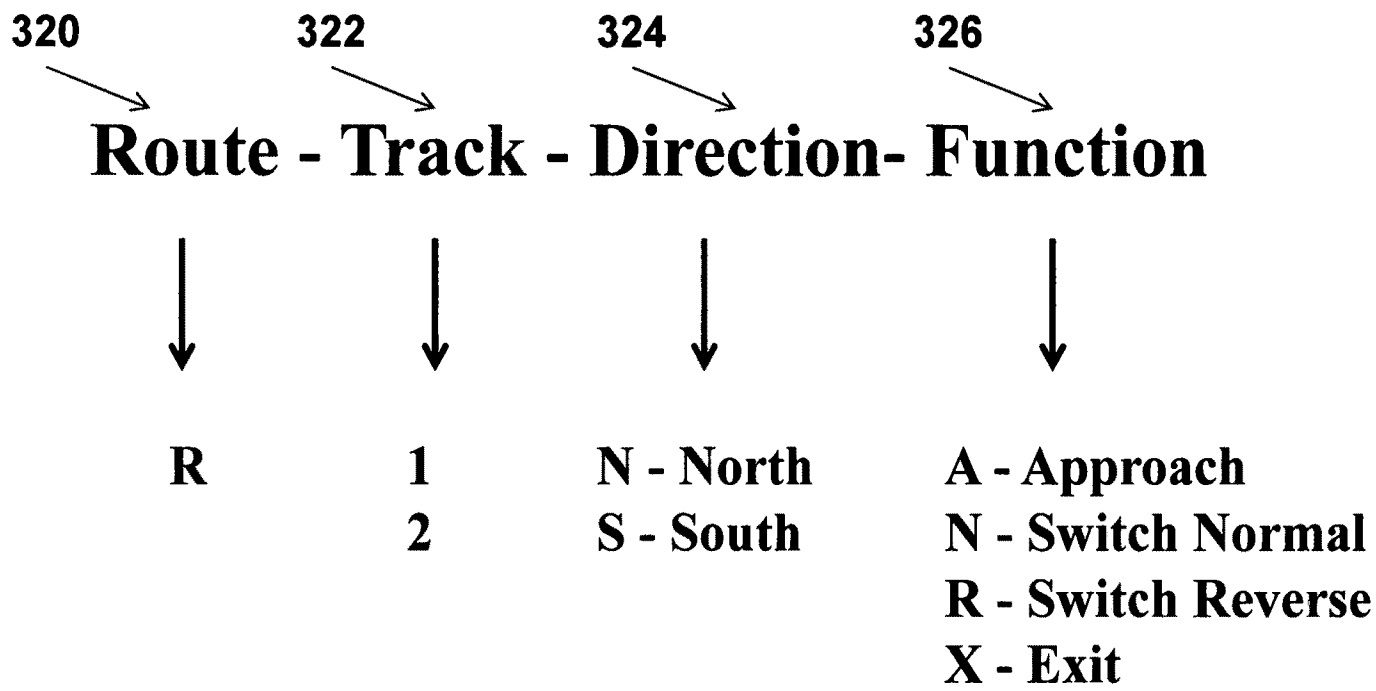
FIG. 15 shows a proposed route section designation for the autonomous operation of an interlocking element in accordance with the invention.

FIG. 15 explains the designation of the route sections for the preferred embodiment. The left most letter "R" 320 is the designation for "Route." The second letter 322 designates the track where the route initiated. In this case, the designation is "1" for TK1 or "2" for TK2. The third letter 324 designates direction of travel: "N" for North and "S" for South. The fourth (right most) letter 326 designates the function of route section, i.e. "A" for an approach section, "N" for a switch section in the Normal position, "R" for a switch section in the Reverse position, and "X" for an exit route section. It should be noted that this designation is provided for the purpose of demonstrating the preferred embodiment and is not intended to limit the invention hereto. As would be understood by a person skilled in the art, different route designations could be used. For example, a designation based on switch number could be used.

With respect to the interaction between a train 290 approaching an interlocking element 291, the train 290 requests track space associated with a route to reach a destination track. For example, in FIG. 14 train 290 moving South on track TK2 requests the interlocking element 291 to relinquish track space to reach destination track TK1. In such case, the interlocking element 291 establishes and secures a route that includes the route sections "R2SA" 306, "R2SR" 315 and "R1SX" 314. The interlocking element 291 will then relinquish the track space associated with the route sections to train 290. In effect, the interlocking element 291 is paired with approaching train 290, and as such it has the origination point for the route. Upon receiving the destination point, it is able to establish and secure the requested route.

Figure 16:
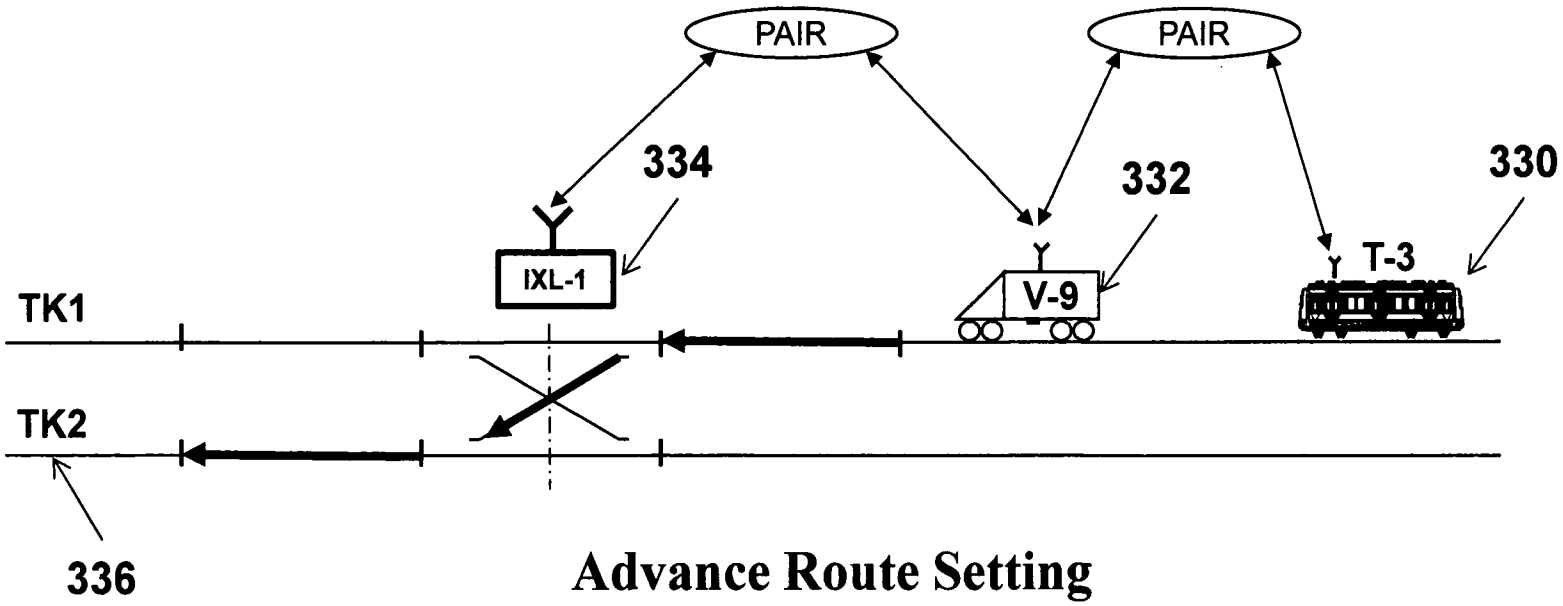
FIG. 16 shows an operational scenario that demonstrates a rule for the autonomous operation of an interlocking element in accordance with the invention.

FIG. 16 demonstrates the concept of advanced route setting, wherein physical train 330 relays its request for a route to TK2 336 to paired virtual train 332. In turn, virtual train 332 will request the interlocking element 334 to establish a route to track TK2 336. Upon receiving this request from virtual train 332, the interlocking element 334 establishes the requested route for both the virtual train 332 and the physical train 330.

Figure 17:
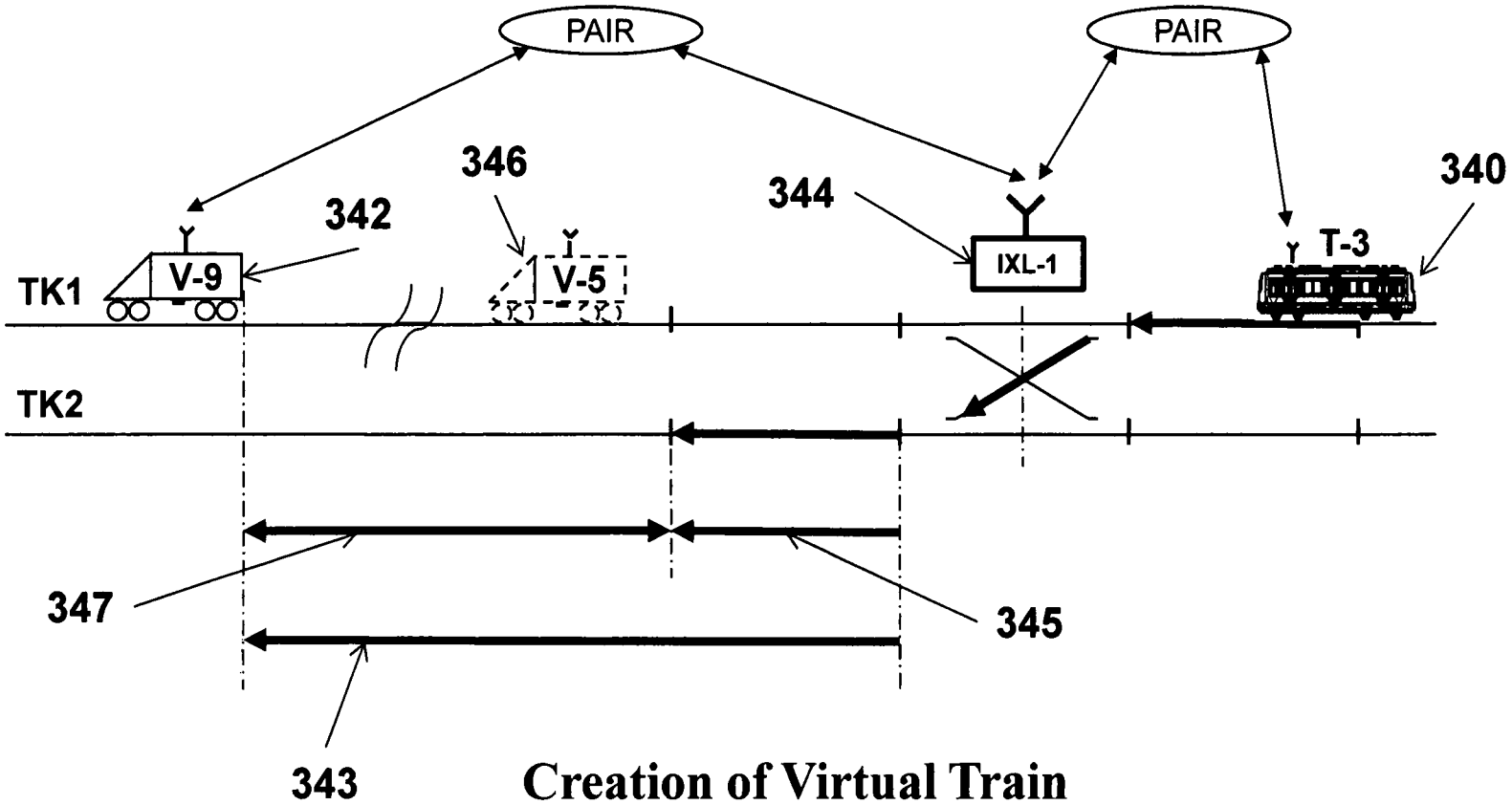
FIG. 17 shows an operational scenario that demonstrates a rule for the autonomous operation of an interlocking element in accordance with the invention.

FIG. 17 demonstrates one of the autonomous functions performed by an interlocking element 344 related to the creation of a virtual train 346 under certain operating conditions. In this operational scenario, physical train 340 is moving over an interlocking route from track TK1 to track TK2. During the operation of physical train T-3 340, the interlocking element acquires vacated track space from virtual train V-9 342, which is moving away from the interlocking. Since no train is able to follow virtual train V-9 342 while the physical train 340 movement is in progress, the interlocking element will continue to acquire more track space 343. When the acquired track space exceeds a maximum threshold 343, the interlocking element creates a new virtual train V-5 346 that is assigned the excess track space 347. This process continues until a train is able to make a normal move over the interlocking.

Figure 18:
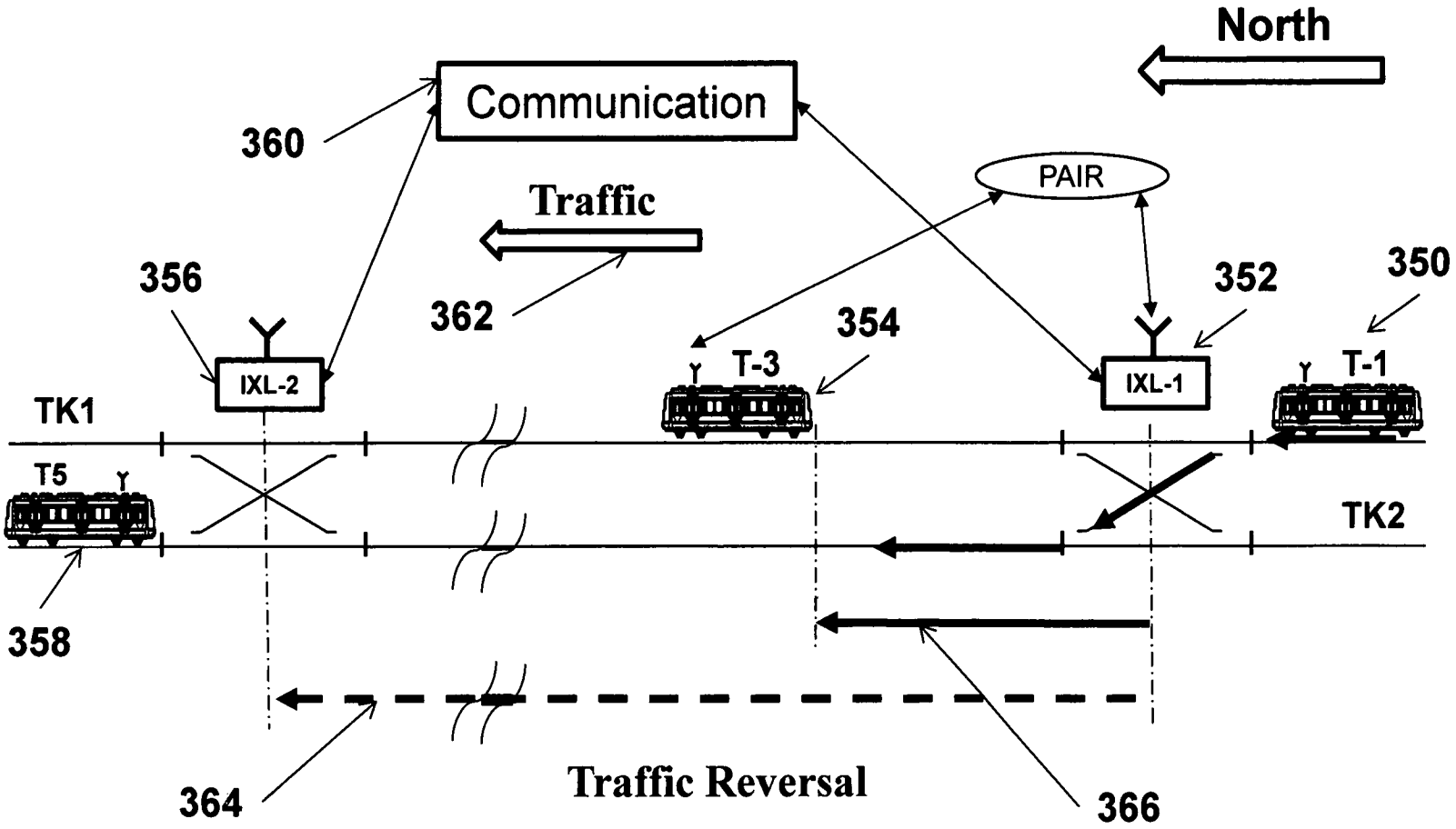
FIG. 18 shows an operational scenario that demonstrates a rule for the autonomous operation of an interlocking element in accordance with the invention.

FIG. 18 demonstrates another autonomous function performed by the interlocking element related to the traffic reversal process. In the shown example, Traffic 362 is set to a Northern direction. The traffic reversal process starts by a request from physical train T5 358 to interlocking element IXL-2 356 to establish a route from track TK2 to track TK1. To implement the requested route, IXL-2 356 requires the reversal of traffic direction 362. Interlocking element IXL-2 356 initiates a request for traffic reversal to IXL-1 352. To implement the traffic reversal function, IXL-1 352 needs to acquire the entire track space 364 between IXL-1 352 and IXL-2 356 on TK1. As such, IXL-1 352 continues to acquire vacated track space 366 from physical train 354. Upon the acquisition of the entire track space 364 between the two interlockings, IXL-1 352 relinquishes the entire track space 364 to IXL-2 356. In turn, IXL-2 356 reverses traffic direction 362 and establishes the requested route for physical train T5 356.

Figure 19:
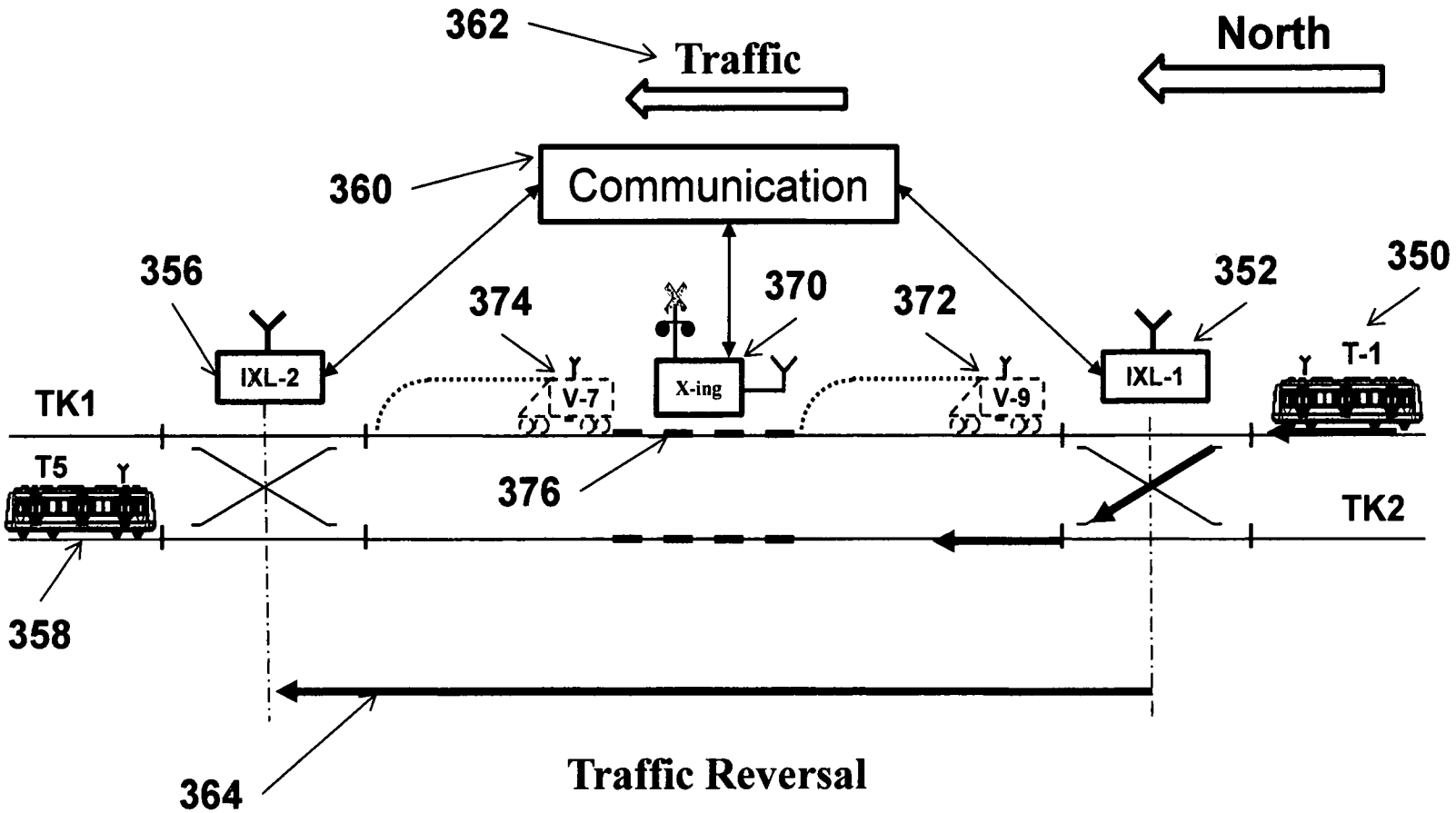
FIG. 19 shows an operational scenario that demonstrates a rule for the autonomous operation of an interlocking element in accordance with the invention.

FIG. 19 demonstrates an alternative configuration of autonomous train control elements, and an associated process for traffic reversal. Similar to the operational scenario of FIG. 18, physical train T5 358 requests interlocking element IXL-2 356 to establish a route from track TK2 to track TK1. This requires that the direction of traffic 362 be reversed to a Southern direction. As explained above, interlocking element IXL-2 356 initiates a request for traffic reversal to DM-1 352. To implement the traffic reversal function, IXL-1 352 needs to acquire the entire track space 364 between IXL-1 352 and IXL-2 356 on TK1. In this case, the track space 364 between IXL-1 and IXL-2 includes track space that is allocated to virtual train V-9 372, virtual train V-7 374 and grade crossing 370. In view of the premise that virtual trains have the lowest priority with respect to track acquisition, upon receiving a request from interlocking element IXL-1 352, virtual trains V-9 372 and V-7 374 relinquish their entire allocated track space to IXL-1 352. Virtual trains V-9 and V-7 are then retired. With respect to the track space 376 allocated to grade crossing 370, it cannot be relinquished to IXL-1 352, as such transfer of track space will result in the activation of the grade crossing 370, which is operationally undesirable. However, as explained above, the preferred embodiment includes the premise of leasing the track space allocated to the grade crossing to an interlocking element for the purpose of enabling traffic reversal. As such, upon receiving a request from IXL-1 352, grade crossing 370 leases its allocated track space 376 to IXL-1. The interlocking element IXL-1 352 then transfers the entire track space 364 to IXL-2 356. This will enable IXL-2 to reverse traffic direction and establishes the route requested by physical train T-5 358. Upon the completion of the traffic reversal, interlocking element IXL-2 356 releases track space 376 back to the grade crossing element 370.

Figure 20:
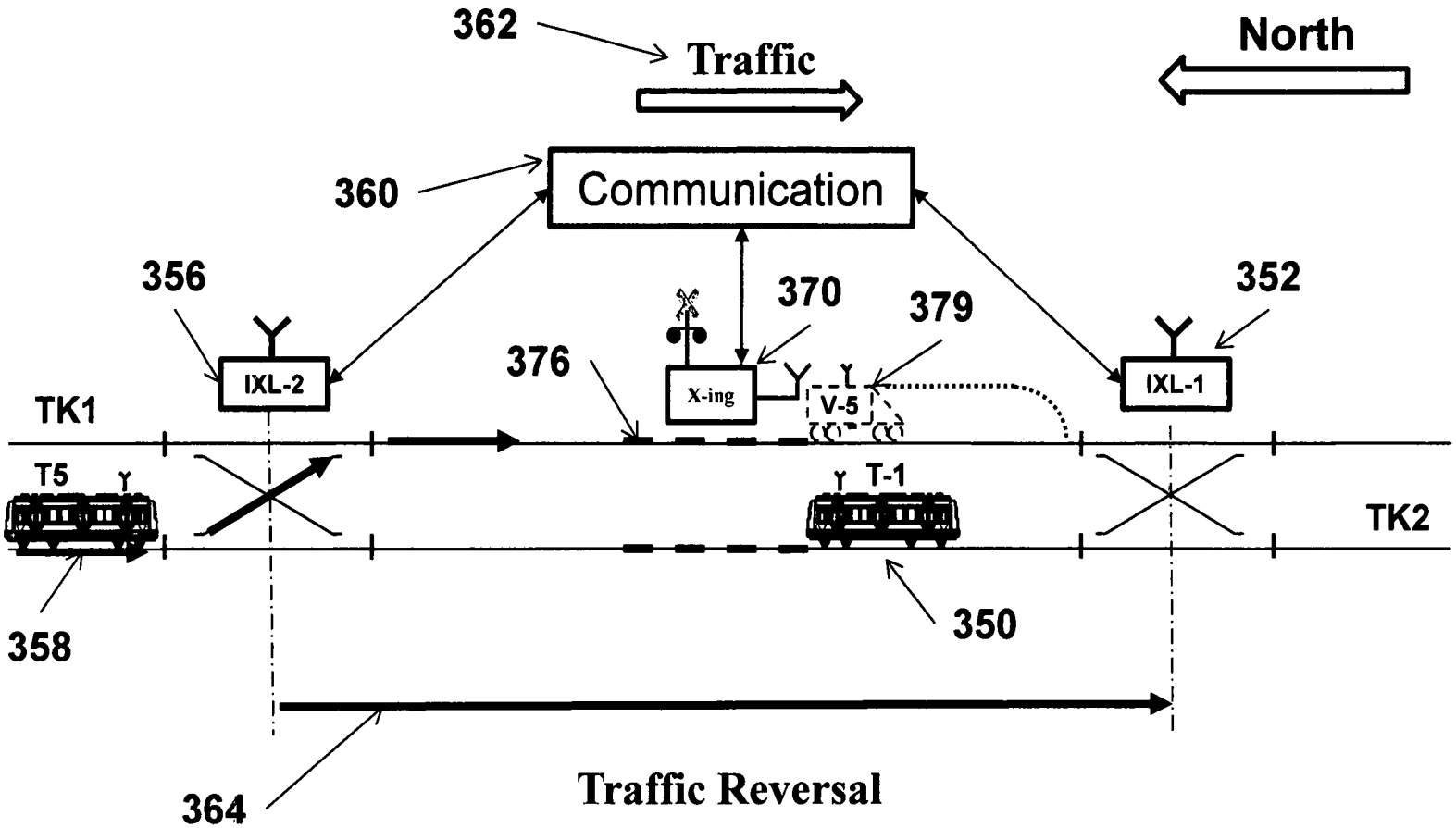
FIG. 20 shows an operational scenario that demonstrates a rule for the autonomous operation of an interlocking element in accordance with the invention.

FIG. 20 demonstrates the autonomous functions performed by an interlocking element IXL-2 355 upon completing a traffic reversal function. The first action performed by IXL-2 355 is to release track space 376 to grade crossing element 370. IXL-2 355 relinquishes track space to physical train 358 as part of the established route from track TK2 to track TK1. IXL-2 358 also relinquishes the remaining traffic track space 364 to a newly created virtual train V-5 379. It should be noted that the initial assignment of track space associated with traffic to the physical train 358 and the newly created virtual train 379 is performed without consideration of the track space rules associated with the autonomous operation of physical trains and virtual trains. These rules become effective after such initial assignment, and may result in the creation of additional virtual trains.

Figure 21:
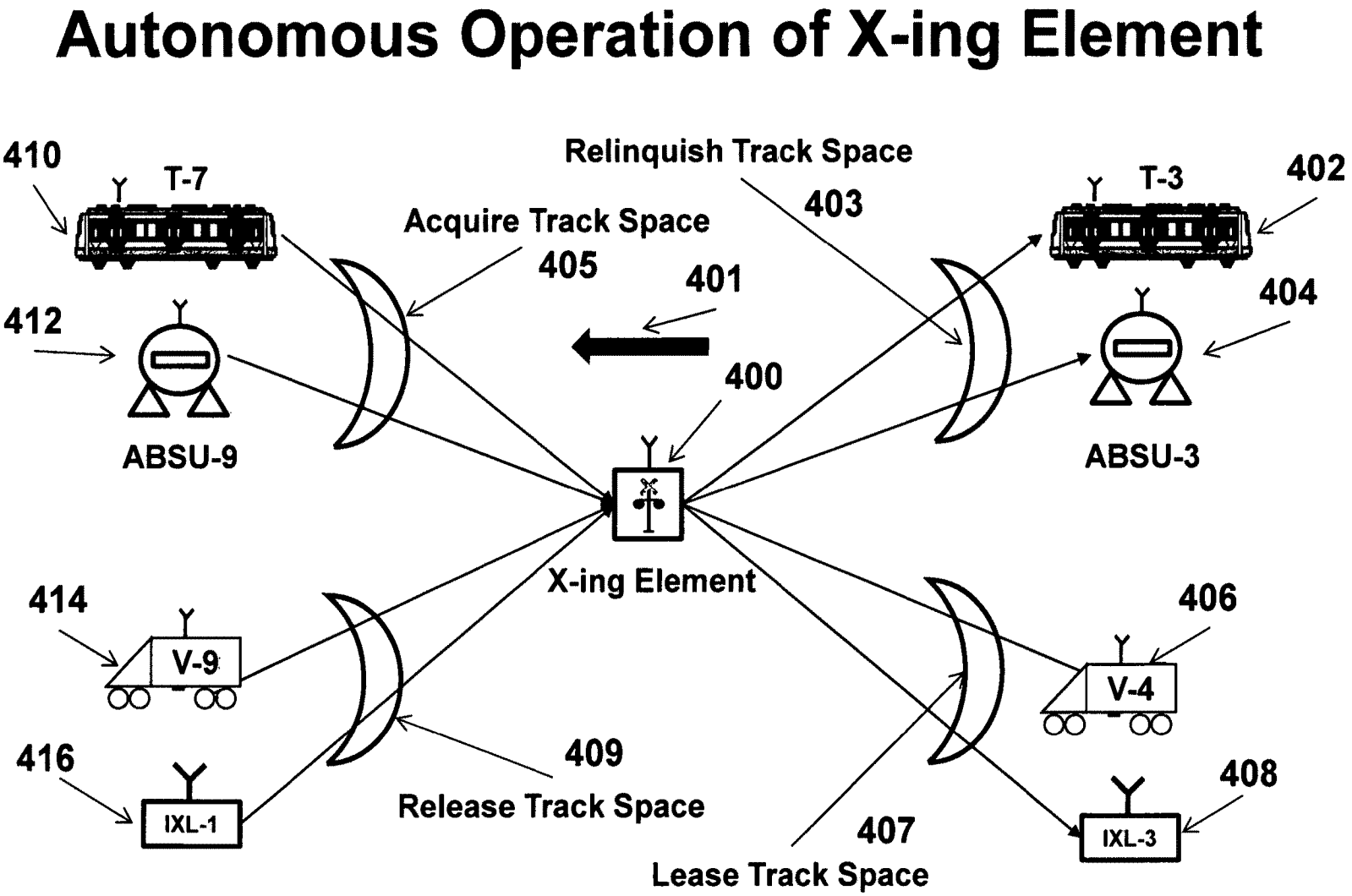
FIG. 21 shows a diagram that demonstrates the autonomous operation of grade crossing element with respect to the acquisition and relinquishment of track space in accordance with the invention.

FIG. 21 shows characteristics of the autonomous operation of a grade crossing control element 400 for an operating traffic direction 401. In general, a grade crossing control element maintains track space that enables vehicle traffic to proceed on the intersecting roadway. It communicates with traffic signal controller to provide advance notification of an approaching physical train, and receive status information related to traffic signal operating and health conditions. The grade crossing element 400 relinquishes its track space only after ensuring that the traffic signal controller is operating correctly, that all minimum functional timing requirements for traffic signals and any associated pedestrian signals have been complied with, and that its warning signals and gates have been activated. As such, grade crossing element 400 relinquishes track space 403 to an approaching physical train 402 or to an absolute block signal unit 404 in the event of a failure condition. The grade crossing element leases track space 407 (without affecting road traffic operation) to virtual trains 406 and interlocking elements 408.

Upon the movement of a physical train 410 past its location or the completion of manual train operation under the supervision of an ABSU 412, the grade crossing element 400 acquires the associated track space 405 before notifying the traffic signal controller to resume road traffic. Similarly, a virtual train 414 or an interlocking element 416 will release track space 409 back to the grade crossing element 400 either after the completion of the virtual train movement, or the completion of the interlocking function requiring the leased track space.

Figure 22:
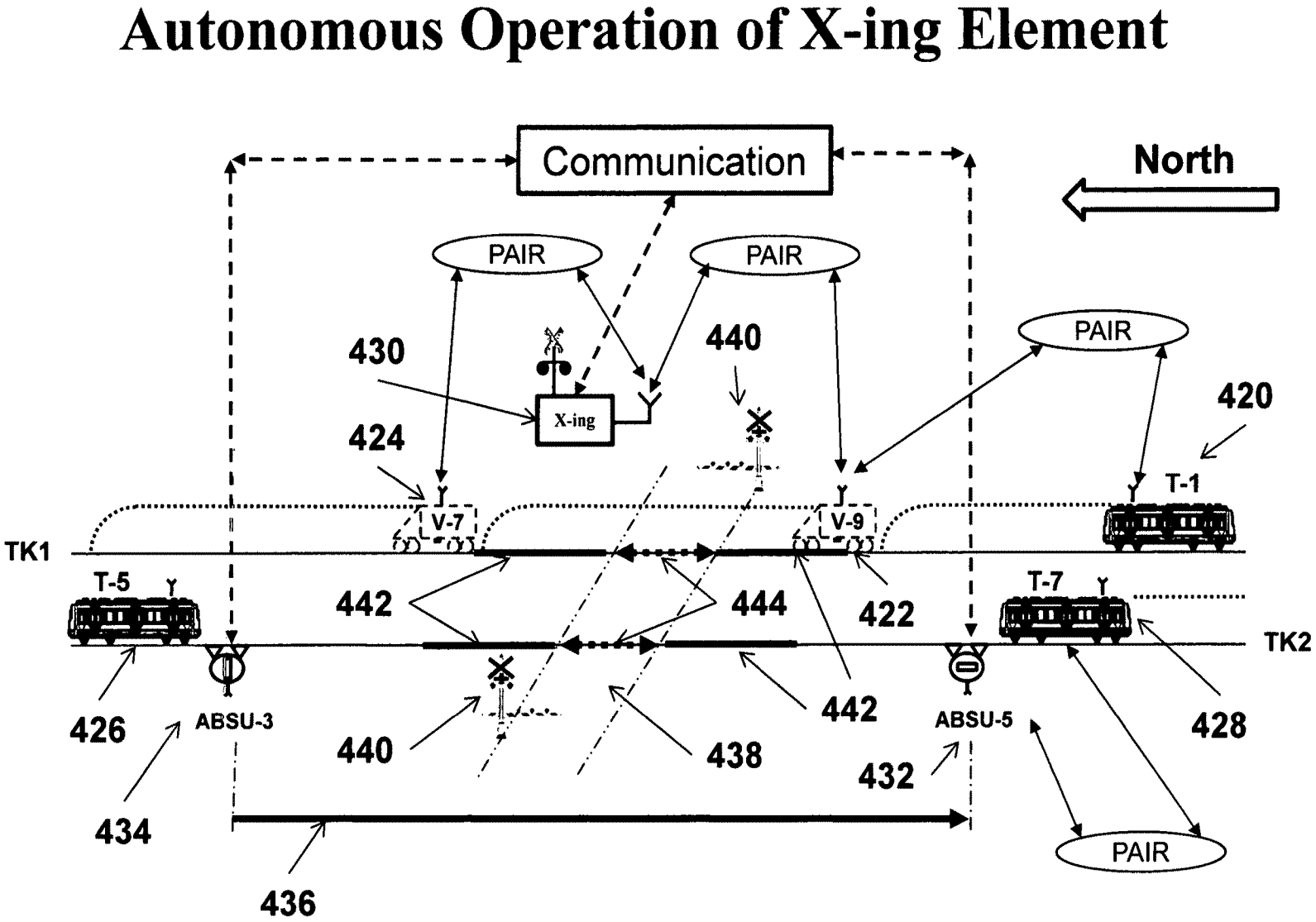
FIG. 22 shows an operational scenario that demonstrates a rule for the autonomous operation of a grade crossing element in accordance with the invention.

FIG. 22 demonstrates interactions between the grade crossing control element 430 and other autonomous train control elements. The grade crossing element 430 controls the warning lights and gates 440 at the intersecting roadway 438. In general, the grade crossing element holds track space associated with grade crossing islands 444 for TK1 and TK2. The grade crossing islands 444 correspond to the intersections between railroad tracks TK1 & TK2 and the roadway 438 protected by the grade crossing element. Further, the grade crossing element 430 controls track space in the approach to island sections 440 on both tracks from both the North and South directions 442. There are two main trigger mechanisms for the grade crossing element 430. The first trigger is based on normal operation, wherein a physical train 420 activates the crossing as it moves within a predetermined distance from the intersection. The second trigger occurs during a physical train failure condition, wherein the operation of the failed physical train 426 is under the control of ABSUs 432 & 434.

Under normal train operation, the grade crossing element 430 must provide adequate warning time to pedestrian and vehicle traffic when a physical train approaches the intersection. With respect to operation on TK1 of FIG. 22, virtual trains V-7 422 and V-9 424 traverse through the grade crossing boundaries (track space associated with approaches and island) without activating the grade crossing equipment. This is based on the above described concept of leased track space. Virtual train V-9 422 is paired with following physical train T-1 420, and as such it informs the grade crossing controller 430 that physical train T-1 420 is approaching. Upon receiving such notification, the grade crossing controller 430 monitors the position of virtual train V-9 422, and when the virtual train V-9 422 is at the boundary of its southern approach, it acquires the entire track space leased to virtual train V-9 422 and effect the retirement of this virtual train. This will result in the pairing of grade crossing controller 430 with approaching physical train T-1 420. When physical train T-1 420 reaches a predefined location from the grade crossing island, the grade crossing controller 430 will execute a process to communicate with traffic light signal controller, and activate the grade crossing equipment 440. After receiving confirmation that the grade crossing equipment 440 has been activated, the grade crossing controller 430 relinquishes track space to the physical train T-1 420 to proceed through the grade crossing territory. It should be noted that the location of physical train T-1 420 at which the grade crossing controller 430 starts to execute the grade crossing activation process can vary based on the speed of the approaching physical train T-1 420. In order to ensure adequate warning time at the grade crossing, the grade crossing controller 430 transmits to approaching physical train T1 420 a minimum time duration before physical train T-1 can enter the island track space. When physical train T-1 420 vacates the island track space 444, the grade crossing controller 430 commences a process to deactivate the grade crossing equipment 440.

With respect to the operation on track T-2 of FIG. 22, failed physical train T-5 426 is held at ABSU3 434, until the absolute block track space 436 associated with ABSU3 434 is free of physical trains. Upon acquiring the entire absolute block track space 436, including leased track space 442 & 444 from the grade crossing controller 430, ABSU3 434 requests the grade crossing controller 430 to acquire the leased track space associated with the grade crossing 442 & 444 in order to enable failed physical train T-5 426 to proceed through the absolute block territory 436. Upon receiving such request, the grade crossing controller 430 executes the grade crossing activation process and upon receiving confirmation that the grade crossing equipment 440 has been activated, it enables failed physical train T-5 426 to proceed through the absolute block track space 436. Then upon receiving confirmation from ABSU5 432 that failed physical train T-5 426 has crossed its location, the grade crossing controller starts the process to deactivate the grade crossing equipment 440. It should be noted that under this operation scenario, the activation time for grade crossing equipment could be long. One design choice is to use auxiliary detection at the crossing island 444 to shorten the activation time by deactivating the crossing equipment 440 after the failed physical train T-5 426 leaves the crossing island 444.

Figure 23:
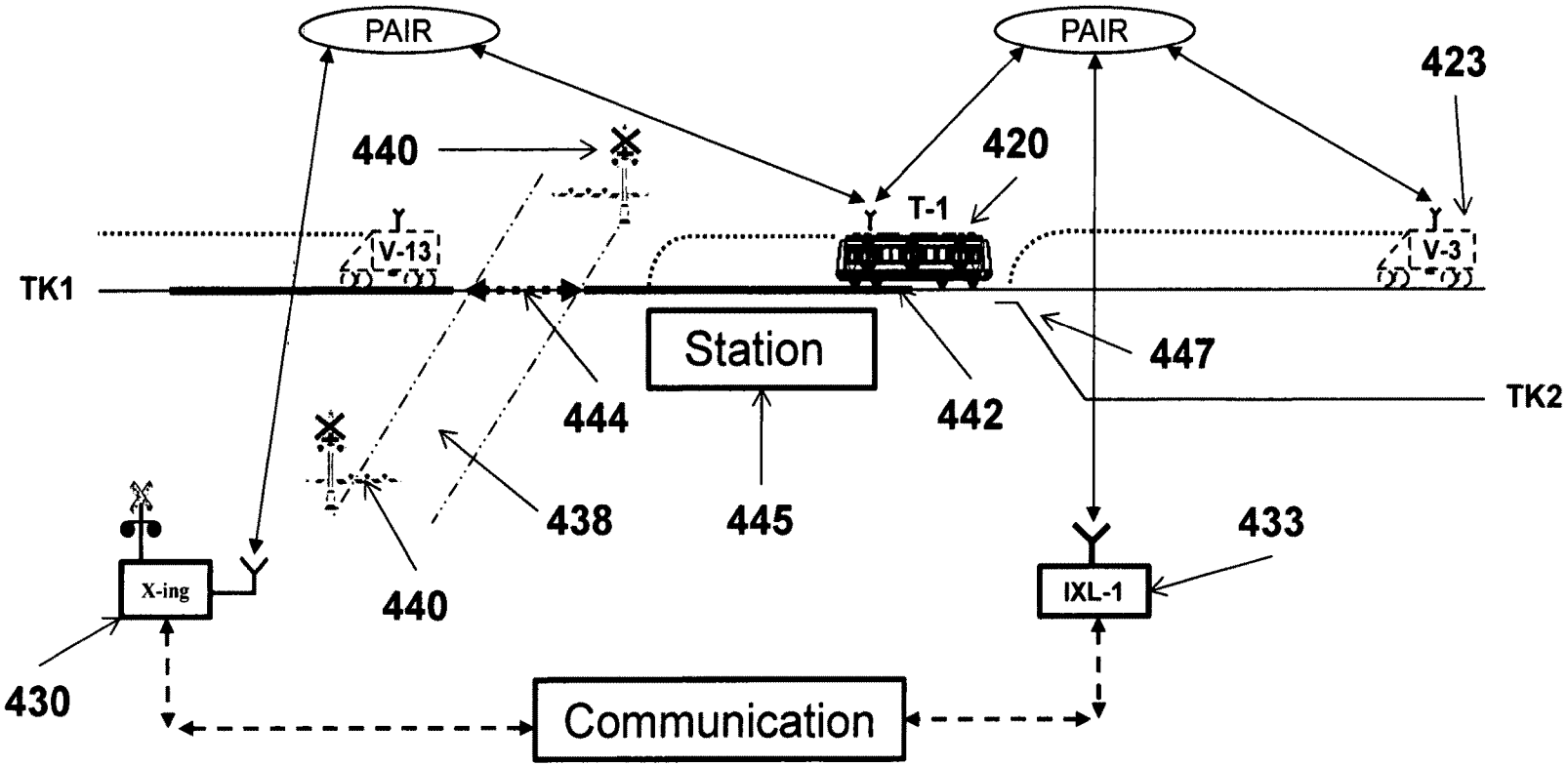
FIG. 23 shows an operational scenario that demonstrates a rule for the autonomous operation of a grade crossing element in accordance with the invention.

As explained above, the grade crossing element 430 normally holds the track space at the intersection islands 444, and controls the track space 442 in the approach to intersections. This enables the grade crossing element 430 to allow vehicle traffic on the roadway 438 when there are no physical trains approaching the intersection, or in the event of an operational scenario that requires a physical train to move close to the intersection without actually crossing the intersecting roadway. One such operating scenario is shown in FIG. 23, wherein physical train T-1 420 makes a station stop and then turns back over an interlocking switch 447 without reaching the intersection island track space 444. The grade crossing controller 430 relinquishes only the approach track space 442 to physical train T-1 420 upon receiving a stop assurance that the physical train will stop before reaching the grade crossing island 444. A stop assurance function is generated by the physical train 420, and indicates that the train is able to stop within its allocated track space that was relinquished to the train by the grade crossing controller 430.

Figure 24:
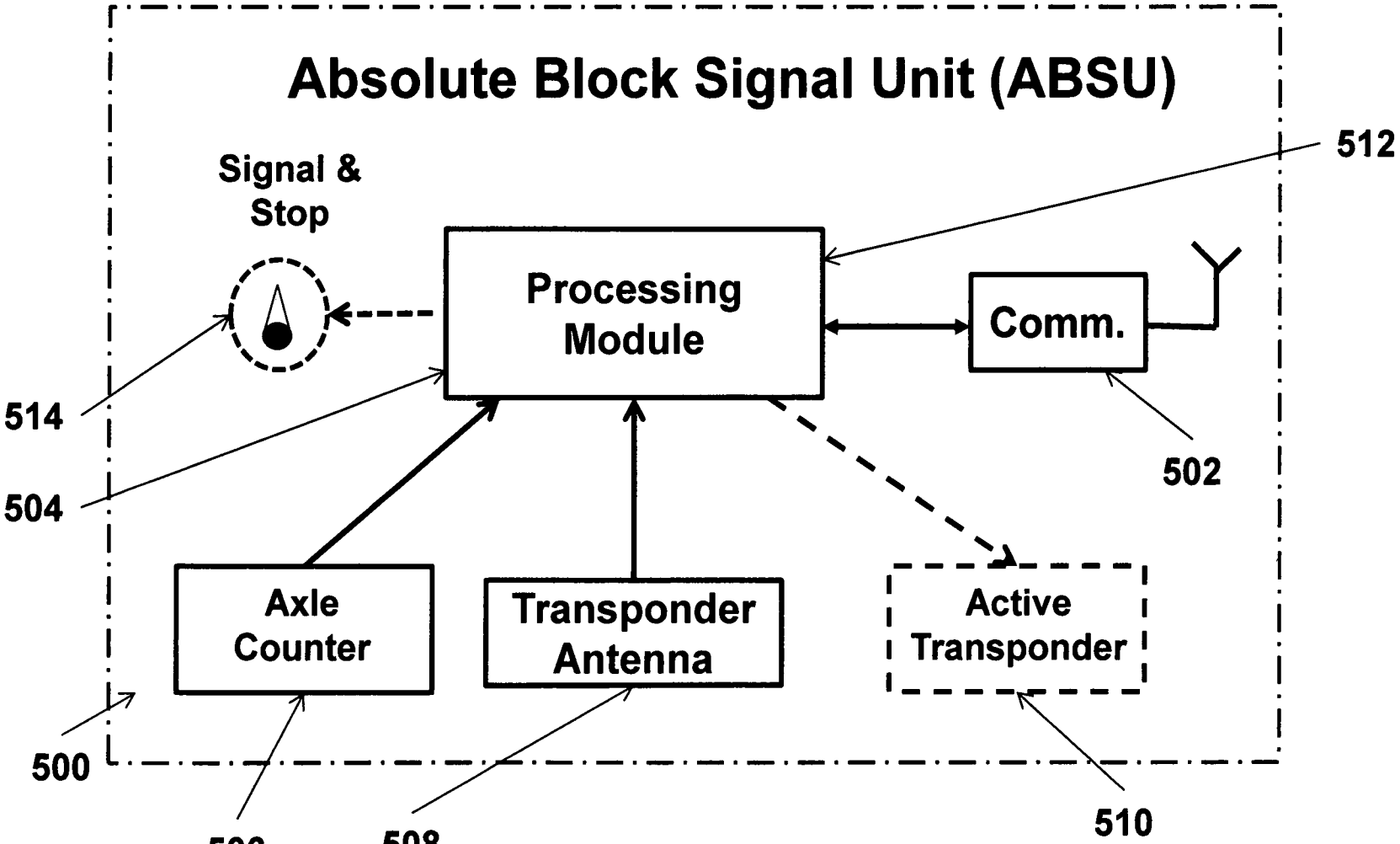
FIG. 24 shows a generic configuration of an Absolute Signal Block Unit in accordance with the invention.

As explained above, the ATCS includes an optional autonomous train control element, which is defined as an Absolute Block Signal Unit (ABSU), to provide a backup mode of operation during system failures. Further, the ABSU facilitates system and train initializations. The ABSU operation is based on the absolute permissive block principle, wherein a train is given a movement authority to proceed through a block from the entering boundary of the block to its exit boundary when the entire block is vacant. The design of the ABSU is based on a generic configuration of traditional signal elements. As shown in FIG. 24, a typical ABSU 500 includes a processing module 512, a communication module 502, an axle counter 506, a transponder antenna 508, an optional active transponder 510 and an optional signal/stop element 514.

Figure 25:
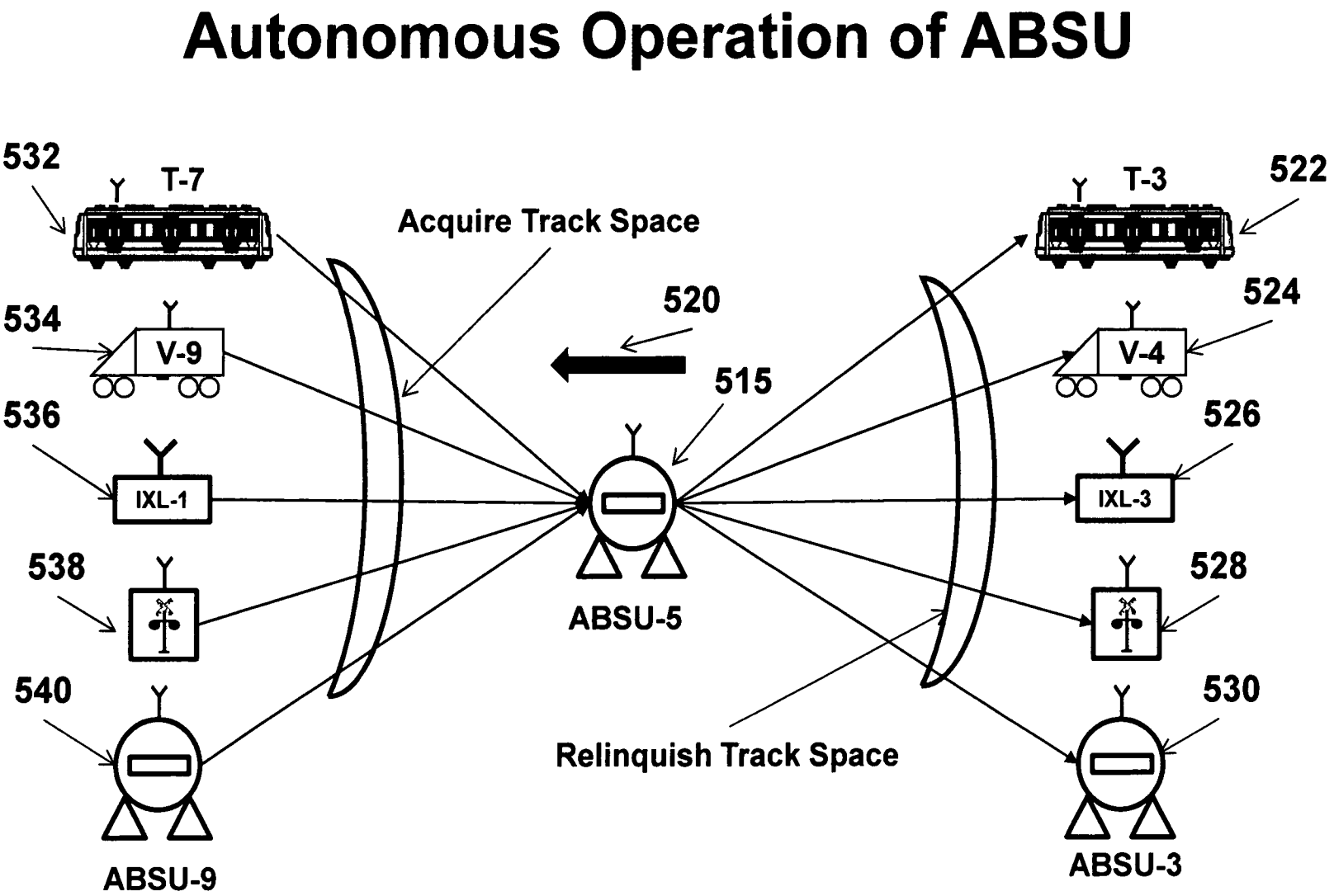
FIG. 25 shows a diagram that demonstrates the autonomous operation of an Absolute Signal Block Unit with respect to the acquisition and relinquishment of track space in accordance with the invention.

FIG. 25 shows characteristics of the autonomous operation of an Absolute Block Signal Unit (ABSU) 515 for an operating traffic direction 520. In general, an ABSU element acquires track space from a paired element when it is necessary to provide a backup mode of operation during system failures. As such, FIG. 25 shows various operating conditions during which the ABSU element 515 acquires track space from paired elements. The ABSU element 515 acquires vacated track space from physical train 532 during a failure condition. This ABSU function is triggered upon the detection of a failed physical train approaching its location. Similarly, when operationally required, the ABSU element 515 acquires track space from a virtual train 534 during a failure condition. The acquisition of track space from a virtual train 534 is not based on vacated track space, but rather an ABSU element acquires the entire track space assigned to a virtual train, and which falls within the ABSU territory. Further, an ABSU element 515 acquires track space within its associated absolute block territory from an interlocking element 536. In such a case, the ABSU element 515 also ensures that an interlocking route is secured for the movement of a failed physical train through its absolute block territory. Similarly, an ABSU element leases/acquires track space from a grade crossing element 528 that is located within its absolute block territory.

Normal ATCS operation does not require an ABSU element 515 to acquire track space from an ABSU ahead 540. However, under unique operating condition, wherein it is desirable to operate a manual train, an ABSU element acquires track space from an ABSU ahead to provide an overlap (sufficient breaking distance) for manual train operation.

The ABSU element 515 does not directly relinquish track space to a failed physical train since the failed physical train may not be paired with the ABSU element. Rather, the ABSU 515 permits the failed physical train to proceed through its track space until it leaves its absolute block territory. Further, upon receiving confirmation from the ABSU ahead that the failed physical train has passed its location, the ABSU element 515 relinquishes its track space to an approaching physical train 522. Similarly, an ABSU element 515 relinquishes its track space to a new created virtual train 524 upon the completion of a failed physical train movement outside of its absolute block territory. In addition, an ABSU element 515 relinquishes track space to an interlocking element 526 to enable the execution of interlocking functions. Also, the ABSU element 515 relinquishes space to a grade crossing element 528 as demonstrated in FIG. 22. Furthermore, the ABSU 515 relinquishes track space to an approach ABSU 530 to support manual train operation as explained above.

Figure 26:
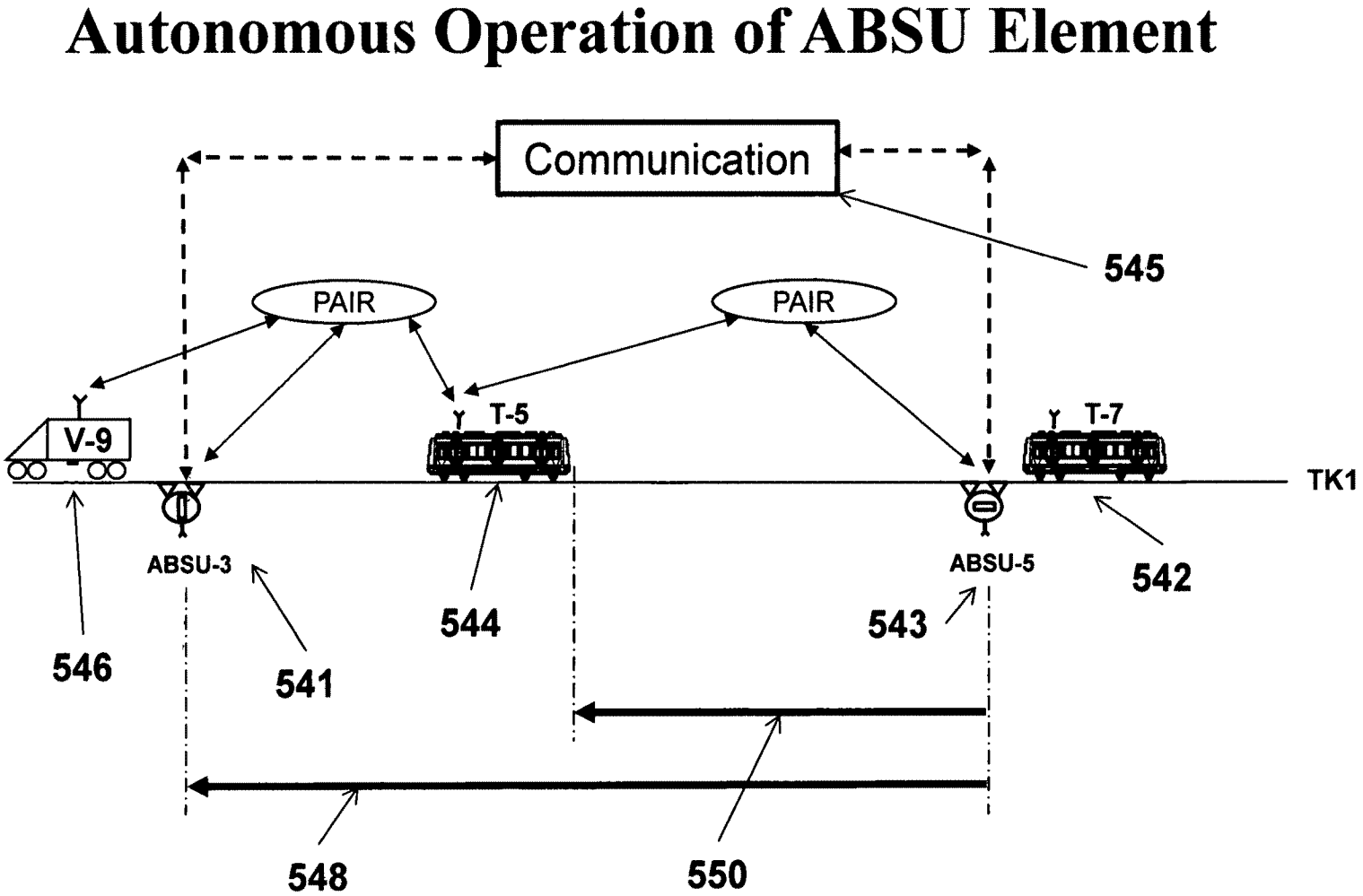
FIG. 26 shows an operational scenario that demonstrates a rule for the autonomous operation of an Absolute Signal Block Unit in accordance with the invention.

FIG. 26 demonstrates the basic autonomous operation of an ABSU element. As explained above, during normal ATCS operation, the ABSU elements operate in a passive mode to monitor the operation of autonomous trains (physical and virtual), without performing any control function that affects train movements. Upon the detection of failed physical train T-7 542 that is approaching its location, ABSU-5 543 switches to an active mode of operation wherein it controls the movement of trains into its associated absolute block track space 548. ABSU-5 543 acquires track space 550 that is vacated by a physical train T-5 544, which is moving away from its location. Then upon acquiring the entire absolute block track space 550, ABSU-5 543 permits failed train T-5 544 to move past its location and enter its associated absolute block territory 550. Depending on the type of failure, ABSU-5 543 can transmit a movement authority limit to failed train T-5 544 using an active transponder 510 (FIG. 24). Alternatively, ABSU-5 543 can activate a permissive wayside signal to authorize failed train T-5 543 to operate manually past its location.

Figure 27:
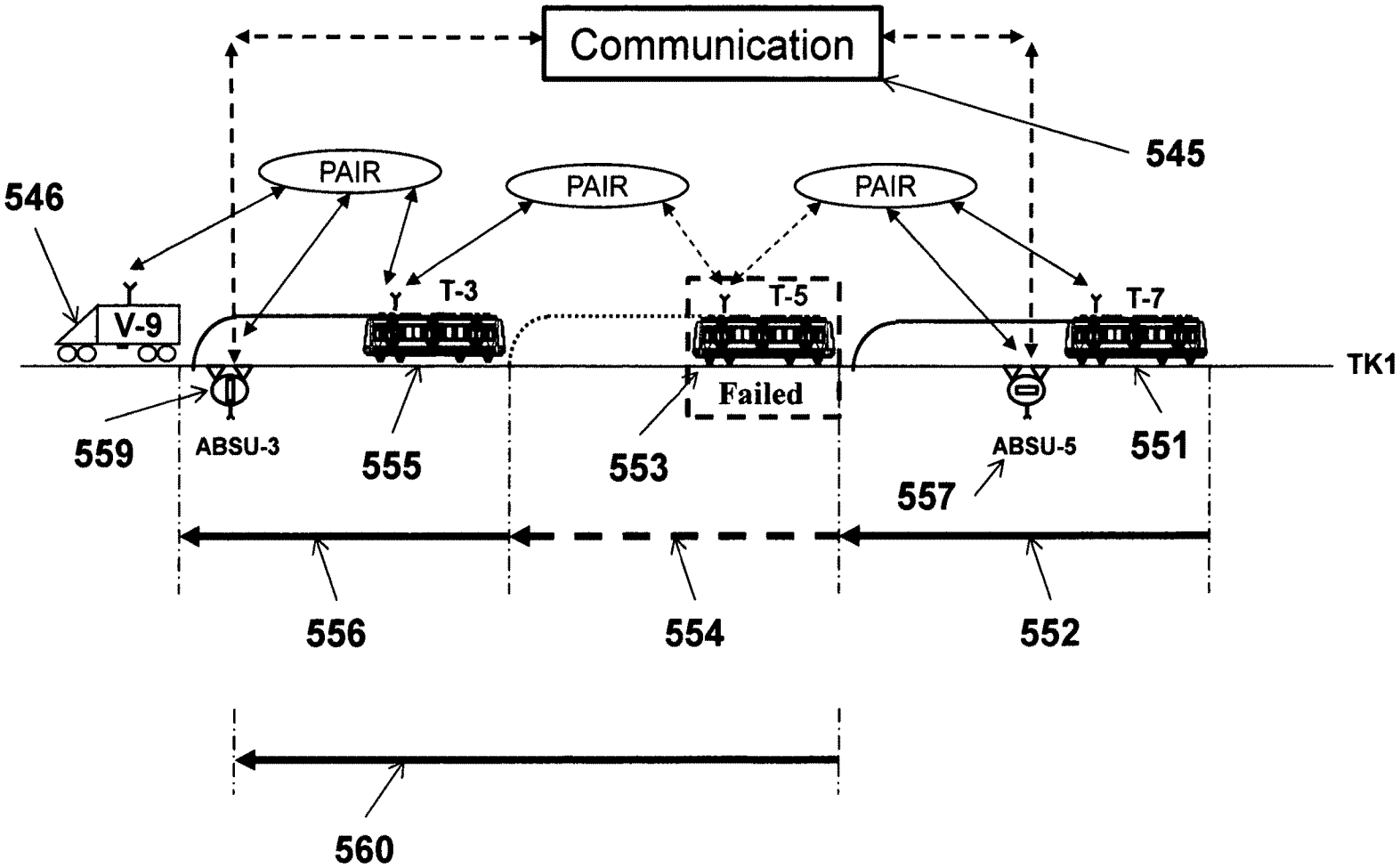
FIG. 27 shows an operational scenario that demonstrates a rule for the autonomous operation of an Absolute Signal Block Unit in accordance with the invention.

FIG. 27 illustrates certain ABSU autonomous functions associated with a physical train T-5 553 failure. In this figure, physical trains T-3 555, T-5 553 and T-7 551 are operating in the vicinity of ABSU-3 559 and ABSU-5 551. Prior to the failure, the physical trains had track space allocations 552, 554 & 556 as shown in FIG. 27. Upon the failure of physical train T-5 553, and especially if physical train T-5 is not able to communicate with paired train control elements T-3 555 and T-7 551, physical train T-5 553 cannot relinquish vacated track space to T-7 551, and cannot acquire additional track space from T-3 555. As such, failed physical train T-5 553 initially retains the track space it had 554 at the time of the failure. The movement of T-5 is then governed by operating rules and procedures. Typically in the preferred embodiment, T-5 receives authorization to proceed at restricted speed passed the limit of its allocated track space 554. Further, physical train T-7 551 is not able to acquire additional track space, and as such is not able to move past the movement authority limit associated with its track space 552. In addition, track space vacated by T-3 555 cannot be assigned to T-5.

Upon losing contact with failed physical T-5, physical train T-3 555 informs ABSU-3 559 that a failed physical train is approaching its location. It also provides ABSU-3 with the train signature information for failed train T-5. This enables ABSU-3 to identify physical train T-5 when it approaches its location. It also enables ABSU-3 to determine when all the axles of T-5 have passed its location. Further, upon receiving T-5 failure information, ABSU-3 559 switches to the active mode. Then upon the movement of physical train T-3 555 past its location, ABSU-3 559 assumes the "stop" operating state and acquires the track space vacated by T-3 in the approach to its location. ABSU-3 then holds said vacated track space in abeyance to be relinquished to the next train T-7 551 at a later time. In addition, ABSU-3 starts acquiring the additional track space vacated by T-3 555. Then, upon accumulating track space equal to its associated absolute block track space, ABSU-3 559 authorizes failed physical train T-5 553 to pass its location as explained by the operation shown in FIG. 26. Also, after the movement of T-5 past the location of ABSU-3 559, ABSU-3 creates a new virtual train and relinquishes the track space that was originally assigned to T-5 together with the track space held in abeyance 560 to the new virtual train. The newly created virtual train will operate within the track space occupied by T-5, and will relinquish vacated track space to physical train T-7 551.

In addition to providing a fallback mode of operation during ATCS failures, ABSUs are used to support system and train initialization functions. Upon entering a territory controlled by the Autonomous Train Control System (ATCS), a physical train is initialized to operate in the territory. The physical train initialization process consists of a number of functions, including localization of the physical train, sweeping track space adjacent to the front and back ends of the train (also known as the "sieving function"), establishing communication with the Track Space Controller (TSC), transmitting physical train operating data to the TSC, allocating an initial track space to the physical train, and pairing the physical train with appropriate autonomous train control elements. To establish initial communication with the TSC, the CIC includes a number of memory pairing modules defined as "incubators," and are used to establish communication between a newly initialized physical train and the TSC. In order to control the initialization process, ABSUs operate in the active mode, wherein they control movement of localized and paired trains into the associated absolute block track space territories. Under the active mode, an ABSU accumulates track space from a paired physical train that is localized. Further, an ABSU receives the sieving status of the localized train moving away from its location, and uses this status as one of the parameters to determine if an approaching physical train should be authorized to move into its associated absolute block track space.

Figure 28:
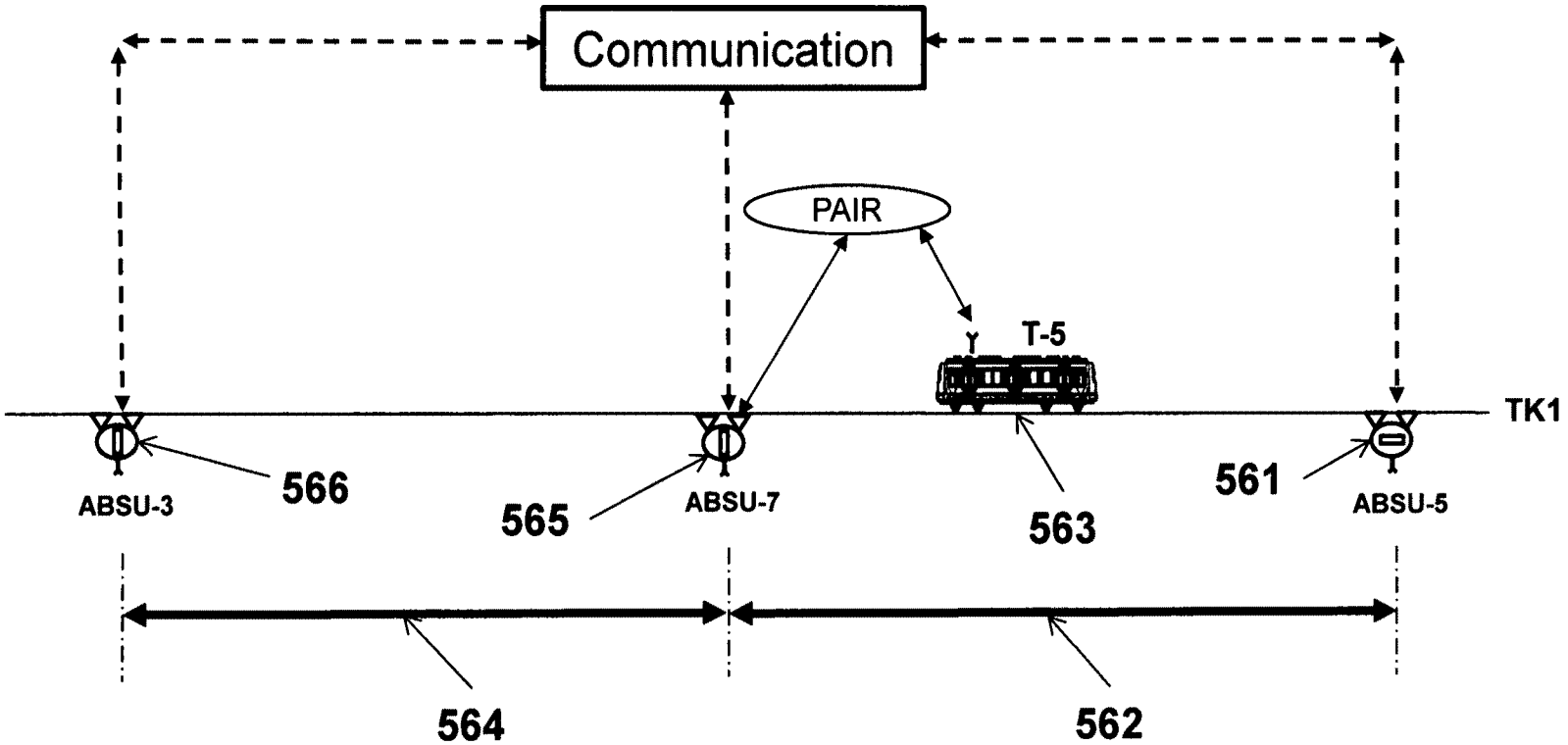
FIG. 28 shows an example of the operation of an Absolute Signal Block Unit during the initialization of a physical train.

An illustration of the sweeping process is shown in FIG. 28, wherein a localized physical train T-5 563 is sieved at the location of ABSU-7 565. The sieving process ensures that there is no short train hidden in front or in the back of the physical train 563. As such, the sieving process is performed in two steps. In the first step, the front of physical train T-5 563 is sieved when T-5 reaches the location of ABSU-7 while the absolute block track space 564 in its entirety is assigned to ABSU-7 565 (i.e. free of physical trains). Alternatively, the front of T-5 is sieved when it reaches the location of ABSU-7 while ABSU-7 holds part of its associated absolute block track space 564. Similarly, in the second step, the rear end of physical train T-5 563 is sieved when all the axles of T-5 pass the location of ABSU-7 565 while the absolute block track space 562 in its entirety is assigned to ABSU-5 561 (i.e. free of physical trains). To implement this sieving process, it is necessary for ABSU-3 566, ABSU-5 561 and ABSU-7 565 to exchange operational data. It is also necessary to establish communication between ABSU-7 565 and T-5 563 to confirm to T-5 that the sieving process was completed successfully. Further, during the implementation of a sieving process, it is necessary for the ABSUs to coordinate their activities and ensure that train movements do not interfere with the sieving process. For example, ABSU-5 561 prevents trains from entering its associated absolute block track space 562 while the sieving process for T-5 563 is on-going. Similarly, ABSU-7 565 prevents T-5 from entering its associated absolute bock track space 564 until it verifies that at least the near end part of this track space is vacant. This will ensure the successful sieving of T-57 563.

It should be noted that additional autonomous train control elements could be implemented in an ATCS system. For example, an autonomous train control element could be defined and implemented to establish a work zone and to authorize the movement of trains within its boundaries. Since work zones could be implemented at any location on the track, they are classified as a temporary autonomous train control element. In the preferred embodiment, a work zone element is created by the Track Space Controller (TSC) and is allocated an initial track space. Upon its creation, the work zone train control element can create virtual trains to operate within its allocated track space. The work zone element can also relinquish track space to other train control elements, including an approaching physical train, based on predefined rules. A physical train operating within the territory assigned to a work zone element must operate at a reduced speed that is established by the work zone element and communicated to the physical train. In the preferred embodiment, track space that is located within a work zone and vacated by a physical train is relinquished back to the work zone element for reassignment to a virtual train or a following physical train. When the work zone is no longer needed and upon receiving confirmation from a supervisory control system, the TSC will retire the work zone element. The track space assigned to the work zone element will then be reassigned to virtual trains and/or to an approaching physical train as the case may be.

Figure 29:
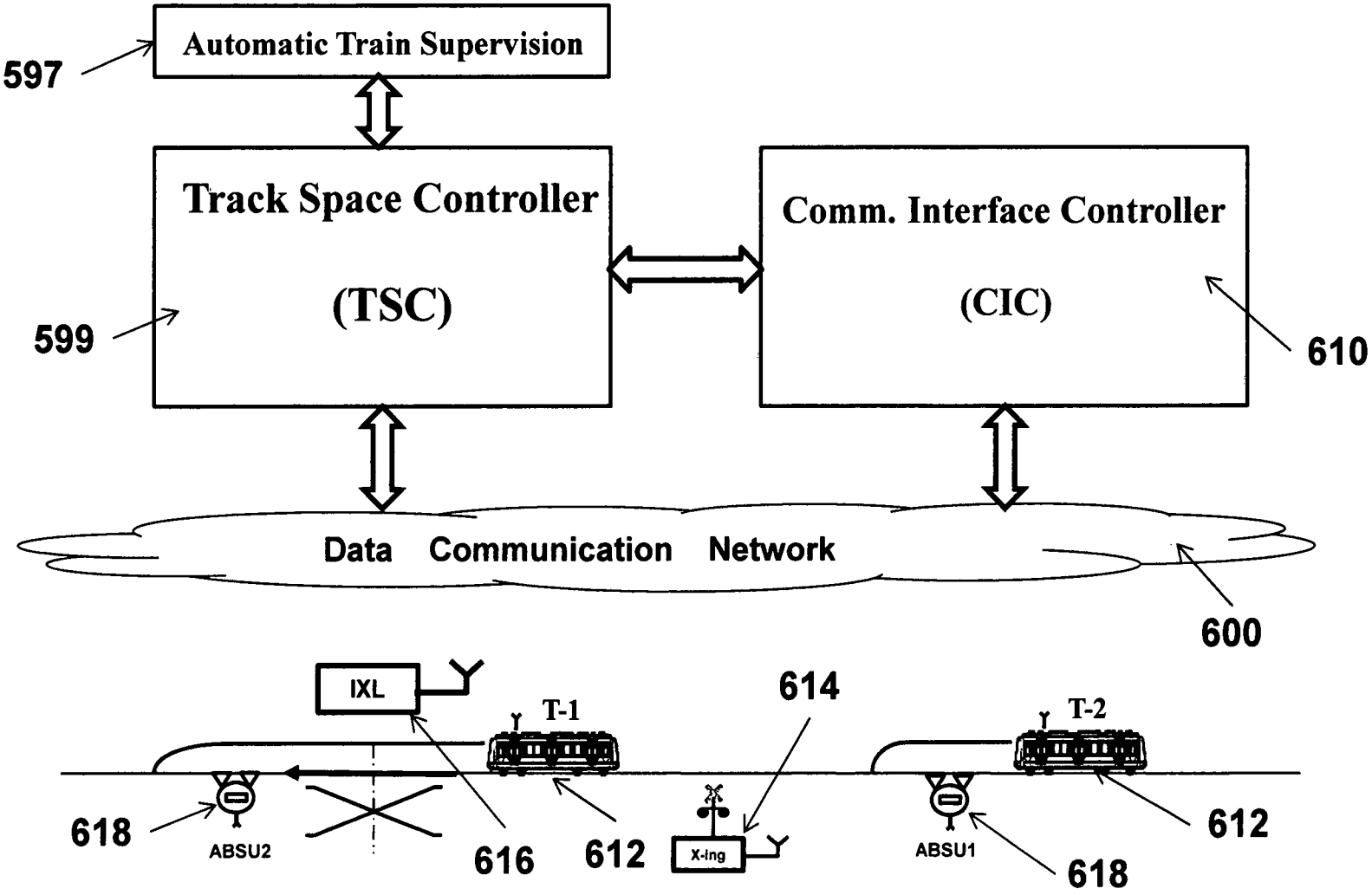
FIG. 29 shows a general block diagram of the Autonomous Train Control System, identifying the main interconnections between the Track Space Controller, the Communication Interface Controller, the Data Communication Network, and the physical autonomous train control elements in accordance with the invention.
Figure 30:
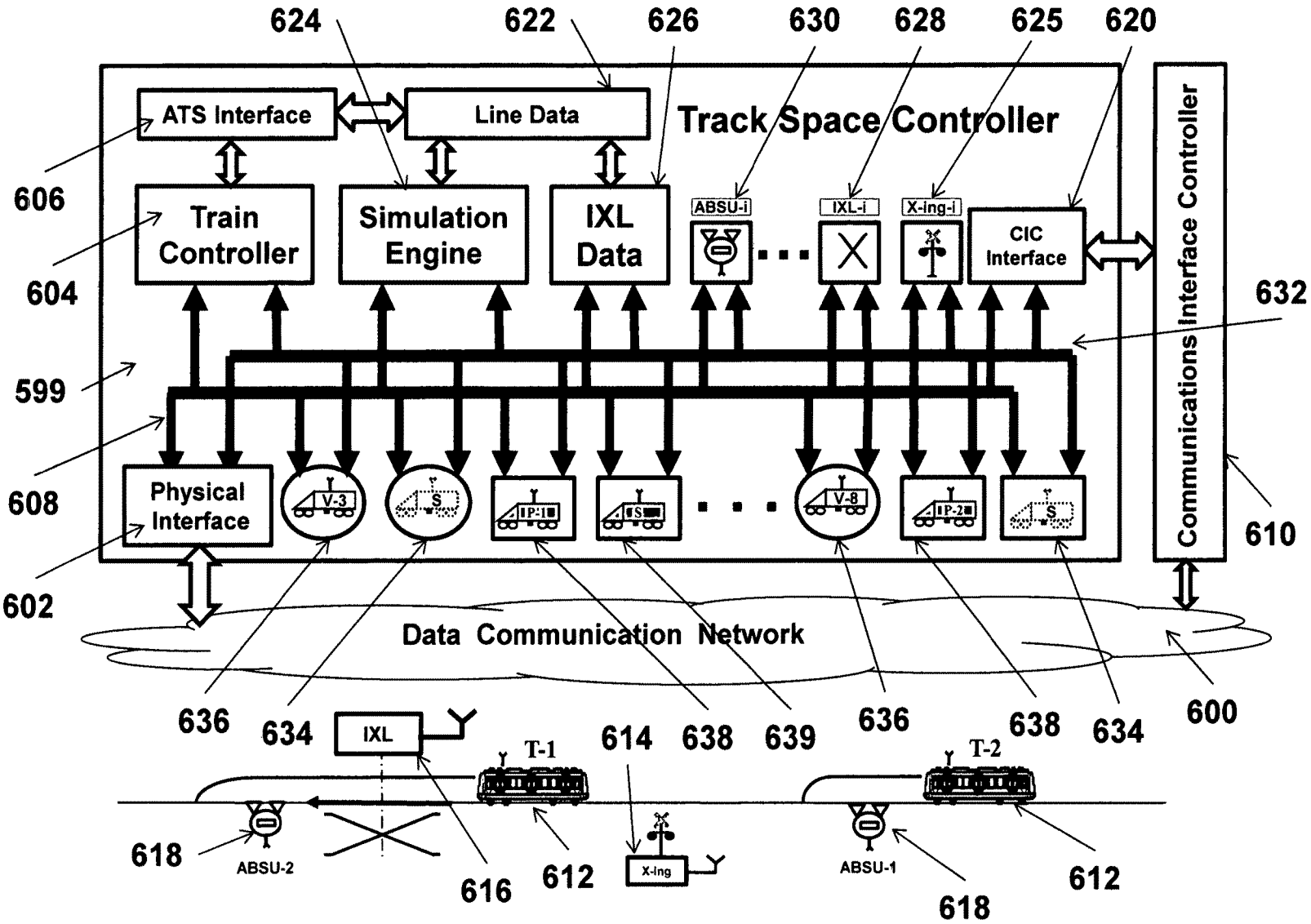
FIG. 30 shows a detailed block diagram of the Track Space Controller in accordance with the preferred embodiment of the invention.

One element of the ATCS is defined as the Track Space Controller (TSC). The TCS manages the interfaces between the various autonomous train control elements, as well as the interfaces between the ATCS elements and other systems in the ATCS operating environment. In addition the TCS manages the creation and retirement of virtual trains and work zone elements. The TCS can be implemented on a dedicated centralized computing environment, or in a network computing environment such as cloud, distributed or virtual network computing. The general architecture of the TCS is demonstrated by the block diagram shown in FIG. 29.

The TCS 599 includes a physical interface module 602 to interface the various TCS elements with physical elements, including physical trains 612, interlocking control elements 616, grade crossing control elements 614 and Absolute Block Signal Units (ABSU) 618. A data communication network 600 is used to interconnect the TCS 599 with the autonomous physical elements. In addition, the TCS 599 includes a diversity of logical and memory modules. Logical modules 634 & 636 are used to provide computing resources for virtual trains, while memory modules 626, 628, 630 & 638 are used to store operational data related to autonomous physical elements.

In the preferred embodiment, the operation of the TCS is controlled by the train controller module 604, which also controls the creation/activation and retirement of virtual trains. To that extent, an address bus 608 and a data bus 632 are used to enable the train controller module 604 to control the operation of the various modules included in the TCS 599. It should be noted that, and as would be understood by a person skilled in the art, a separate TCS processor could be used to control the operation of the TCS. In such an embodiment, the function of the train controller module 604 is limited to the creation/activation and retirement of virtual trains. Upon receiving a request from an autonomous train control element to create or activate a new virtual train, the train controller 604 selects and activates a "spare" logical element 634 to provide the computing resources for the newly created virtual train. The train controller 604 assigns a unique train ID to the newly created virtual train, as well as an initial location that must be confirmed with the autonomous train control element that requested the creation of the new virtual train. Further, the train controller 604 communicates with the Communication Interface Controller CIC 610 via the CIC Interface 620 requesting that the newly created virtual train be paired with the autonomous train control element that requested the creation of the virtual train. In turn, the paired autonomous train control element confirms the location of the new virtual train and relinquishes track space to it.

Alternatively, under certain operating conditions, an autonomous train control element requests the retirement of a virtual train. An example of such operating conditions is during the initialization of a physical train. Typically for the preferred embodiment, a physical train is initialized as a replacement of an existing virtual train, and by acquiring its allocated track space. The virtual train is then switched to a standby mode or state ("standby mode"), its logical element is spared, and the physical train receives an initial movement authority limit associated with the retired virtual train. This movement authority limit is adjusted to account for the length of the physical train. In general, upon receiving a request from an autonomous train control element to retire a virtual train, the train controller 604 acknowledges the request and informs the train control element of a "pending" status of the request. The train control element then acquires the track space assigned to the virtual train, and confirms to the train controller 604 that the virtual train is ready to be retired. Upon receiving such confirmation, the train controller 604 retires the virtual train and assigns a "spare" status to the corresponding logical module 634.

The TSC 599 further includes a Simulation Engine Module 624 that provides nominal operating speeds for the various virtual trains operating in the ATCS territory. The nominal operating speeds are based on the average operating speeds of physical trains 612 operating at various sections of the ATCS territory, as well as civil speed limits. It should be noted that physical trains 612 provide operational data (location, speed, etc.) to corresponding memory modules 638 that reside in the TSC 599.

At the time of a physical train initialization, the train controller 604 assigns a memory module to it. Similarly, each autonomous train control element 614, 616 & 618 is assigned an associated memory module 625, 628 & 630 within the TSC 599. The memory modules stores real time data related to the operational statuses of the corresponding autonomous train control elements, and provide relevant data to the CIC 610. The real time data includes operational and maintenance data and are used to provide train location and status information for the Automatic Train Supervision displays as well as for maintenance functions.

In addition, the TSC 599 includes two memory modules that provide line data necessary for the operation of the autonomous train control elements. The line data memory unit 622 stores track geometry information including data for grades, curves, super elevation, station platforms, civil speed limits, locations of wayside equipment, etc. Similarly, interlocking data memory unit 626 stores data related to interlocking configuration, route and traffic patterns, track switch information, etc. In the preferred embodiment, the line data is downloaded from the Automatic Train Supervision (ATS) system via the ATS interface module 606. In turn, relevant line data is downloaded to physical trains 612 at the time they are initialized in ATCS operation. In addition the ATS system provides itinerary data for each physical train to control and regulate its movement through the ATCS territory. The train itinerary data includes train destination, identity of interlocking routes, required station stops, schedule data, etc. In addition, the ATS system can issue direct commands to physical trains that impact normal scheduled operation. These commands include skip station stop, hold train at station, emergency stop, change itinerary, etc. Further, the ATS system provides line/train regulation data that is sent in the form of performance parameters to physical trains. It should be noted that one design choice is to store the physical train 612 itinerary data, any direct ATS commands and regulation data in the corresponding memory modules 638. In addition, and as disclosed above, operational parameters of virtual trains could be used for the purpose of train regulation.

The physical interface unit 602 provides the needed wireless communications, via wireless communication network 600, between trackside physical elements 612, 614, 616 & 618 and corresponding logical/memory modules 638, 625, 628 & 630. It should be noted that communications between paired and interconnected physical elements do not go through the physical interface 602. However, communications between paired physical elements and virtual trains pass through the physical interface unit 602.

Figure 31:
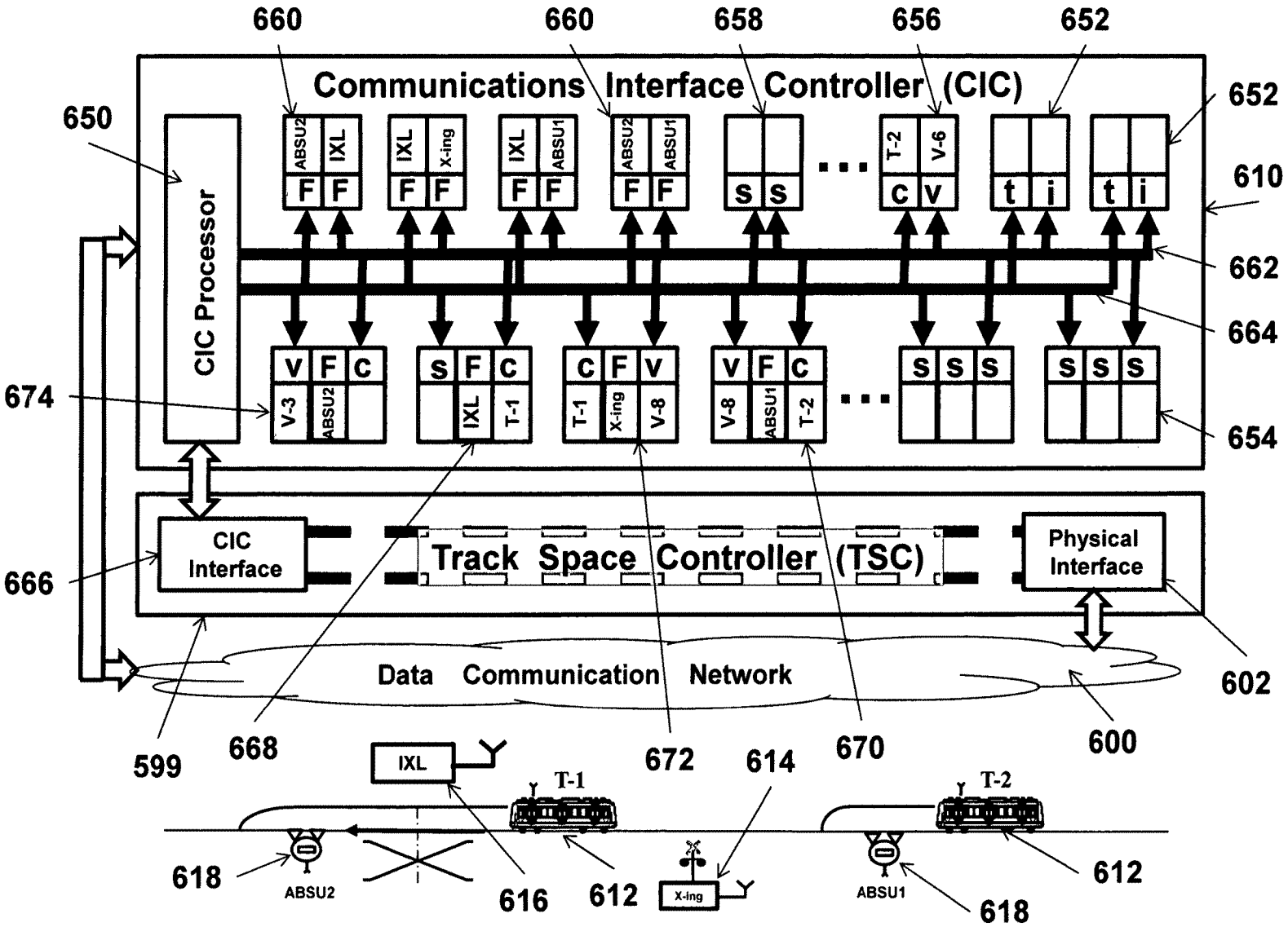
FIG. 31 shows a detailed block diagram of the Communication Interface Controller in accordance with the preferred embodiment of the invention.

Another element of the ATCS is defined as the Communication Interface Controller (CIC). The CIC's main function is to dynamically manage in real time the pairing of various ATCS elements. In general, the CIC receives location information from the Track Space Controller (TSC), and assigns communication frequencies/channels to paired ATCS elements. Further, in the preferred embodiment, the CIC provides fixed communication links/channels between fixed location ATCS elements. The general CIC architecture proposed for the preferred embodiment is shown in FIG. 31.

The CIC 610 includes a CIC processor 650 that control the operation of the CIC unit, a plurality of pairing memory modules 652, 654, 656, 658, 660, 668, 670, 672 & 674, a data bus 662, an address bus 664, and an interface to the data communication system 600. The main function of a pairing memory module is to store in real time the identity information of the ATCS elements paired together, as well as data related to the communication frequencies/channels used for the paired communications. To that extent, and to facilitate the implementation of the pairing process, the preferred embodiment employs an architecture that includes different types of modules. There are modules that include two cells 652, 656, 658 & 660, which are used for the pairing of two ATCS elements. Further, there are modules that include three cells 654, 668, 670, 672 & 674, which are used for the pairing of three ATCS elements. In general, a three-cell module is used to pair a fixed element (IXL 616, XING 614 & ABSU 618) with physical and/or virtual trains. Also, certain two-cell modules 660 are used to pair or provide communication links between fixed location elements. Other two-cell modules 656 are used to pair moving ATCS elements. Spare modules 658 are provided to accommodate increased traffic conditions. In addition, a number of cells 652 are dedicated for incubator functions to establish initial communication between newly initialized physical trains and the TSC 599.

It should be noted that the preferred embodiment employs cell designations to facilitate the dynamic pairing of ATCS elements. For example, the designations "F" for fixed location, "C" for physical train and "I" for incubator are designed to establish communication for physical elements through the Data Communication Network. Similarly, the designations "V" for virtual train and "t" for Track space controller are designed to establish communication to modules within the TSC. The "s" designation is for spare cells. Preferably, the pairing memory modules could be configured geographically during the application design along individual tracks. It should also be noted that the above CIC architecture is being disclosed for the description of the preferred embodiment. As would be understood by persons skilled in the art, different architectures could be devised to provide the functions for the CIC element. For, example network communication switching could be used to provide the interconnections (pairing) for the various ATCS elements. In addition, pairing memory modules capable of pairing more than three elements could be provided if required by the track configuration warrants it.

As would be understood by those skilled in the art, alternate embodiments could be provided to implement an Autonomous Train Control System based on the new concepts disclosed herein. For example, and as disclosed in the detailed description of an alternate embodiment, physical elements, including physical trains, interlocking control devices, grade crossing control devices and ABSUs could be virtualized and implemented in a network computing environment.

DETAILED DESCRIPTION OF AN ALTERNATE EMBODIMENT

Figure 32:
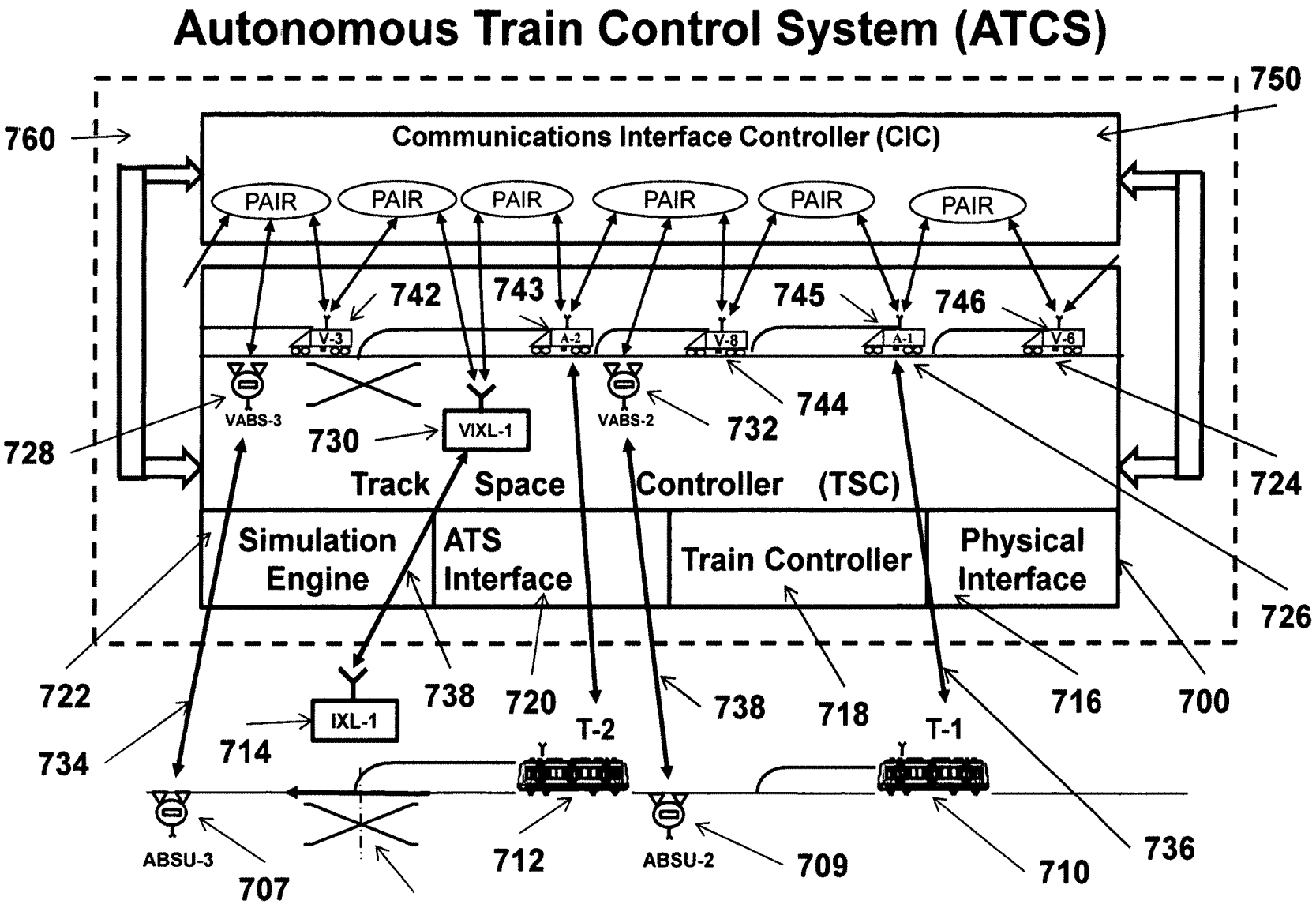
FIG. 32 shows a general block diagram of the Autonomous Train Control System in accordance with the alternate embodiment of the invention.

Referring now to the drawings where the illustrations are for the purpose of describing an alternate embodiment of the invention and are not intended to limit the invention hereto, FIG. 32 shows a block diagram of a configuration of the proposed Autonomous Train Control System (ATCS) in accordance with the teachings of the alternate embodiment. This configuration includes physical trains T-1 710 and T-2 112, virtual trains V-3 742, V-6 746 & V-8 744, interlocking element 706, absolute block signal units ABSU2 709 & ABSU3 707. The ATCS also includes centralized computing resources 760 that is implemented in a cloud computing environment, and which includes two main elements: the Track Space Controller (TCS) 700, and the Communication Interface Controller (CIC) 750.

The TCS 700 includes logical modules that provide virtualization of physical train control elements. More specifically, the TCS 700 includes logical modules that are defined as "Avatar" trains A-1 745 & A-2 743, and which correspond to physical trains T-1 710 and T-2 712. Also, the TCS 700 includes a logical module VIXL-1 730 that virtualizes the interlocking control unit 714. In addition, the TCS 700 includes logical modules VABSU-2 732 and VABSU-3 728 that virtualize Absolute Block Signal Units ABSU-2 709 and ABSU-3 707. It should be noted that if the physical train control installation includes a grade crossing control device, then the ATCS will also include a virtual grade crossing control element that performs the required grade crossing functions in the context of an Autonomous Train Control System.

In the alternate embodiment, the main functions performed by the TCS 700 include the management of virtual trains 742, 744 & 746, the management of logical modules that provide virtual train control elements that correspond to physical elements, management of interfaces 716 and communications between virtual train control elements and corresponding physical elements, and the management of interfaces with external systems 720. In effect, the main concept used in the alternate embodiment is for the virtual train control elements (avatar trains, virtual trains, virtual interlocking control elements, virtual Absolute Block Signal Units, and virtual grade crossing control units) to operate autonomously from each other, exchange virtual track space that corresponds to the physical track space within the ATCS territory, receive status information from corresponding physical elements and transmit control data to corresponding physical elements.

Similar to the preferred embodiment, the main function of the CIC 750 is to pair the virtual train control elements together based on location and operational data received from the TCS 700. As such, for the ATCS configuration shown in FIG. 32, and for the relative positions of trains shown, virtual train V6 724 is paired with avatar train A-1 745, virtual train V-8 744 is also paired with A-1 745. In turn, V-8 744 is also paired with avatar train A-2 743 and virtual absolute block signal unit VABU-2 732. Further, avatar train A-2 743 is paired with virtual interlocking control element VIXL-1 730. In addition, virtual train V-3 742 is paired with VIXL-1 730 and ABSU3 728. It should be noted that avatar trains A-1 and A-2 continuously reflect the movements of associated physical trains T-1 and T-2. It should also be noted that as the relative positions of avatar (physical) trains and virtual trains change, the pairing of train control elements change. This is a dynamic process based train locations and operational data.

Figure 33:
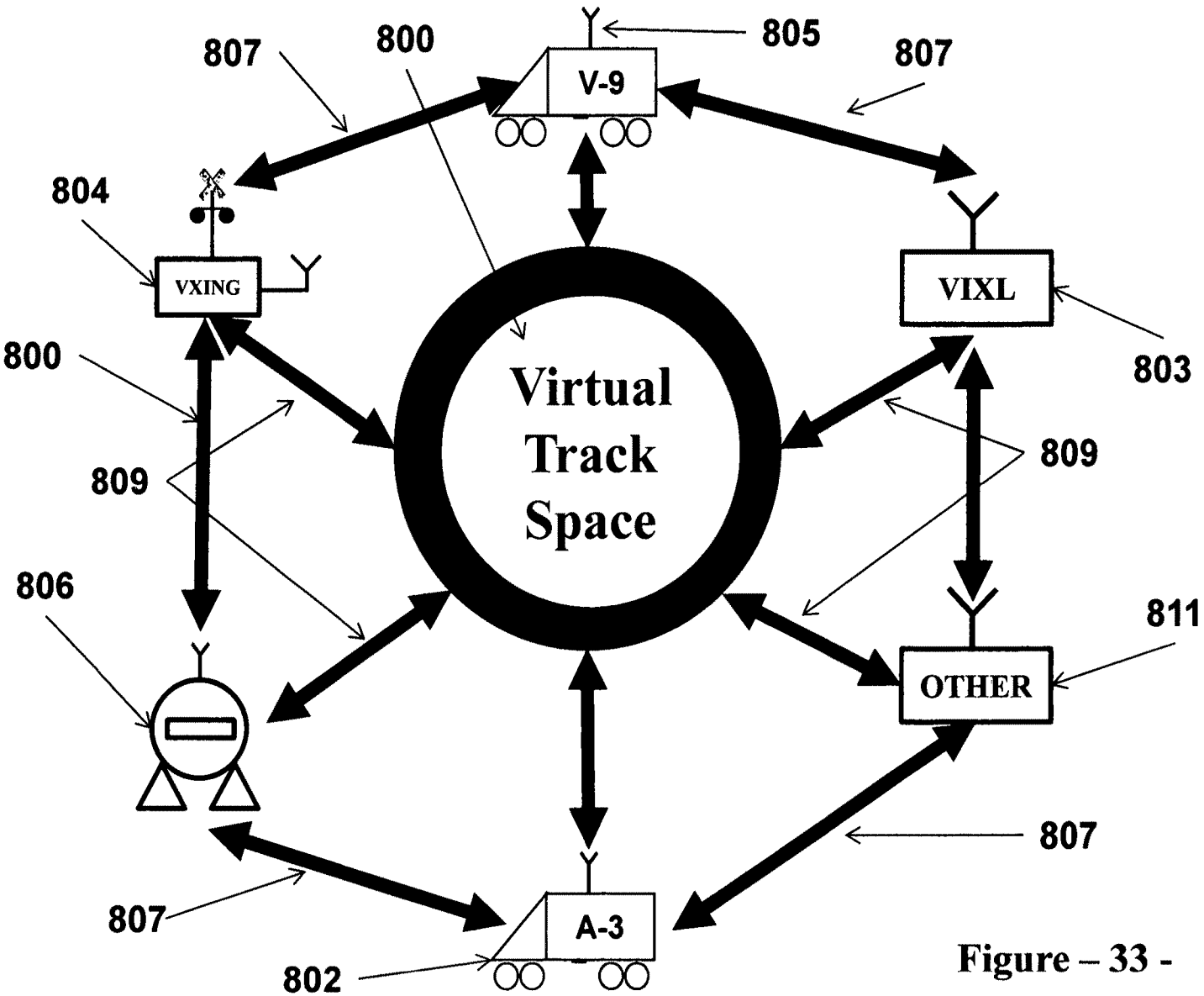
FIG. 33 is a general conceptual diagram of an Autonomous Train Control System showing the various autonomous train control elements, and the interaction between elements related to the acquisition and relinquishment of track space in accordance with the alternate embodiment of the invention.

Referring now to FIG. 33, where the illustrations are for the purpose of describing the alternate embodiment of the invention and are not intended to limit the invention hereto, FIG. 33 is a conceptual diagram of the proposed ATCS, showing virtual track space 800, and the various autonomous virtual train control elements, including avatar trains 802, virtual interlocking control elements 803, virtual grade crossing control elements 804, virtual trains 805, virtual Absolute Block Signal Units (ABSU) 806 & any other virtual train control element 811. The virtual track space 800 corresponds to the track space within the ATCS territory. Similar to the preferred embodiment, the main concept for the operation of the alternate embodiment is for the various virtual train control elements to acquire virtual track space, then operate autonomously within that space in accordance with predefined rules. As part of normal ATCS operation, virtual train control elements exchange virtual track space 807 with paired elements. Similar to the preferred embodiment, the initial allocation of virtual track space 809 to the virtual train control elements is made during system and/or train initialization, and is based on predefined rules.

Figure 34:
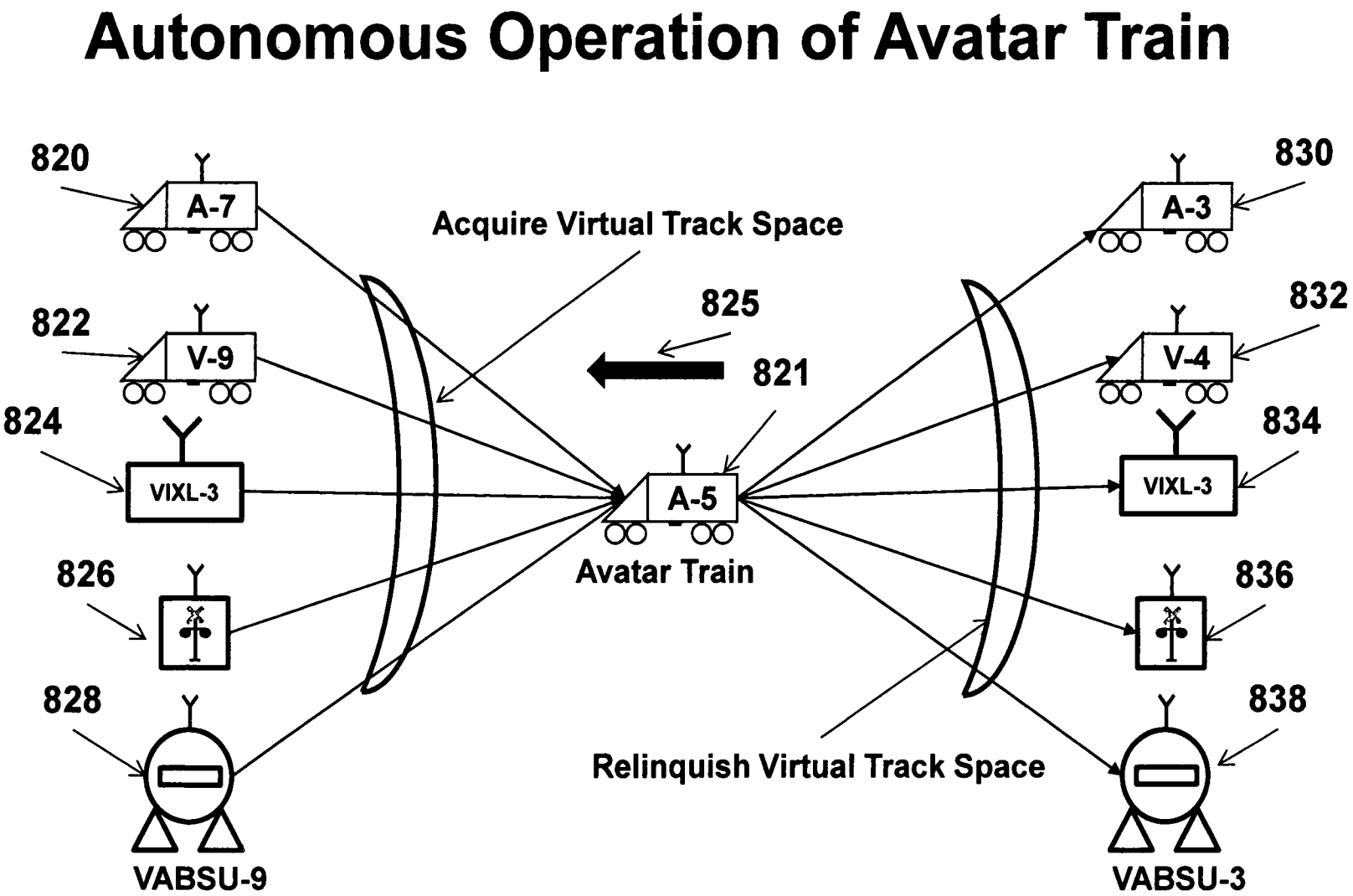
FIG. 34 shows a diagram that demonstrates the autonomous operation of an avatar train with respect to the acquisition and relinquishment of track space in accordance with the invention.

With respect to the autonomous operation of an avatar train, it is similar to the operation of the physical train described in the preferred embodiment. As such, an avatar train acquires and relinquishes virtual track space from/to other virtual train control elements. More specifically, and as shown in FIG. 34, an avatar train 821 can acquire track space from another avatar train 820, a virtual train 822, a virtual interlocking control element 824, a virtual grade crossing control element 826, or a virtual absolute block signal unit (ABSU) 828. The acquisition of virtual track space takes place as a train ahead (avatar 820 or virtual 822) vacates virtual track space, in response to a route request to a virtual interlocking control element 824, in response to a request for virtual track space to a virtual grade crossing control element 826, or during a failure condition, wherein a virtual ABSU 828 relinquishes the virtual track space associated with its absolute signal block (ASB) after ensuring that the ASB is vacant. It should be noted that to proceed through a grade crossing section, it is necessary for the avatar train to acquire track space directly from the grade crossing. A train (avatar or virtual) moving ahead of the avatar train must relinquish/release vacated virtual track space to the virtual grade crossing element for reassignment to the following avatar train.

Similarly, an avatar train 821 can relinquish virtual track space to another avatar train 830, a virtual train 832, a virtual interlocking control element 834 a virtual grade crossing control element 836, or a virtual absolute block signal unit (ABSU) 838. The relinquishing of virtual track space takes place after avatar train 821 vacates virtual track space upon its movement in the indicated direction 825.

Figure 35:
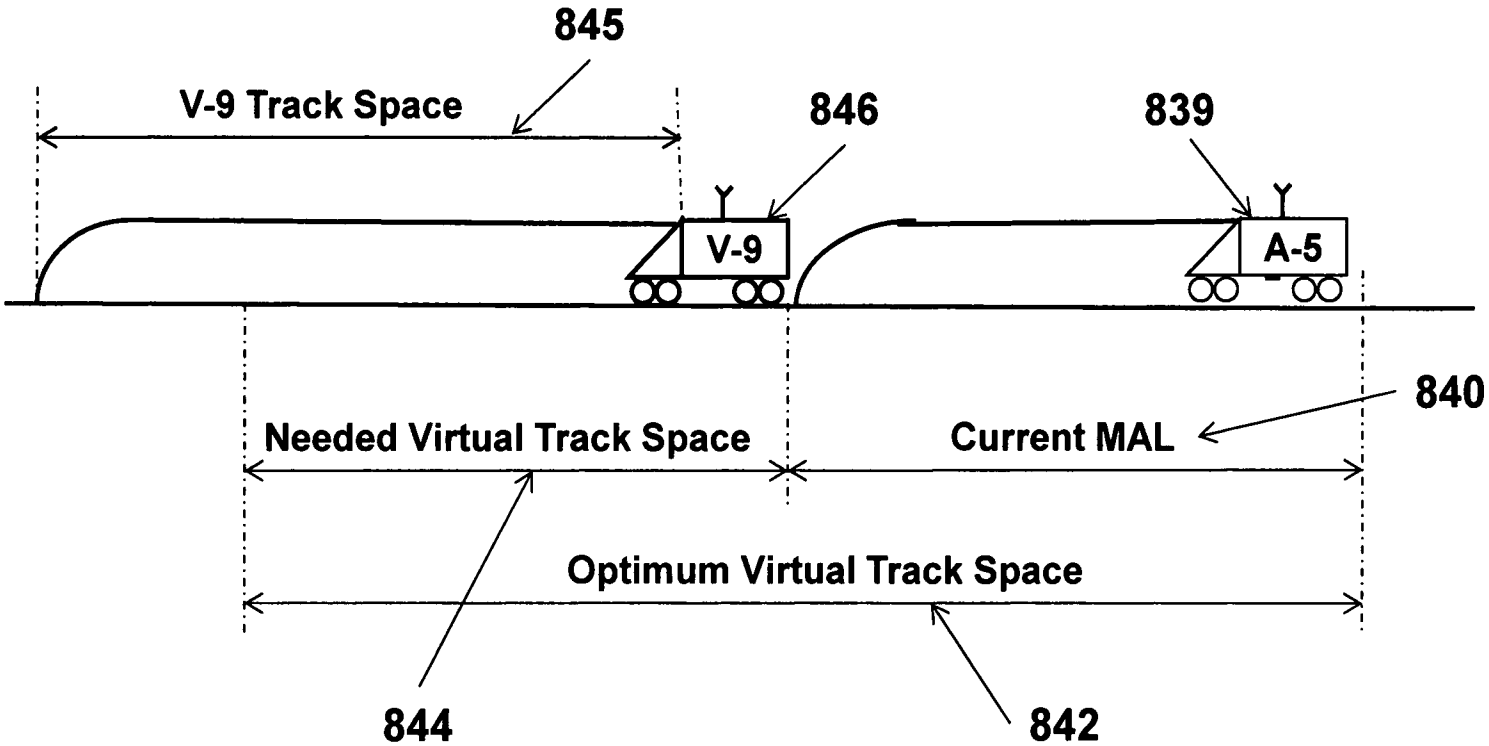
FIG. 35 shows an operational scenario that demonstrates a rule for the autonomous operation of an avatar train in accordance with the invention.
Figure 36:
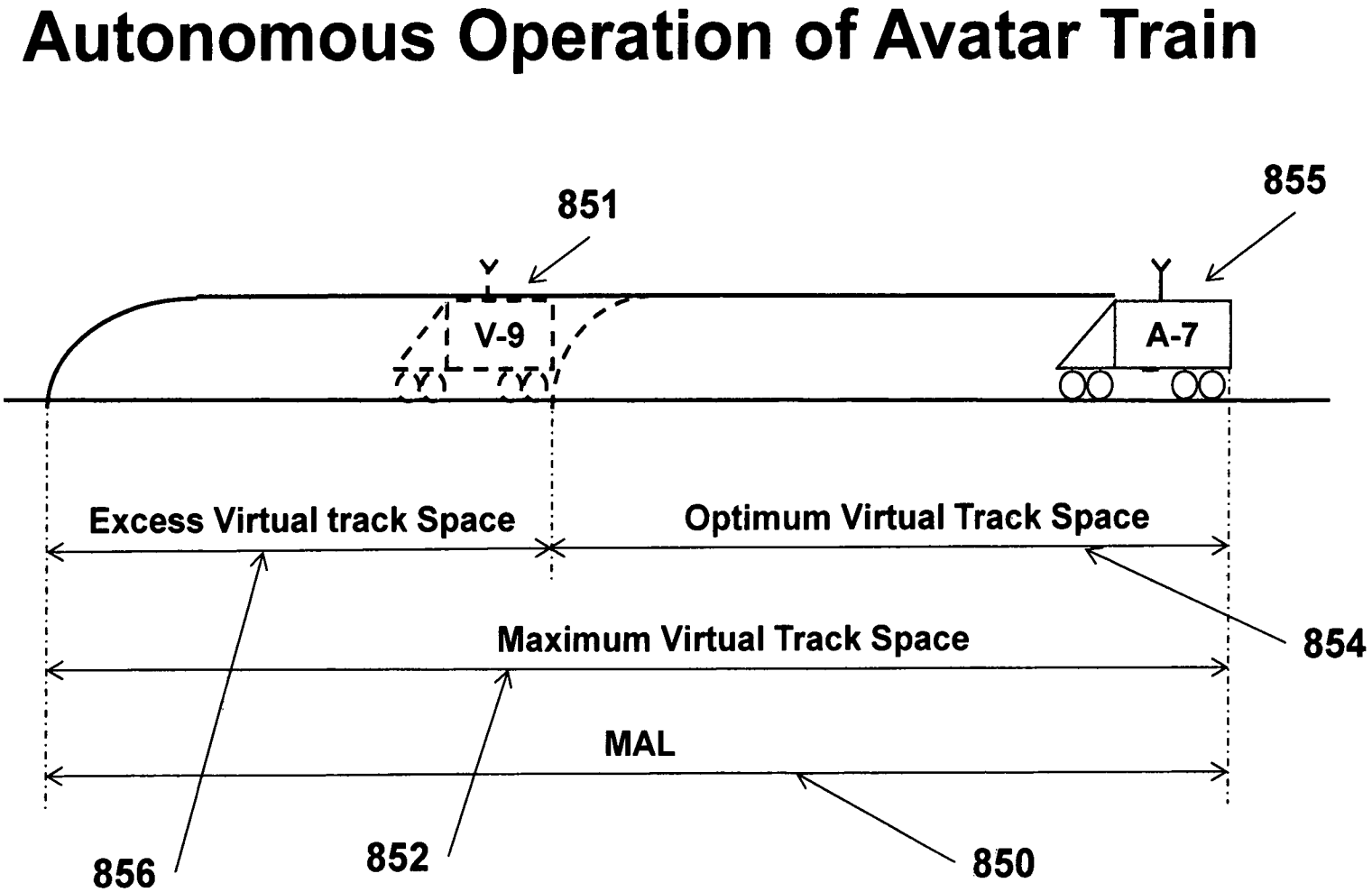
FIG. 36 shows an operational scenario that demonstrates a rule for the autonomous operation of an avatar train in accordance with the invention.

FIGS. 35 & 36 show certain characteristics of the autonomous operation for avatar trains. Each avatar train establishes a movement authority limit (MAL) based on the available virtual track space it has acquired from paired elements. The MAL is then transmitted to the associated physical train. In turn, the physical train establishes a stopping profile that is based on the MAL received from the avatar train. Similar to the preferred embodiment, to the extent possible, it is desirable to provide an "optimum" virtual track space to an avatar train in order for the associated physical train to operate at the maximum allowable operating speed within the ATCS territory. As such, FIG. 35 reflects an operating scenario, wherein the current virtual track space and associated MAL 840 for an avatar train 839 is less than the required optimum virtual track space 842. Based on the premise that avatar trains have an assigned level of virtual track space acquisition priority that is higher than that of virtual trains, the autonomous operation of avatar trains includes a rule wherein an avatar train 839 acquires more track space from a paired virtual train 846 to satisfy its optimum virtual track space requirements. As such, in FIG. 35, avatar train 839 requests virtual track space from paired front virtual train 846 to satisfy the requirement for an optimized virtual track space 842. In the event the needed virtual track space 844 is more that the virtual track space 845 allocated to the virtual train 846, the process is repeated until the optimized virtual track space 842 is satisfied. Alternatively, if the needed virtual track space 844 is less than the track space 845 allocated to the virtual train 846, then the virtual train 846 will relinquish the needed track space 844 to the avatar train 839. However, if the remaining virtual track space for the virtual train 846 is less than a certain threshold, the entire virtual track space 845 assigned to the virtual train 846 is relinquished to the avatar train 839. In such a case, the virtual train 846 is retired.

A second characteristic of the avatar train autonomous operation is associated with the operating scenario depicted in FIG. 36, wherein the virtual track space 852 allocated to an avatar train 855 exceeds a maximum virtual track space threshold 852. Similar to the preferred embodiment, it is not desirable for an avatar train to acquire virtual track space way in excess of its optimum virtual track space. As such, one autonomous operation characteristics of avatar train is to relinquish virtual track space when its allocated space exceeds a maximum threshold. An example of an operational scenario that results in excess virtual track space 856 occurs when a physical train (and associated avatar train) is delayed, and wherein the avatar train keeps accumulating virtual track space from a train ahead that is moving away from its location. In FIG. 36, when the virtual track space allocated to avatar train 855 exceeds the maximum virtual track space threshold 852, the avatar train relinquishes the excess virtual track space 856 for the creation or activation of a new virtual train 851.

As indicated above, the autonomous operation of an avatar train in the alternate embodiment is similar to the autonomous operation of a physical train in the preferred embodiment. As such, additional operational scenarios that involve an avatar train are similar to the operational scenarios disclosed in the preferred embodiment. For example, the operational scenario described in FIG. 6, wherein a physical train relinquishes track space to a paired autonomous train control element that has a higher assigned level of track space acquisition priority.

With respect to the autonomous operation of an avatar train during a failure condition in the associated physical train, the avatar train detects such failure and communicates the failure information to other train control elements. The failure is detected either based on self-diagnostics of the failed physical train or by loss of communication between the avatar train and the physical train. Failure information, including the identity and characteristics of the failed physical train are propagated within the ATCS using daisy chain communication by paired virtual train control elements. Similar to the preferred embodiment, the alternate embodiment identifies a physical train by a "train signature." FIG. 7 shows various design options to provide physical train signature for a train consist 161. The various design options are described and explained in the preferred embodiment.

As in the preferred embodiment, virtual trains are logical elements that represent free/unassigned virtual track space, but have a similar operational behavior to avatar trains. These logical elements are implemented as part of the TSC and operate autonomously based on predefined rules. In addition, the autonomous operation of virtual trains in the alternate embodiment is similar to the autonomous operation of virtual trains in the preferred embodiment, except that virtual trains have to interact with avatar trains in lieu of physical trains. In that respect, the autonomous rules that govern the operation of a virtual train in both the preferred and alternate embodiments are similar. Further, the characteristics of the virtual train autonomous operation are similar in both embodiments.

In the alternate embodiment, the virtual interlocking control element (V-IXL) provides the control logic functions for trackside interlocking equipment. The V-IXL communicates with a physical interlocking interface unit through a data communication network. In turn, the interlocking interface unit provides local control functions for the track side interlocking equipment based on control data received from the V-IXL. Further, the interface unit receives status information from the interlocking trackside equipment, and transmits this information to the V-IXL. The characteristics of the autonomous operation of the V-IXL are similar to the characteristics of the autonomous operation of the interlocking control element in the preferred embodiment. Some of the characteristics are related to operating scenarios, wherein the V-IXL acquires virtual track space from paired elements. Other characteristics are related to operating scenarios, wherein the V-IXL relinquishes virtual track space to paired elements. During these operating scenarios, the V-IXL performs various interlocking functions (modify a route, establish new route, modify traffic direction, etc.). Examples of the operating scenarios are shown in FIGS. 13, 14, 16, 17, 18, 19 & 20, and are described in the preferred embodiment.

The alternate embodiment could also includes a virtual grade crossing control element (V-XING). The V-XING provides the control logic functions for physical grade crossing equipment. The V-XING communicates with a physical grade crossing interface unit through a data communication network. In turn, the grade crossing interface unit provides local control/activation functions for the physical grade crossing equipment based on activation data received from the V-XING. Further, the interface unit receives status information from the grade crossing equipment, and transmits this information to the V-XING. The characteristics of the autonomous operation of the V-XING are similar to the characteristics of the autonomous operation of the grade crossing control element in the preferred embodiment. These characteristics are related to operating scenarios, wherein the V-XING relinquishes/recaptures virtual track space (physical track space in the preferred embodiment) from paired elements. During these operating scenarios, the main function of the V-XING is to provide safe operation of vehicle and rail traffic at an intersection. In general, and as described in the preferred embodiment, the V-XING maintains virtual track space in the approach to and at the associated intersection to allow vehicle traffic to proceed. The V-XING relinquishes virtual track space to paired avatar trains to allow associated physical trains to proceed through the intersection. Further, the V-XING relinquishes virtual track space to other paired elements to allow them to perform various autonomous functions. Examples of the operating scenarios during which virtual track space is exchanged between the V-XING and other virtual train control elements are shown in FIGS. 22 & 23, and are described in the preferred embodiment.

The alternate embodiment also includes an optional virtual Automatic Block Signal Unit (VABSU). The VABSU provides the control logic functions for physical ABSU equipment. The VABSU communicates with a physical ABSU interface unit through a data communication network. In turn, the physical ABSU interface unit provides local control functions for the physical ABSU equipment based on control data received from the VABSU. Further, the interface unit receives status and monitoring data from the physical ABSU equipment, and transmits this information to the VABSU. The characteristics of the autonomous operation of the VABSU are similar to the characteristics of the autonomous operation of the ABSU element in the preferred embodiment. These characteristics are related to operating scenarios, wherein the V-XING relinquishes/recaptures virtual track space from paired elements. During these operating scenarios, the main function of the V-XING is to provide system initialization functions and to support a backup mode of operation during system failures. Further, the interactions between a VABSU and other virtual autonomous train control elements are similar to those described in the preferred embodiment.

The configuration of physical ABSU equipment is similar to the ABSU configuration described in the preferred embodiment and shown in FIG. 24. As in the preferred embodiment, the VABSU operates in a plurality of modes. During a passive mode, the VABSU monitors train movements during normal train operation without any impact on train service. During a failure condition (active VABSU mode), the VABSU provides control function that ensures safe train separation for a failed physical train. During its autonomous mode of operation, the VABSU acquires virtual track space from an avatar train or a virtual train moving away from its location. The VABSU controls the physical ABSU equipment to hold a failed physical train, and allows it to proceed only after ensuring that its associated absolute signal block is vacant. FIGS. 26 & 27 and associated descriptions in the preferred embodiment provide examples of operational scenarios that demonstrate the characteristics of the autonomous operation of ABSUs. The VABSU also provides control functions during system initialization. More specifically, a VABSU controls the movement of an avatar train and associated physical train into its associated signal block to enable the performance of track sweep, and the initialization of a physical/avatar train into ATCS operation. FIG. 28 and associated description in the preferred embodiment provide an example of operational scenario for system initialization.

Figure 37:
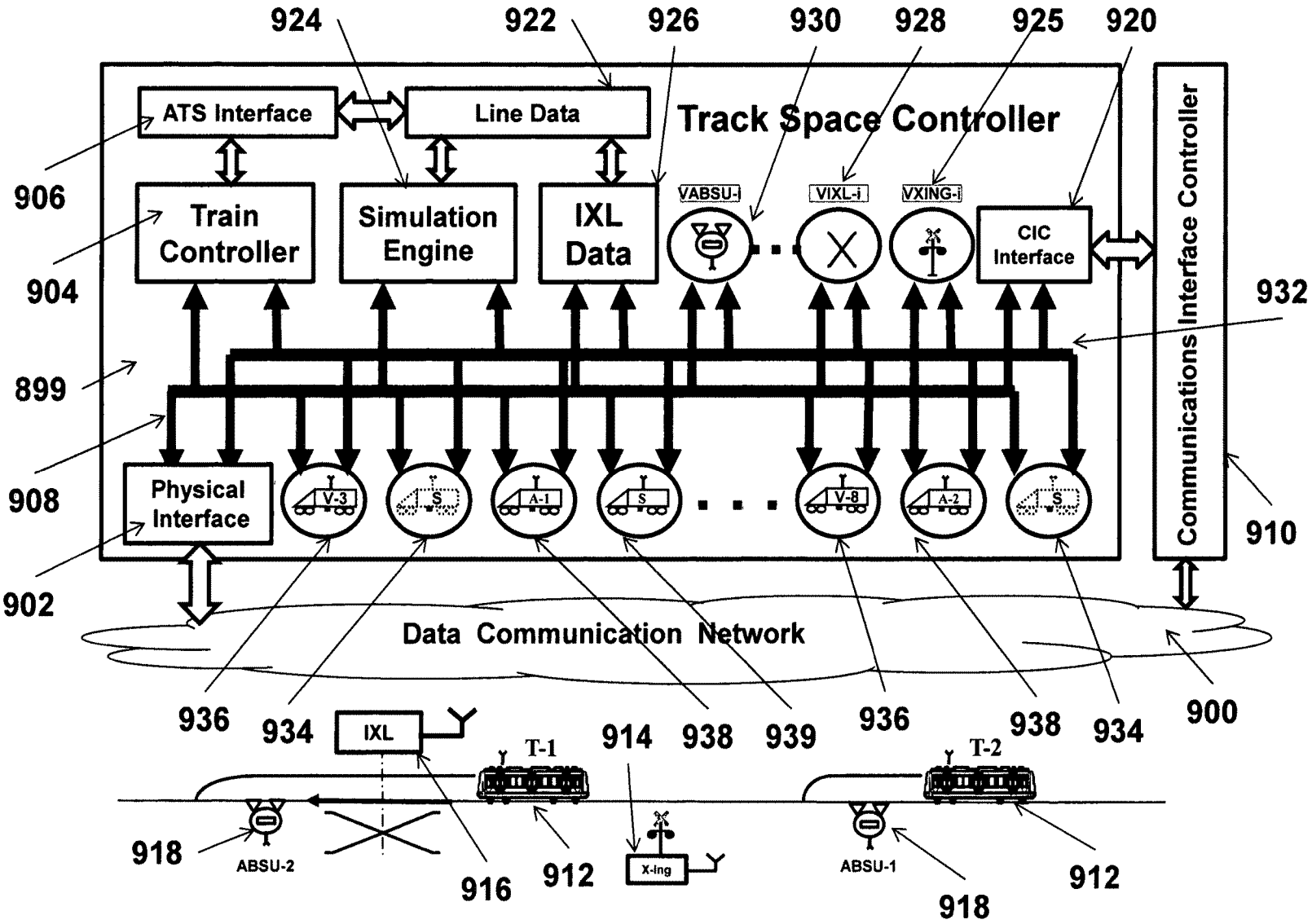
FIG. 37 shows a detailed block diagram of the Track Space Controller in accordance with the alternate embodiment of the invention.

Similar to the preferred embodiment, the alternate embodiment employs a Track Space Controller (TSC), which includes logical elements that provide the autonomous operations for various virtual train control elements. The TCS is implemented in a cloud computing environment to provide a very high level of reliability/availability. The TSC manages the interfaces between virtual train control elements, between virtual elements and associated physical elements, and between virtual elements and external elements in the ATCS operating environment (for example ATS). FIG. 37 shows a block diagram of the architecture for the TCS in accordance with the alternate embodiment. The TCS 899 includes elements that are similar to elements included in the TCS of the preferred embodiment. A physical interface module 902 performs the function of interfacing the various virtual TCS elements with associated physical elements, including physical trains 912, interlocking control elements 916, grade crossing control elements 914 and Absolute Block Signal Units (ABSU) 918. A data communication network 900 is used to interconnect the TCS 899 with the physical elements. In addition, the TCS 899 includes a diversity of logical modules 925, 928, 930, 936 & 938 that are used to provide computing resources for virtual crossing elements, virtual interlocking controllers, virtual ABSUs, virtual trains and avatar trains.

In the alternate embodiment, the operation of the TCS is controlled by the train controller module 904, which also controls the creation/activation and retirement of virtual trains, as well as the management of avatar trains. To that extent, an address bus 908 and a data bus 932 are used to enable the train controller module 904 to control the operation of the various modules included in the TCS 899. It should be noted, and as would be understood by a person skilled in the art, that a separate TCS processor could be used to control the operation of the TCS. In such an embodiment, one of the main functions of the train controller module 904 is to create/activate and retire of virtual trains. Upon receiving a request from a virtual train control element to create or activate a new virtual train, the train controller 904 selects and activates a "spare" logical element 934 to provide the computing resources for the newly created virtual train. The train controller 904 assigns a unique train ID to the newly created virtual train, as well as an initial location that must be confirmed with the virtual autonomous train control element that requested the creation of the new virtual train. Further, the train controller 904 communicates with the Communication Interface Controller CIC 910 via the CIC Interface 920 requesting that the newly created virtual train be paired with the virtual autonomous train control element that requested the creation of the virtual train. In turn, the paired virtual autonomous train control element confirms the location of the new virtual train and relinquishes virtual track space to it.

Alternatively, under certain operating conditions, a virtual autonomous train control element requests the retirement of a virtual train. An example of such operating conditions is during the initialization of a physical/avatar train. Typically for the preferred embodiment, a physical/avatar train is initialized as a replacement of an existing virtual train, and by acquiring its allocated virtual track space. The virtual train is then switched to a standby mode or state ("standby mode"), its logical element is spared, and the avatar train receives an initial movement authority limit associated with the retired virtual train. This movement authority limit is adjusted to account for the length of the associated physical train. In general, upon receiving a request from a virtual autonomous train control element to retire a virtual train, the train controller 904 acknowledges the request and informs the virtual train control element of a "pending" status of the request. The virtual train control element then acquires the virtual track space assigned to the virtual train, and confirms to the train controller 904 that the virtual train is ready to be retired. Upon receiving such confirmation, the train controller 904 retires the virtual train and assigns a "spare" status to the corresponding logical module 934.

Further, the TSC 899 has the function of initializing a new avatar train when a physical train enters or is activated in the ATCS territory. When a new physical train establishes communication with the TSC 899, the train controller 904 assigns a spare logical module 939 to operate as an avatar train it. In addition, at the time the ATCS system is configured, fixed location physical elements are assigned logical elements within the TSC 899. For example, a physical interlocking element 916 is assigned a logical module 928 to operate as a virtual interlocking control element, a physical ABSU element 918 is assigned a logical element 928 to act as a virtual ABSU, and a physical grade crossing element 914 is assigned a logical element 925 to act as a virtual grade crossing control element. In addition to providing autonomous control functions, the logical elements store real time data related to the operational statuses of the corresponding physical train control elements. Also, the logical elements provide relevant data to the CIC 910 to effect the pairing process. The real time data includes operational and maintenance data related to physical/virtual elements and is used to provide train location and status information for the Automatic Train Supervision displays as well as for maintenance functions.

The TSC 899 further includes a Simulation Engine Module 924 that provides nominal operating speeds for the various virtual trains operating in the ATCS territory. The nominal operating speeds are based on the average operating speeds of avatar trains 938, which receive operational data from associated physical trains 912 operating at various sections of the ATCS territory, as well as civil speed limits. In addition, the TSC 899 includes two memory modules that provide line data necessary for the operation of the autonomous virtual train control elements. The line data memory unit 922 stores track geometry information including data for grades, curves, super elevation, station platforms, civil speed limits, locations of wayside equipment, etc. Similarly, interlocking data memory unit 926 stores data related to interlocking configuration, route and traffic patterns, track switch information, etc. In the alternate embodiment, the line data is downloaded from the Automatic Train Supervision (ATS) system via the ATS interface module 906. In turn, relevant line data is provided to avatar trains 938, which in turn download relevant data to associated physical trains 912 at the time they are initialized in ATCS operation. In addition the ATS system provides itinerary data for each avatar train to control and regulate its movement through the ATCS territory. The train itinerary data includes train destination, identity of interlocking routes, required station stops, schedule data, etc. Further, the ATS system can issue direct commands to avatar trains that impact normal scheduled operation. These commands include skip station stop, hold train at station, emergency stop, change itinerary, etc. Also, the ATS system provides line/train regulation data that is sent in the form of performance parameters to avatar trains, and then transmitted to associated physical trains. In addition, and as disclosed above, operational parameters of virtual trains could be used for the purpose of train regulation.

The physical interface unit 902 provides the needed wireless communication interfaces, via wireless communication network 900, between trackside physical elements 912, 914, 916 & 918 and corresponding logical modules 938, 925, 928 & 930. It should be noted that communications between paired virtual train control elements are managed by the Communication Interface Controller 910 based on operational data provided by the TSC 899. Also, the CIC 910 provides initial communication links for physical trains as they enter the ATCS territory.

Figure 38:
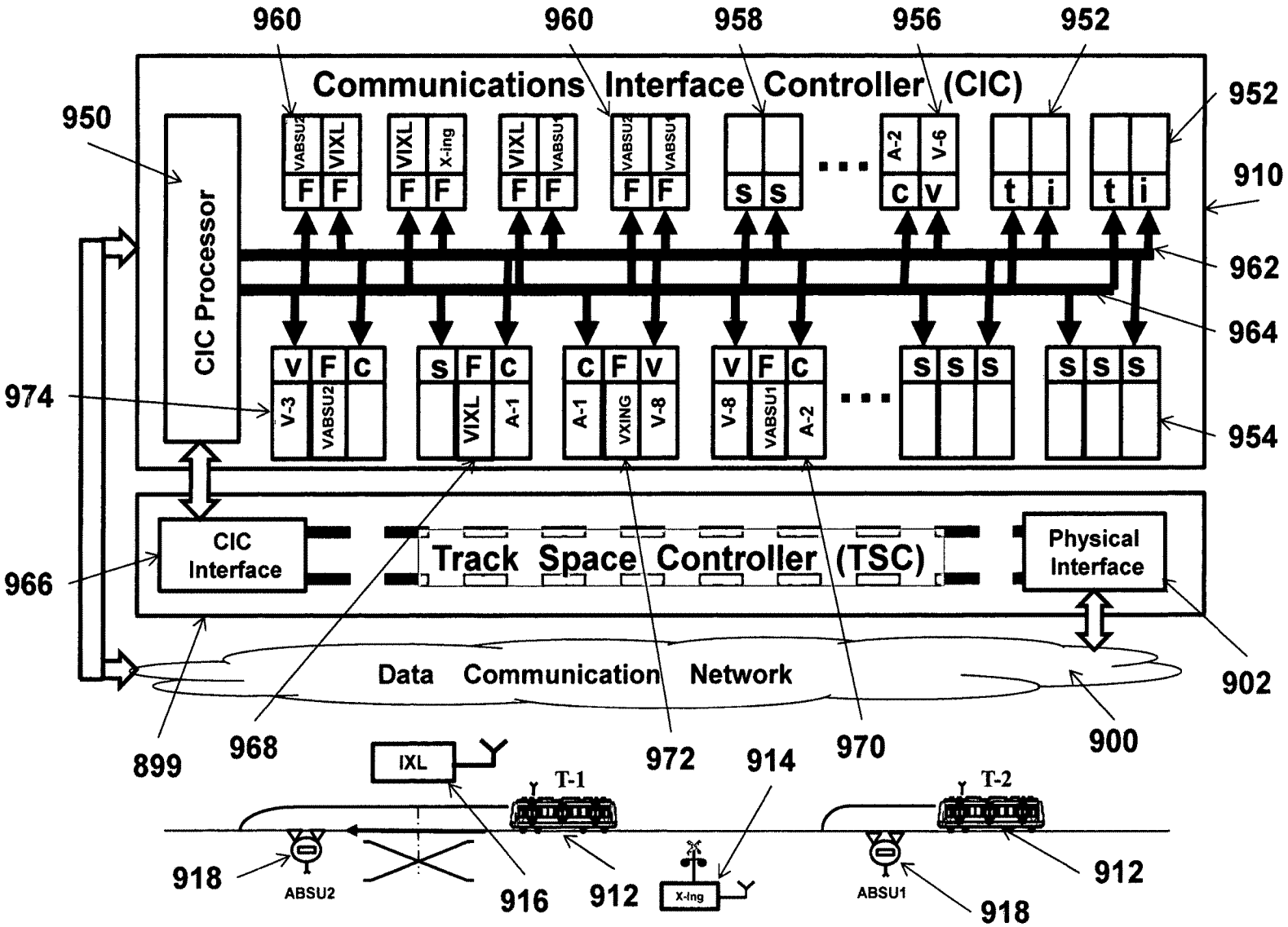
FIG. 38 shows a detailed block diagram of the Communication Interface Controller in accordance with the alternate embodiment of the invention.

Similar to the preferred embodiment, the alternate embodiment includes an ATCS element defined as the Communication Interface Controller (CIC). The CIC's main function is to dynamically manage in real time the pairing of various virtual ATCS elements. In general, the CIC receives location information from the Track Space Controller (TSC), and assigns communication channels to paired virtual ATCS elements. Further, in the alternate embodiment, the CIC manages the allocation of fixed communication links between virtual train control elements that are associated with fixed location physical elements. The general CIC architecture proposed for the alternate embodiment is shown in FIG. 38. It should be noted, and unlike the preferred embodiment, the communication channels needed for communications between the virtual train control elements reside within the TSC 899. As such, one design choice is for the CIC to provide addressing information for the various logical modules to communicate in dynamic pairing configurations.

The CIC 910 includes a CIC processor 950 that control the operation of the CIC unit, a plurality of pairing memory modules 952, 954, 956, 958, 960, 968, 970, 972 & 974, a data bus 962, an address bus 964, and an interface to the data communication network 900. The main function of a pairing memory module is to store in real time the identity (or address) information of the virtual ATCS elements paired together, as well as data related to the communication links used for the paired communications. To that extent, and to facilitate the implementation of the pairing process, the alternate embodiment employs an architecture that includes different types of modules. There are modules that include two cells 952, 956, 958 & 960, which are used for the pairing of two virtual ATCS elements. Further, there are modules that include three cells 954, 968, 970, 972 & 974, which are used for the pairing of three virtual ATCS elements. In general, a three-cell module is used to pair a fixed location element (VIXL 916, VXING 914 & VABSU 918) with avatar and/or virtual trains. Also, certain two-cell modules 960 are used to pair or provide communication links between fixed location virtual elements. Other two-cell modules 956 are used to pair moving virtual ATCS elements. Spare modules 958 are provided to accommodate increased traffic conditions. In addition, a number of cells 952 are dedicated for incubator functions to establish initial communication between newly initialized physical trains and the TSC 899. It should be noted that in the alternate embodiment, one design choice is to integrate the CIC 910 as part of the TSC architecture 899. In such configuration, the TSC performs the functions performed by the CIC.

It should be noted that the foregoing detailed descriptions of the preferred and alternate embodiments have been given to demonstrate the various disclosed concepts and functions. As would be understood by a person skilled in the art, there are different design choices to implement the concepts presented herein. It should also be noted that the various autonomous elements disclosed in the preferred and alternate embodiments can utilize alternate vital programs to implement the described autonomous train control functions. Obviously these programs will vary from one another in some degree. However, it is well within the skill of the signal engineer to provide particular programs for implementing vital algorithms to achieve the functions described herein. In addition, it is to be understood that the foregoing detailed descriptions of the preferred and alternate embodiments have been given for clearness of understanding only, and are intended to be exemplary of the invention while not limiting the invention to the exact embodiment shown. Obviously certain subsets, modifications, simplifications, variations and improvements will occur to those skilled in the art upon reading the foregoing. It is, therefore, to be understood that all such modifications, simplifications, variations and improvements have been deleted herein for the sake of conciseness and readability, but are properly within the scope and spirit of the following claims.

The invention claimed is:

1. A train control system that includes a plurality of autonomous train control elements, wherein the train control system controls the movement of trains within a section of track, wherein an autonomous train control element operates independent of other elements, wherein said plurality of autonomous train control elements include a plurality of autonomous virtual train control elements and a plurality of autonomous physical train control elements, wherein an autonomous virtual train control element controls the movement of a virtual train and is assigned free track space that extends beyond the entire length of the virtual train, wherein an autonomous physical train control element controls the movement of a physical train and has designated track space, and wherein upon the movement of an autonomous physical train, the physical train relinquishes vacated track space to one of an autonomous virtual train control element and an autonomous physical train control element.

2. A train control system as recited in claim 1, wherein an autonomous physical train control element is assigned a higher level of priority with respect to the acquisition of track space.

3. A train control system as recited in claim 1, further comprising a communication system that performs the function of pairing at least two autonomous train control elements together.

4. A train control system as recited in claim 1, wherein upon the movement of an autonomous virtual train, the virtual train relinquishes vacated track space to one of an autonomous virtual train control element and an autonomous physical train control element.

5. A train control system as recited in claim 1, wherein said autonomous train control elements further includes an autonomous interlocking control element.

6. A train control system as recited in claim 5, wherein said autonomous interlocking control element performs interlocking functions within designated track space, based on predefined rules, to establish and secure train routes within interlocking limits.

7. A train control system as recited in claim 6, wherein said autonomous interlocking control element relinquishes track space over a secured train route to one of an autonomous virtual train control element and an autonomous physical train control element.

8. A train control system as recited in claim 1, further including an autonomous grade crossing control element that operates based on predefined rules within allocated track space to control the operation of a grade crossing at a road intersection.

9. A train control system as recited in claim 1, further including an autonomous signal control device that provides a backup mode of operation, wherein said autonomous signal control device operates based on the absolute block principle.

10. A train control system that includes a plurality of autonomous train control elements, wherein the train control system controls the movement of trains within a section of track, wherein an autonomous train control element operates independent of other elements based on predefined rules, wherein said plurality of autonomous train control elements include at least one of a plurality of autonomous physical train control elements, a plurality of autonomous virtual train control elements, an autonomous interlocking control element, and an autonomous grade crossing control element, wherein an autonomous virtual train control element controls the movement of a virtual train and is assigned free track space that extends beyond the entire length of the virtual train, wherein an autonomous physical train control element controls the movement of a physical train and has designated track space, and wherein upon the movement of an autonomous physical train, the physical train relinquishes vacated track space to at least one of an autonomous virtual train control element, an autonomous physical train control element, an autonomous interlocking control element and an autonomous grade crossing control element.

11. A train control system as recited in claim 10, and further comprising a communication system that performs the function of pairing at least two autonomous train control elements together.

12. A train control system as recited in claim 10, wherein upon the movement of an autonomous virtual train, the virtual train relinquishes vacated track space to at least one of an autonomous virtual train control element and an autonomous physical train control element, an autonomous interlocking control element and an autonomous grade crossing control element.

13. A train control system as recited in claim 10, further comprising a plurality of logical modules in a cloud computing environment, which correspond to said plurality of autonomous physical train control elements.

14. A train control system as recited in claim 10, further comprising a control module that manages the creation, movements and removal of virtual trains.

15. A train control system as recited in claim 10, wherein an autonomous physical train control element generates a movement authority limit to associated physical train, wherein said movement authority limit is within the track space allocated to the physical train.

16. A train control system as recited in claim 10, wherein an autonomous physical train control element ensures that the speed of the associated physical train does not exceed the civil speed limits within the allocated track space.

17. A train control system as recited in claim 10, wherein said predefined rules include rules for the acquisition of track space and rules for relinquishing track space.

18. A train control system as recited in claim 10, wherein said autonomous grade crossing control element controls the operation of grade crossing equipment at a rail/vehicle intersection based on predefined rules within an allocated track space, and wherein said autonomous grade crossing control element communicates directly with road vehicles approaching the intersection.

19. A train control system that controls the movement of trains within a section of track, wherein said train control system includes at least one of a plurality of autonomous physical train control elements, a plurality of autonomous virtual train control elements, an autonomous interlocking control element and an autonomous grade crossing control element, wherein autonomous train control elements operate within allocated track space based on predefined rules, wherein an autonomous train control element operates independent of other elements, wherein an autonomous train control element is paired with at least one other autonomous train control element, wherein an autonomous virtual train control element is assigned free track space that extends beyond the entire length of the virtual train, wherein an autonomous train control element includes a processor module with a computer-readable medium encoded with a computer program to control the operation of the autonomous train control element, comprising the following steps:

- performing autonomous train control functions within allocated track space,
- determining if additional track space is needed to perform said autonomous functions,
- acquiring track space from paired autonomous train control element, and
- relinquishing track space to at least one paired autonomous train control element.

20. A train control system as recited in claim 19, wherein at least one of the autonomous train control elements has a high level of priority related to the acquisition of track space.

* * * * *